US006032494A

United States Patent [19]

Tanigawa et al.

[11] Patent Number: 6,032,494

[45] Date of Patent: Mar. 7, 2000

[54] DRUM TYPE DRYING/WASHING MACHINE

[75] Inventors: Masanobu Tanigawa, Takatsuki; Hiroyasu Nakagawa; Tsuyoshi Matsumoto, both of Kitakatsuragi-gun, all of Japan

[73] Assignee: Sharp Kabushiki Kaisha, Osaka, Japan

[21] Appl. No.: 09/272,242

[22] Filed: Mar. 19, 1999

Related U.S. Application Data

[62] Division of application No. 08/697,265, Aug. 21, 1996, Pat. No. 5,887,456.

[30] Foreign Application Priority Data

| | | | |
|---|---|---|---|
| Aug. 30, 1995 | [JP] | Japan | 7-221491 |
| Feb. 1, 1996 | [JP] | Japan | 8-16357 |
| Feb. 26, 1996 | [JP] | Japan | 8-37748 |
| May 22, 1996 | [JP] | Japan | 8-127302 |
| Jun. 25, 1996 | [JP] | Japan | 8-164012 |

[51] Int. Cl.[7] ..... D06F 33/02

[52] U.S. Cl. ..... 68/12.06; 68/19.2

[58] Field of Search ..... 68/19.2, 20, 12.06, 68/58, 140

[56] References Cited

U.S. PATENT DOCUMENTS

| | | | |
|---|---|---|---|
| 2,920,470 | 1/1960 | Bochan | 68/12.06 |
| 2,943,472 | 7/1960 | Painter | 68/12.06 |
| 2,950,009 | 8/1960 | Bochan | 68/12.06 |
| 3,055,203 | 9/1962 | Toma | 68/12.06 |
| 3,098,372 | 7/1963 | Bochan | 68/12.06 |
| 3,152,462 | 10/1964 | Elliott et al. | 68/12.06 |
| 3,273,361 | 9/1966 | Smith | 68/12.06 |
| 3,347,065 | 10/1967 | Stilwell, Jr. | 68/19.2 |
| 3,583,182 | 6/1971 | Matsuura et al. . | |
| 3,640,098 | 2/1972 | Eastall | 68/12.06 |
| 3,674,419 | 7/1972 | Tichy | 68/12.06 |
| 3,731,550 | 5/1973 | Malecki et al. . | |
| 3,924,833 | 12/1975 | Korrell et al. . | |
| 4,112,767 | 9/1978 | Bochan . | |
| 4,411,664 | 10/1983 | Rickard et al. | 68/12.06 |
| 4,498,317 | 2/1985 | Thysen | 68/19.2 |
| 4,765,161 | 8/1988 | Williamson | 68/12.06 |
| 5,029,458 | 7/1991 | Obata et al. | 68/19.2 |
| 5,107,606 | 4/1992 | Tsubaki et al. | 68/19.2 |
| 5,146,693 | 9/1992 | Dottor et al. . | |
| 5,212,969 | 5/1993 | Tsubaki et al. | 68/19.2 |
| 5,768,730 | 6/1998 | Matsumoto et al. | 68/12.06 |

FOREIGN PATENT DOCUMENTS

| | | | |
|---|---|---|---|
| 2311883 | 12/1976 | France . | |
| 1585945 | 2/1963 | Germany . | |
| 2215319 | 3/1972 | Germany . | |
| 3017109 | 11/1981 | Germany . | |
| 3416639 | 11/1985 | Germany . | |
| 3421845 | 12/1985 | Germany . | |
| 0481442 | 4/1992 | Germany . | |
| 499506 | 3/1974 | Japan . | |
| 50-16099 | 6/1975 | Japan . | |
| 61-234897 | 6/1975 | Japan . | |
| 3-86197 | 4/1991 | Japan | 68/12.06 |
| 386197 | 4/1991 | Japan . | |
| 2073257 | 10/1981 | United Kingdom . | |

*Primary Examiner*—Frankie L. Stinson

[57] ABSTRACT

A drum type drying/washing machine performs drying without the flow of cooling water during a predetermined period of time or a period of time determined in accordance with an amount of clothes. After the passage of the period of time, the machine starts the flow of the cooling water so as to perform drying with cooling-dehumidication. The drum type drying/washing machine, at the initial stage of the drying operation, also performs not only the heating of clothing, but also the rotating of a drum at a high speed to dehydrate the clothing. A drum type drying/washing machine rotates a drum at an almost a maximum rotational rate at which, in a low speed rotation, materials to be processed can roll over in the drum; or at a rotational rate above which, in the low speed rotation, the materials to be processed as a whole stick to the inner peripheral wall of the drum. Further, the drum is accelerated to a high speed rotation only when an output from an unbalance detecting device is a predetermined level or less.

26 Claims, 45 Drawing Sheets

FIG. 5

| DETERMINED AMOUNT OF CLOTHING | LESS | NORMAL | MORE |
|---|---|---|---|
| PRE-SELECTED TIME | 10 min. | 15 min. | 20 min. |

FIG. 6

| DETERMINED AMOUNT OF CLOTHING | LESS | NORMAL | MORE |
|---|---|---|---|
| PRE-SELECTED TIME | 5 min. | 10 min. | 15 min. |

60 rpm VIBRATION WAVEFORM 70 rpm VIBRATION WAVEFORM 80 rpm VIBRATION WAVEFORM 90 rpm VIBRATION WAVEFORM RATIO OF VIBRATION EQUAL TO OR LESS THAN PREDETERMINED VIBRATION TO NUMBER OF TIMES FOR ACCELERATION (A PAIR OF JEANS,n=50, RESPECTIVELY, VIBRATION ACCELERATION IS 5.0m/s$^2$ OR LESS)

① RANDOM ACCELERATION(ACCELERATING PERIOD 2 SEC.)

② RANDOM ACCELERATION(ACCELERATING PERIOD 10 SEC.)

RATIO OF VIBRATION EQUAL TO OR LESS THAN PREDETERMINED VIBRATION TO NUMBER OF TIMES FOR ACCELERATION (A PAIR OF JEANS, n=50, RESPECTIVERY, VIBRATION ACCELERATION IS 5.0m/s$^2$ OR LESS)

LOW PASS FILTER (BASIC CIRCUIT)

( OUTPUT FROM ACCELERATION SENSOR )

( 3 Hz LPF OUTPUT )

( OUTPUT FROM ACCELERATION SENSOR )

( 3 Hz LPF OUTPUT )

( OUTPUT FROM ACCELERATION SENSOR )

( 1 Hz LPF OUTPUT )

BASIC CHART OF ACCELERATION

BASIC CHART OF RE-ACCELERATION (WHEN FIRST ACCELERATION HAS FAILED)

DRUM TYPE DRYING/WASHING MACHINE

This application is a divisional of application Ser. No. 08/697,265, filed on Aug. 21, 1996, now U.S. Pat. No. 5,887,456, the entire contents of which are hereby incorporated by reference.

BACKGROUND OF THE INVENTION (1) Field of the Invention

The present invention relates to a drum type drying/washing machine which is able to singly perform washing through drying laundry, and which holds the laundry in a drum which is driven to rotate about a horizontal shaft and which dries it by cooling-dehumidication using cooling water while performing dehydration by a high speed rotation of the drum.

Further, the present invention relates to a drum type drying/washing machine that performs washing and dehydrating (and optionally drying) fabrics such as clothes etc., as well as a machine that only performs a drying operation.

(2) Description of the Prior Art

In conventional drum type driers, for example, drum type full automatic drying/washing machines, a method called 'cooling-dehumidication' has been known in which drying is performed by using air ventilation, heating and water cooling as soon as the drying operation is started. There has not been any known method in which drying is performed by stopping the flow of cooling water for a predetermined period of time immediately after the drying is started, in which dehydration by high speed drum rotation will be performed during drying, or in which clothes are relocated during drying by performing a high speed drum rotation.

There is a method which can reduce the power consumption of the heater near the end of the drying process, but no method has been found which stops and starts the flowing of cooling water at intervals whilst reducing the power consumption of the heater.

Accordingly, in the conventional drum type driers of this kind, much water and time were needed for drying and still there was a problem that drying unevenness would occur depending on the locations of clothes.

In the drum type drying/washing machine, detergent and water are supplied after laundry has been loaded to the loading port for laundry. Then, after washing, the washing liquid is drained and dehydrated. Subsequently, the laundry is supplied with water, rinsed and dehydrated. At the final stage, the laundry undergoes the heat drying treatment using a heater.

High-temperature, low-humidity air which is obtained by the heat treatment using the heater is supplied into the drum through an orifice located above the loading port of the drum type drying/washing machine so that, whilst the laundry is heated, damp contained in the laundry is removed to be exhausted from the drum. The exhausted air which now has become of high temperature and high humidity is transported through a duct around which cooling water is supplied from above the duct, so that the moisture in this air is condensed by the cooling water, and thus the air becomes of low temperature and low humidity. This air is further sucked out by a fan to the drying heater. The thus delivered air is heated to be of high temperature and low humidity, and then is blown into the drum through a blower port.

The above conventional drum type drying/washing machine, however, needed a long running time. Specifically, for drying/washing a 2 kg laundry, it took 162 min. in total, 72 min. for washing and 90 min. for drying. For a 3 kg laundry, it took 222 min. in total, 80 min. for washing and 142 min. for drying.

Japanese Patent Application Laid-Open Sho 61 No.234897 has proposed an idea in which the dehydration rate is increased by taking in hot air which is discharged from a clothing drier into the dehydrating container of a two-tub washing machine. However, this proposal is not practical.

Further, in accordance with conventional drum type washing machines, the drum is made to turn at such a low speed that materials to be processed are able to move during washing, whereas dehydration is performed by rotating the drum at such a high speed that the materials to be processed are stuck to the interior peripheral wall surface of the drum. However, such control suffers from a problem that if the materials to be processed are distributed unevenly inside the drum, anomaly vibrations might occur. Various methods have been proposed to solve this problem.

For example, Japanese Patent Publication Sho 49 No.9506 has proposed a drum type washing machine including a detector which detects the horizontal vibrating amplitude of the drum, over a certain period of time longer than one-cycle (one revolution) of the drum when the drum is rotated at a low rate, and based on the detected result, only if the average of the detected values is not more than a predetermined value, the driving state of drum will be transferred to a high speed rotation mode.

Japanese Patent Publication Sho 50 No.16099 has proposed a drum type washing machine including a detector which detects the horizontal vibrating amplitude of the drum, so that this detector will detect the vibrating amplitude of the water tank containing the drum during the rotation at a low rate, and only if the magnitude of the vibrating amplitude is not more than a predetermined value and the state is continued over a certain period of time longer than one-cycle (one revolution) of the drum, the driving state of the drum is transferred to a high speed rotation mode.

Japanese Patent Application Laid-Open Hei 3 No.86197 has proposed a drum type washing machine wherein the drum is rotated for pre-dehydration at a rate in between that of the low speed turn for washing and the high speed rotation for dehydrating, and only if the variation of the detected value outputted from a rotational speed detector which detects the rotational speed of the drum is not more than a previously selected value, the driving state of the drum is transferred to a high speed rotation mode.

It is true that all the above conventional configurations have some effect at drastically reducing the occurrence of anomaly vibrations, but they are still not able to ensure the prevention of anomaly vibrations at every case. Specifically, in the former two configurations, the materials to be processed would roll over in the drum during the low speed turn. Therefore, the drum could not become stabilized but would constantly change in its vibrating amplitude even within one revolution. Accordingly, if the driving state of the drum is transferred to the high speed rotation mode while the mean value of the vibrating amplitude is not more than a predetermined value, there is no assurance that the drum will be set into the high speed rotation mode whilst maintaining an even distribution. Although these configurations lent themselves to suppress significantly abnormal vibrations to a certain level, the effect was not sufficient to further eliminate lower level vibrations.

On the other hand, in the latter configuration, the materials to be processed would roll over during the predehydrating rotating whilst sticking to and peeling off the inner peripheral wall of the drum. That is, the materials to be processed, most of the time, would not be stuck permanently to the inner peripheral wall of the drum. Since the variation of unbalance is detected approximately each revolution at this rotational rate, it will be delayed about one revolution behind when the driving state of the drum is transferred to the high speed rotation mode. During this time, if the materials to be processed roll over, the driving state of the drum may not always transfer to a high speed rotation mode keeping the operation of the drum normal.

Thus, in the conventional configuration, since the vibration of the drum was detected at a rotational speed when the materials to be processed in the drum were constantly rolling over, when the vibration of the drum was detected to be low, it was not certain whether the driving state of the drum could be transferred into the high speed rotation mode whilst the drum was kept at that state. That is, there was a time lag or delay between the time when it was judged whether the drum could be transferred to the high speed rotation mode and the time when the drum was actually transferred to the high speed rotation mode. During this span of time, the state of the materials to be processed might have changed, so that it was impossible to transfer the driving state of the drum to the high speed rotation mode whilst the vibration was being maintained lower than a designated level.

The above problems are not limited to the scope of the drum type washing machines, but drum type driers dedicated only to drying as well as other drum type rotary processing apparatuses have suffered from similar problems.

SUMMARY OF THE INVENTION

It is therefore an object of the present invention to provide a drum type drying/washing machine which consumes lesser amount of water and is capable of drying laundry evenly within a short period of time.

It is another object of the present invention to provide a drum type drying/washing machine which is improved in the efficiency of dehydration in order to shorten the time for drying.

It is a further object of the present invention to provide a drum type drying/washing machine which can accelerate a drum to a high speed rotation when the drum vibrates at a designated vibration level.

In accordance with the first aspect of the present invention, there is provided a drum type drying/washing machine for performing washing through drying which comprises: a drum incorporated rotatably inside the machine body; a driving means for rotationally driving the drum; an air-blowing means disposed on a circulating passage which joins an exhaust port with an intake port of the drum; a dehumidifying means for dehumidifying air inside the circulating passage by cooling the air using cooling water; a water-flowing means for flowing the cooling water; a heating means for heating the air dehumidified by the dehumidifying means; and a control means for controlling the driving means to rotate the drum at the same time a drying operation starts, the air-blowing means to blow out a dry air, the heating means to heat the dry air and the water-flowing means to stop flowing the cooling water during a predetermined period of time or time determined in accordance with an amount of clothes so as to perform drying and to start flowing the cooling water after the time passes so as to perform drying with cooling-dehumidication.

Since the drum type drying/washing machine of the invention is configured as described above, it is possible to save cooling water for cooling-dehumidication by stopping the flow of the cooling water immediately after the drying operation is started. The time for stopping the flow of the cooling water after the start of the drying operation is determined in accordance with the amount of clothes, thus making it possible to save a required amount of the cooling water based on the amount of clothes.

In accordance with the second aspect of the invention, there is provided a drum type drying/washing machine which comprises: a drum accommodating laundry and having a number of holes on the peripheral wall thereof and a baffle for agitating laundry; a water tank enclosing the drum and supporting the drum rotatably about a horizontal axis; a driving means for imparting driving force to rotate the drum in normal and reverse directions; a heating means for heating air to be supplied to the drum; and a control means for controlling the driving means such that the drum is rotated for a predetermined period of time at a high speed once or a plurality of times in order to dehydrate the laundry which has been heated by a warm air at the initial stage of a drying operation.

In the above second configuration, after the completion of the dehydration by the high speed rotation, the control means controls the driving means such that the drum is stopped for a predetermined period of time and then is rotated in the reverse direction at a low speed in order to separate the laundry sticking to the peripheral wall of the drum.

Since the drum type drying/washing machine of the invention is configured as described above, it is possible to shorten the time for drying using such a simple method that the drum is made to rotate at a high speed at the initial stage of the drying and heating operation. In this configuration, the motor and other components for rotating the drum are unlikely to be loaded because the drum is merely rotated at a high speed at the beginning of the drying and heating operation. The drum is stopped for a while after the high speed rotation, and it is then rotated in a reverse direction for some time. Therefore, the clothes will not stick to the drum and thus it becomes possible to perform the drying operation efficiently.

In accordance with the third aspect of the invention, there is provided a drum type drying/washing machine for performing washing through drying which comprises: a drum, incorporated rotatably inside the machine body, for accommodating laundry; a driving means for rotationally driving the drum; an air-blowing means for bringing air exhausted from the drum again into the drum through a circulating passage; a dehumidifying means for dehumidifying the air inside the circulating passage by cooling the air using cooling water; a heating means for heating the air dehumidified by the dehumidifying means; an exhausted air temperature detecting means for detecting the temperature of the air exhausted from the drum; and a control means for controlling the driving means and the heating means based on the temperature detected by the exhausted air temperature detecting means, wherein the control means controls the heating means to turn on the electricity at a final dehydration operation prior to shifting to a drying operation and controls the driving means such that dehydration is performed even during the drying operation.

Since the drum type drying/washing machine of the invention is configured as described above, the heating means is turned on the electricity at the final stage of the dehydration operation before shifting to the drying operation. Therefore, the laundry is dehydrated with heating so as to raise the temperature of the laundry and to lower the viscosity of water in the wet laundry. Accordingly, the laundry can be dehydrated more effectively as compared with the efficiency of dehydration at a similar level of a rotational rate, and thus it is possible to shorten the time for drying.

In accordance with the fourth aspect of the invention, there is provided a drum type drying/washing machine which comprises: a drum, supported rotatably inside a housing, for accommodating materials to be processed; a driving means for rotationally driving the drum; a control means for controlling the driving means to shift to a high speed rotation after the drum is rotated at a low speed at which the materials to be processed can roll over inside the drum; and an unbalance detecting means for detecting uneven distribution of the materials to be processed inside the drum, wherein the control means controls the driving means such that the drum is rotated in a low speed rotation at a balance rotational rate at which part of the materials to be processed around the rotary central axis of the drum can roll over, and the control means allows the driving means to accelerate the drum to the high speed rotation only when output from the unbalance detecting means is equal to or less than a predetermined level.

Since the drum type drying/washing machine of the invention is configured as described above, the drum is rotated at an approximately upper limit below which the materials to be processed can roll over, and the judgment for accelerating the drum to the high speed rotation (mode transition) is to be made at this rotational rate. Accordingly, the materials to be processed will stick to the peripheral wall of the drum immediately after the mode transition. Therefore, it is possible to accelerate the drum to the high speed rotation when the drum is vibrating at a designated vibration level. As a result, it is possible to reduce the unbalance due to the uneven distribution of the materials to be processed. This means a reduction of vibrations and thus it is possible to reduce the weight of the machine.

In accordance with the fifth aspect of the invention, there is provided a drum type drying/washing machine which comprises: a drum, supported rotatably inside a housing, for accommodating materials to be processed; a driving means for rotationally driving the drum; a control means for controlling the driving means to shift to a high speed rotation after the drum is rotated at a low speed at which the materials to be processed can roll over inside the drum; and an unbalance detecting means for detecting uneven distribution of the materials to be processed inside the drum, wherein the control means controls the driving means such that the drum is rotated in a low speed rotation at a balance rotational rate above which the materials to be processed as a whole stick to the inner peripheral wall of the drum, and the control means allows the driving means to accelerate the drum to a high speed rotation when output from the unbalance detecting means is equal to or less than a predetermined level.

Since the drum type drying/washing machine of the invention is configured as described above, unbalance of the materials to be processed in the drum is modified whilst the drum is rotating at the balance rotational rate so as to find out a low unbalanced condition. Therefore, it is possible to make a better correlation between the low speed rotation and the high speed rotation, thus making it possible to perform transition to the high speed rotation with low vibrations. In this way, it is possible to reduce the unbalance due to an uneven distribution of the materials to be processed. This means a reduction of vibrations and thus it is possible to reduce the weight of the machine.

Further advantages and features of the invention as well as the scope, nature and utilization of the invention will become apparent to those skilled in the art from the description of the preferred embodiments of the invention set forth below.

BRIEF DESCRIPTION OF THE DRAWINGS

FIG. 5 is a chart showing a relation between the preselected time and the determined amount of clothing in accordance with an embodiment of a drum type drying/washing machine of the invention;

FIG. 6 is a chart showing a relation between the preselected time and the determined amount of clothing in accordance with another embodiment of a drum type drying/washing machine of the invention;

FIGS. 29, and 29A–C, hereinafter referred to as FIG. 29, are diagrams explaining a vibrating waveform obtained from the acceleration sensor and a timing of setting the drum into the high speed mode as well as conditions of the laundry inside the drum;

DESCRIPTION OF THE PREFERRED EMBODIMENTS

One embodiment of the drum type drying/washing machine of the invention will hereinbelow be described with reference to the accompanying drawings.

Figure 1:
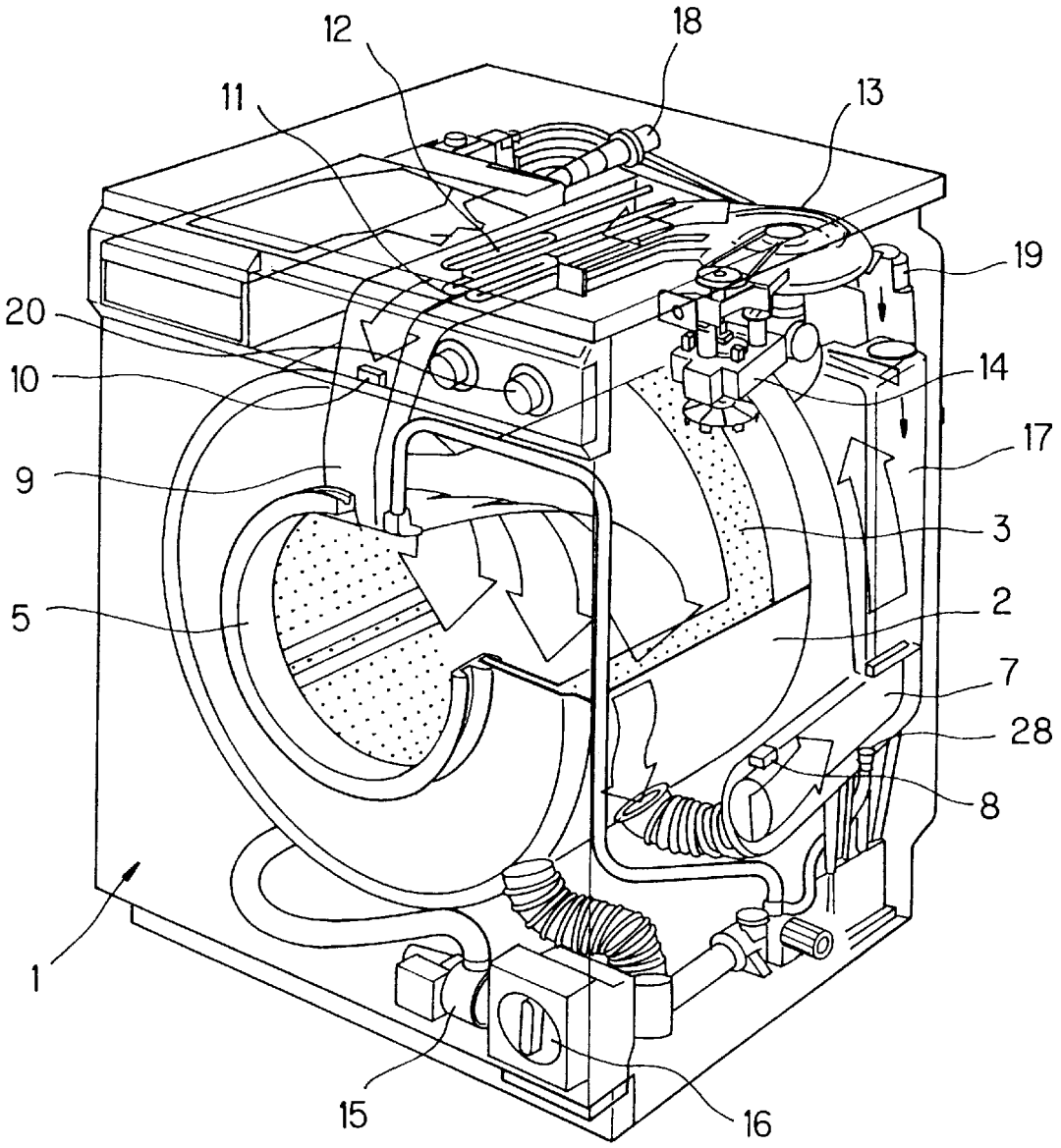
FIG. 1 is an overall perspective view showing an embodiment of a drum type drying/washing machine of the invention.
Figure 2:
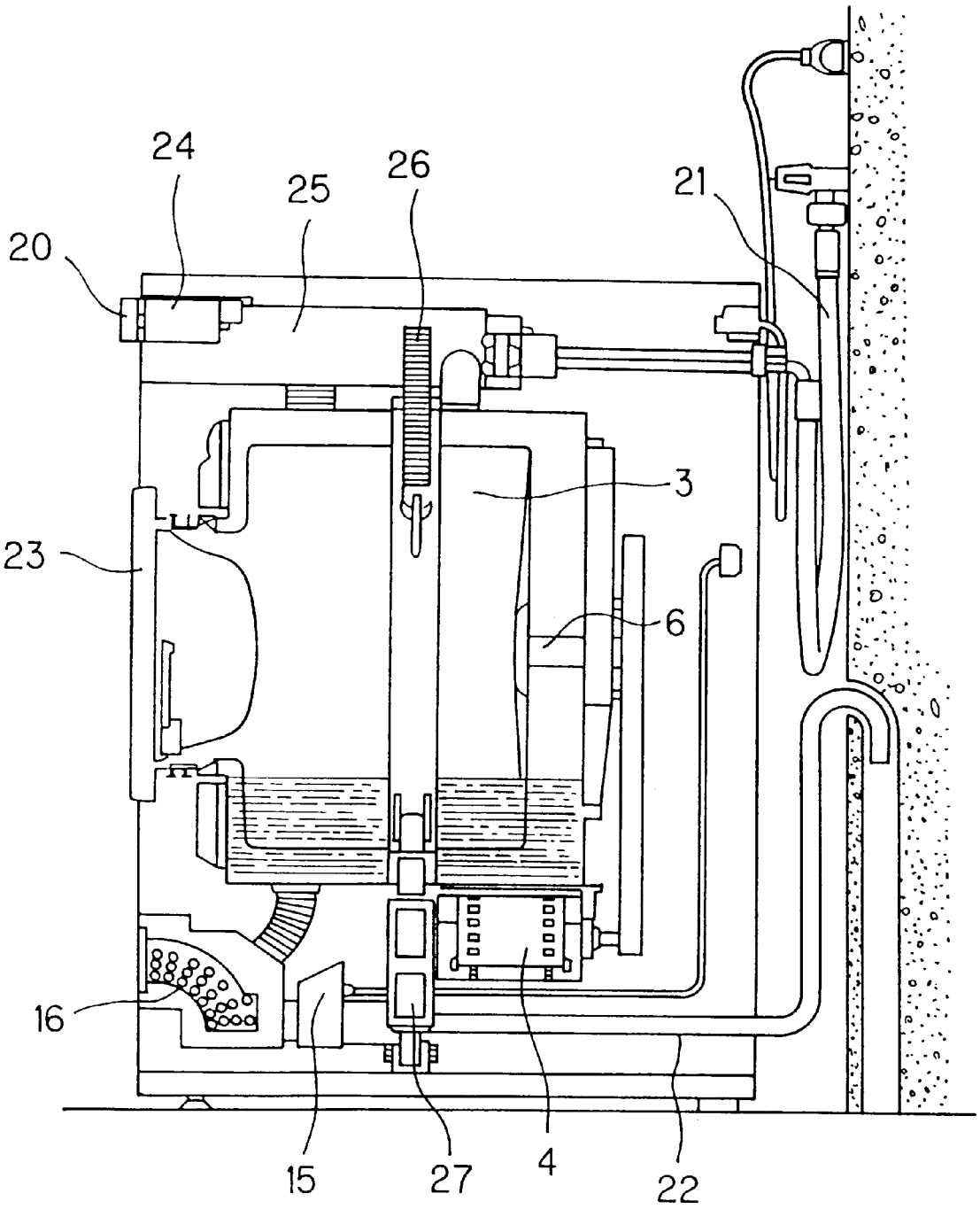
FIG. 2 is an overall sectional side elevation showing the drum type drying/washing machine of FIG. 1.

As shown in FIGS. 1 and 2, a drum type drying/washing machine of the invention includes a cylindrical water tank 2 which is elastically supported inside a machine body 1; and a cylindrical drum 3 which is supported in the water tank 2, rotatably by a shaft 6 provided on the back side of the water tank 2 and accommodates laundry and rotates on the shaft. Since the washing mechanism used in the drum type drying/washing machine of the embodiment is of a well-known type, the mechanism of drying will, in particular, be explained in detail.

The drum 3 is formed with an exhaust duct 7 on which an exhausted air temperature sensor 8 is provided. The drum 3 further has an intake duct 9, on which an intake air temperature sensor 10 is provided.

A controlling device 24 including a microcomputer (CPU) is disposed in the front part of the drum type drying/washing machine body 1. This controlling device controls the washing operation in accordance with input which is imparted through control keys (control switch) 20 of a control panel disposed on the front side of the machine body 1, output signals from various sensors such as exhausted air temperature sensor 8 and intake air temperature sensor 10 etc., as well as an internal timer. As shown in a block diagram of FIG. 3, a control circuit 30 in controlling device 24 receives signals from exhausted air temperature sensor 8, intake air temperature sensor 10, switch 20 for selecting the type of clothing etc., a water level switch 29, a lid switch 31 and a tachometer 32, and controls a drum motor 4, a fan motor 14 (a blower fan 13), a low-mode heater 11, a high-mode heater 12, a drain pump 15, a cooling water solenoid valve 19 and a water supply solenoid valve 18.

In FIG. 2, the drying/washing machine further has a filter 16 for trapping lint etc. from waste water, a supply hose 21, a drain hose 22, a lid 23, a detergent supplying port 25, a spring 26 and a shock absorber 27.

Figure 3:
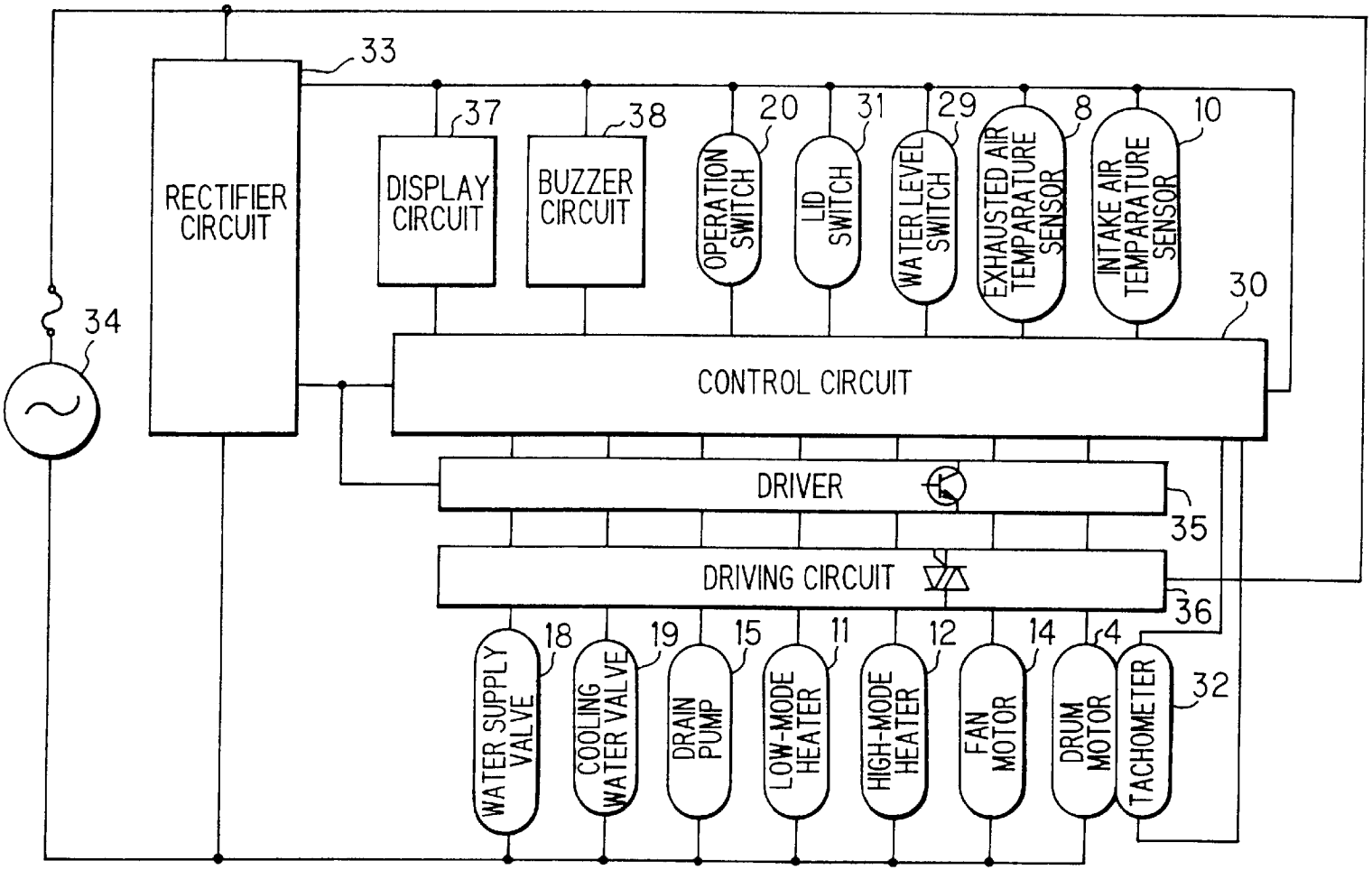
FIG. 3 is a circuit block diagram for a drum type drying/washing machine of the invention.

In FIG. 3, the control system further has a rectifier circuit 33, an AC power supply 34, a driver 35, a driving circuit 36, a display circuit 37 and a buzzer circuit 38.

In the above configuration, when laundry is loaded into the drum 3 through a clothing loading port 5 and the washing operation is started, the drum 3 is made to rotate at a high speed and then is stopped so that the weight of clothing in the drum 3 can be estimated by measuring the duration of the continuation of the rotation due to the inertia of the drum 3 until it stops.

Then, water is supplied by releasing the water supply solenoid valve 18, and thereafter the drum 3 is rotated by means of the drum motor 4, to start the washing operation, which is followed by subsequent rinsing and dehydrating operations.

When the operation enters the drying stage, the low-mode heater 11 and the high-mode heater 12 are turned on via electricity with the cooling water solenoid valve 19 closed and the drum 3 starts rotation at a low speed (50 rpm. in this embodiment). A circulating gas is circulated by the operation of the fan motor 14 through the passage of the low-mode heater 11, the high-mode heater 12, the drum 3 and the exhaust duct 7, in this order, so as to heat the clothing inside the drum 3 to evaporate the moisture.

Next, when the temperature detected by the exhausted air temperature sensor 8 has reached a pre-selected temperature A (50° C. in this embodiment) or more, the high-mode heater 12 will be turned off to halve the power consumption while the drum 3 will be rotated at a high speed (1,000 rpm. in this embodiment) so that water in the clothing, which is reduced in viscosity by heating, will be centrifugally dehydrated for a predetermined time D (10 min. in this embodiment).

After the predetermined time D has passed, the rotational rate of the drum 3 will be restored to the low speed, and the high-mode heater 12 will be turned on again so that the clothing inside the drum 3 will be heated and water can be evaporated.

Then, when the temperature detected by the exhausted air temperature sensor 8 has reached a pre-selected temperature B (60° C. in this embodiment) or more, or when the temperature detected by the intake air temperature sensor 10 has reached a pre-selected temperature C (110° C. in this embodiment) or more, the drain pump 15 will be activated and the cooling water solenoid valve 19 will be opened so as to initiate the flow of the cooling water. A high-humidity circulating air that contains water vapor which was evaporated from the clothing and delivered from the exhaust port of the drum 3 enters a cooling dehumidication chamber 17 where the circulating air is made in contact with the cooling water and cooled. In this process, water vapor in excess of the saturated vapor is condensed to drops of water so that the water is discharged outside from the drum type drying/washing machine body 1 through a drain port 28 disposed at the bottom of the cooling dehumidication chamber 17. Thus, the clothing can be dried by dehumidifying the circulating air.

In this case, tap water is used as the cooling water and is sprayed to the circulating air inside the cooling dehumidication chamber 17.

In the course of the drying process, whenever a pre-selected time E (which will be determined depending upon the amount of clothing as shown in FIG. 5, in this embodiment) elapses from the end of the high speed rotation operation, the high-mode heater 12 will be turned off to halve the power consumption while, with the cooling water solenoid valve 19 closed, the drum 3 will be rotated at a high speed (1,000 rpm. in this embodiment) for a pre-selected time F (3 min. in this embodiment) in order to centrifugally dehydrate water from the clothing, whose viscosity has been reduced by heating, and relocate the clothing inside the drum.

Figure 4:
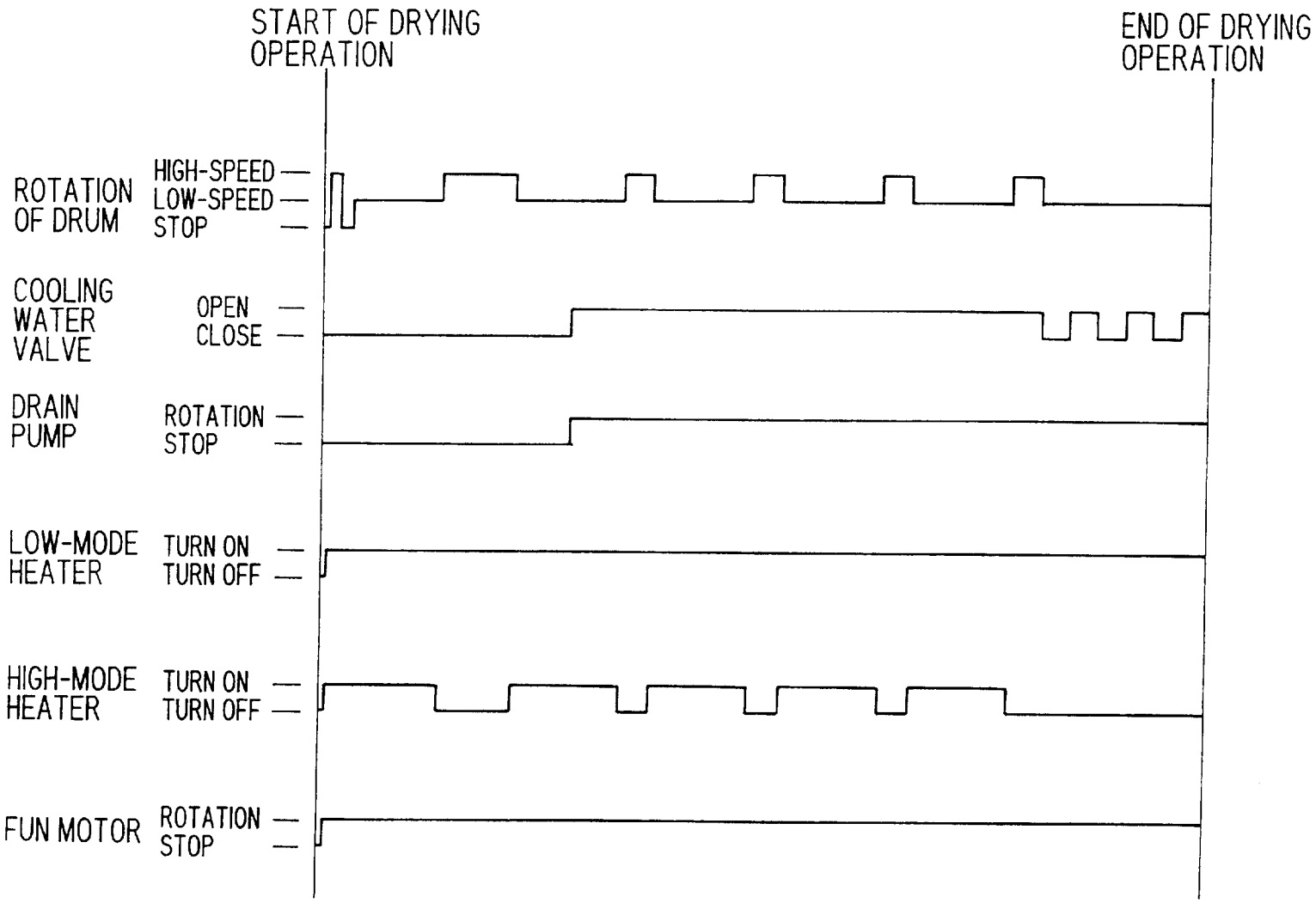
FIG. 4 is a time chart for a drum type drying/washing machine of the invention.

Next, when the temperature detected by the exhausted air temperature sensor 8 has reached a pre-selected temperature G (65° C. in this embodiment) or more, the high-mode heater 12 will be turned off to halve the power consumption while the cooling water solenoid valve 19 will be opened and closed alternately at intervals of a pre-selected time (in this embodiment, the valve is alternately opened for 1 min. and closed for 1 min.) so as to allow intermediate flowing of cooling water. When the temperature detected by the exhausted air temperature sensor 8 has reached a pre-selected temperature H (70° C. in this embodiment) or more, or when the temperature detected by the intake air temperature sensor 10 has reached a pre-selected temperature (120° C. in this embodiment) or more, the drying of clothing will be judged as complete and the drying operation will be finished by turning off the low-mode heater 11, stopping the fan motor 14, shutting out the cooling water solenoid valve 19, stopping the drain pump 15, and stopping the drum motor 4. FIG. 4 shows a time chart of the drying operation described above.

Next, description will be made of another embodiment of a drum type drying/washing machine in accordance with the invention.

In the above embodiment, in the course of the drying process, whenever a pre-selected time E (15 min. in this embodiment) elapses from the end of the high speed rotation operation, the high-mode heater 12 will be turned on to halve the power consumption while, with the cooling water solenoid valve 19 closed, the drum 3 will be rotated at a high speed (1,000 rpm. in this embodiment) for a pre-selected time F (3 min. in this embodiment). However, in this embodiment, the high speed rotation operation will be performed whenever a pre-selected time which is determined depending upon the amount of clothing as shown in FIG. 6 passes.

In the above embodiment, although the description was made of the drum type full automatic drying/washing machine of the invention, it is also possible to apply the invention to a drum type drier which only performs drying. Particularly, the present invention should not be limited to the mode of the above embodiment.

Another embodiment of a drum type drying/washing machine of the invention will hereinbelow be described with reference to the drawings.

Figure 7:
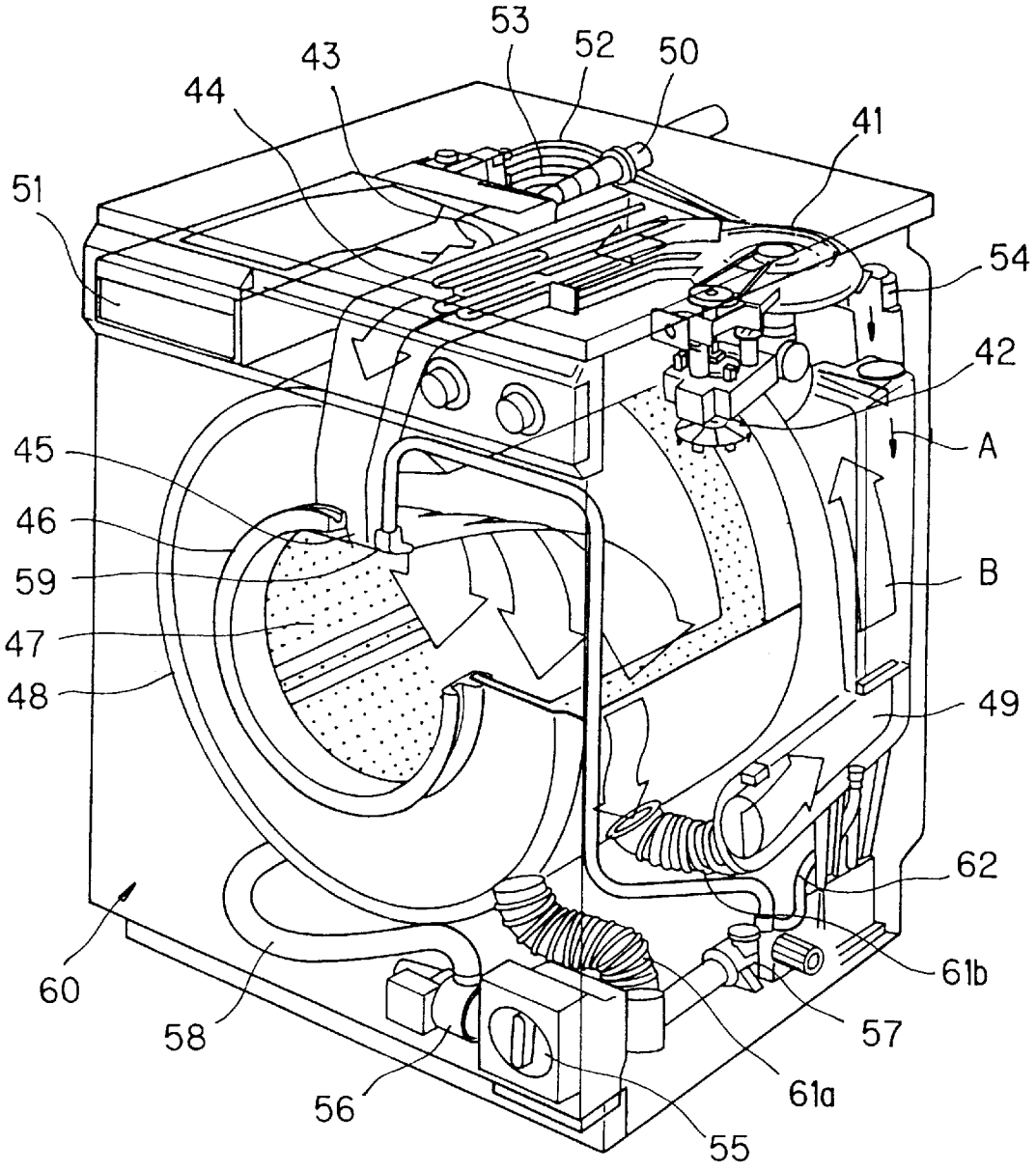
FIG. 7 is an overall perspective view showing another embodiment of a drum type drying/washing machine of the invention.

FIG. 7 is a schematic perspective diagram view showing a structure of the embodiment of a drum type drying/ washing machine of the invention. In FIG. 7, a reference numeral 41 designates a fan, 42 a motor, 43 a duct, 44 a drying heater, 45 a hot-air blower port, 46 a sealer, 47 a drum, 48 an outer tank, 49 a duct, 50 a water supply valve, 51 a detergent supplying port, 52 a condensation branch hose, 53 a water-cooling dehumidication hose, 54 a check valve, 55 a filter, 56 a drain pump, 57 a circulating pump, 58 a drain hose, 59 a nozzle, 60 a drum type drying/washing machine body, and 61*a*, 61*b* and 62 bellows hoses.

Wound around the outer periphery of the drum 47 which accommodates laundry and rotates is a drum rotating belt for transmitting a rotational force from a drum rotating motor, so that the drum will rotate at about 50 to 60 rpm. for drying/washing and will revolve at about 1,000 rpm. for dehydration. The outer tank 48 is attached around the drum 47 so that no water will leak. The sealer 46 for protecting leakage of water is attached on the front side between the laundry loading port and the drum 47. Attached to the outer tank 48 is the bellows hose 61*a* for draining and circulating washing water as well as the bellow hose 61*b* for circulating a drying air.

The bellow hose 61*a* to be used to drain and circulate washing water is attached to the filter 55 for trapping lint, dust etc., scattered in the water. The drain pump 56 and the drain hose 58 to be used for draining washing water and dehydrating are attached to one side of the filter 55. Attached on the other side of the filter 55 are the circulating pump 57 and the nozzle 59 for circulating washing water during washing so that washing water can forcibly be blown upon the laundry.

The bellows hose 61*b* to be used for circulating drying air is connected to the duct 49, which is then followed by the fan 41, the duct 43 and the hot-air blower port 45. Performed in the duct 49 is exchange of heat between laundry drying circulating air (indicated by an outlined arrow B) and water (indicated by a solid arrow A) supplied from the water-cooling dehumidication hose 53 so as to condense some of the water and produce a low-temperature high-humidity air. This heat-exchanged air is drawn by the fan 41 which is rotated by the motor 42, into the duct 43 where the air is heated to about 120° C. by means of the drying heater 44. The thus heated air is supplied again from the hot-air blower port 45 into the drum 47 to evaporate moisture of the laundry. In this way, the air is circulated in the machine.

On the other hand, the water condensed in the duct 49, passing through hose 62, is discharged via the drain hose 58 by the function of the drain pump 56. In the figure, 50 indicates a water supplying valve for supplying tap water, 51 a detergent supplying port, 52 a condensation branch hose, and 54 a check valve. Here, these components are not of importance, so that the description will be omitted.

Next, the operation of this drum type drying/washing machine will be described. After laundry is loaded into the machine via the laundry loading port in front of the sealer 46 for protecting leakage of water, a detergent suited to the laundry should be put into the detergent supplying port 51. As the start button is pressed, a suitable quantity of water to the amount of the laundry is passed through the water supplying valve 50 and is supplied to the drum 47 whilst the detergent is loaded in the detergent supplying port.

Then, the drum 47 will be rotated to beat-wash the laundry. During washing, washing water is circulated through the bellows hose 61*a*, the filter 55 and the circulating pump 57 and returned to the drum 47 from the nozzle 59. This procedure is repeated to perform washing. When washing is complete, the water is passed through the bellow hose 61*a*, the filter 55, the drain pump 56 so as to be discharged from the drain hose 58. Thereafter, the drum 47 is rotated at a high speed so that the washing water remaining in the laundry can be dehydrated. The waste water during dehydration is also discharged through the same passage as above.

At the completion of washing, water is supplied into the drum 47 through the detergent supplying port 51 from the water supplying valve 50, and rinsing is performed in the same manner as in the washing process. Then, the dehydration is performed in the same manner as above. Here, washing or rinsing water which goes into the duct 49 through the bellows hose 61*b* will be drained from the drain hose 58 with the help of the drain pump 56, the passing through hose 62 which is connected to a bottom exit of the duct 49, the circulating pump 57, the filter 55 and the drain pump 56.

Next, the dehydrated laundry undergoes the drying process. In the drying process, first, the fan 41 is activated while the drying heater 44 is heated with 1,200 W so that the hot air can be blown out from the hot-air blower port 45 into the drum 47 which is rotating at 50 rpm. (by means of main motors 'b' and 'c' in FIG. 8). After about 5 min., a heat switch 63 will be turned off in the circuit shown in FIG. 8, reducing the power of the drying heater 44 to 700 W while the drum 47 will be rotated at approximately 1,000 rpm. (using main motors 'a' and 'b' in FIG. 8) for 10 min.

Figure 9:
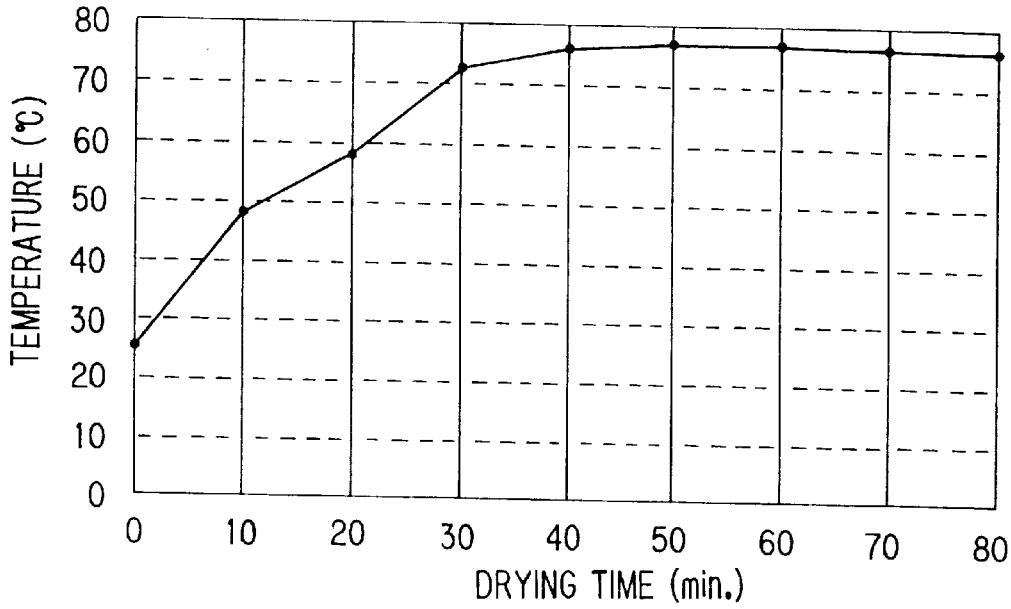
FIG. 9 is a graph showing change in the surface temperature of laundry with the passage of time during the drying operation.
Figure 10:
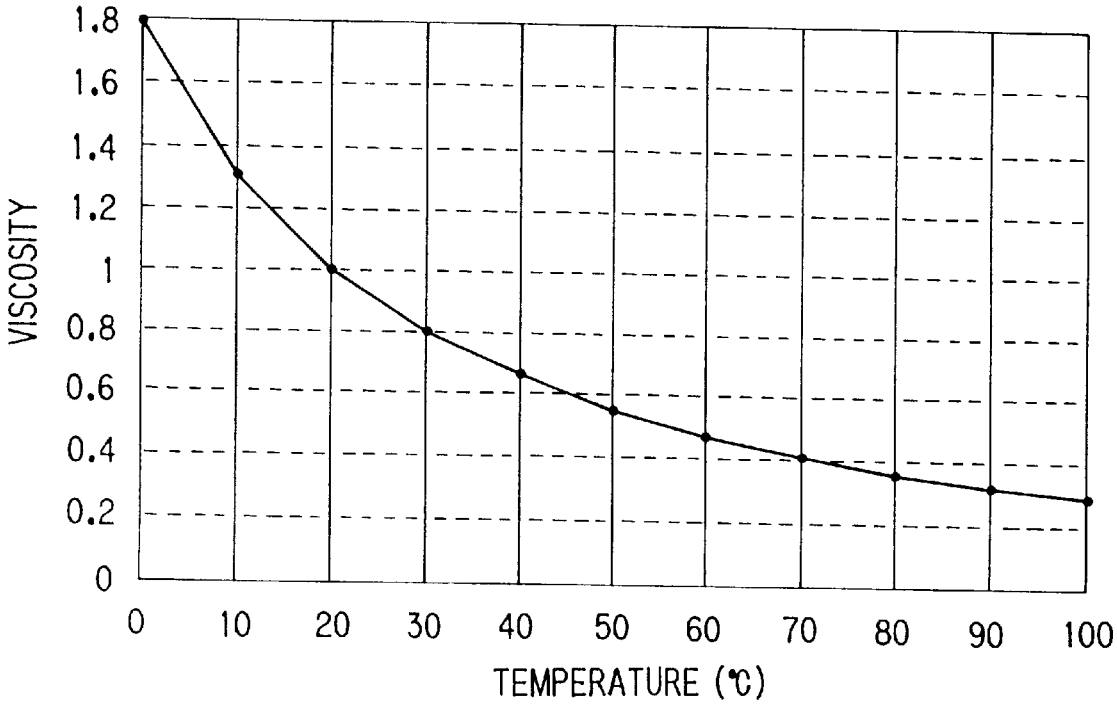
FIG. 10 is a graph showing how a viscosity of water will change depending on the temperature.

In this case, as shown in FIG. 10, a characteristic has been known that the viscosity of water will become lower as the temperature of water becomes higher. FIG. 9 shows a graph of change in the surface temperature of laundry. In this graph, during the period from 5 to 15 min., the laundry is heated to around 40° C., and approximately 100 g of water is removed by the high speed dehydration. This dehydrated water, the water used for water cooling and condensed water are all discharged out from the drain hose 58 by the function of the drain pump 56, passing through the duct 49, the hose 62, the circulating pump 57, the filter 55 and the drain pump 56.

When the drum 47 is rotated at a rate of 1,000 rpm., laundry will stick to the peripheral wall of the drum 47. Therefore, once stopped after the high speed rotation, the drum 47 is rotated in reverse direction at about 50 rpm. by the function of a rectifier board. This rotation causes the laundry stuck to the drum 47 to go down and roll over in harmony with the low speed turn. This operation is continued until the drying will be complete.

Although it took about 45 min. to dry 1 kg of laundry in the conventional method, the drying time could be reduced by 10%, that is, it took 40 min. to dry the same amount of laundry.

Figure 8:
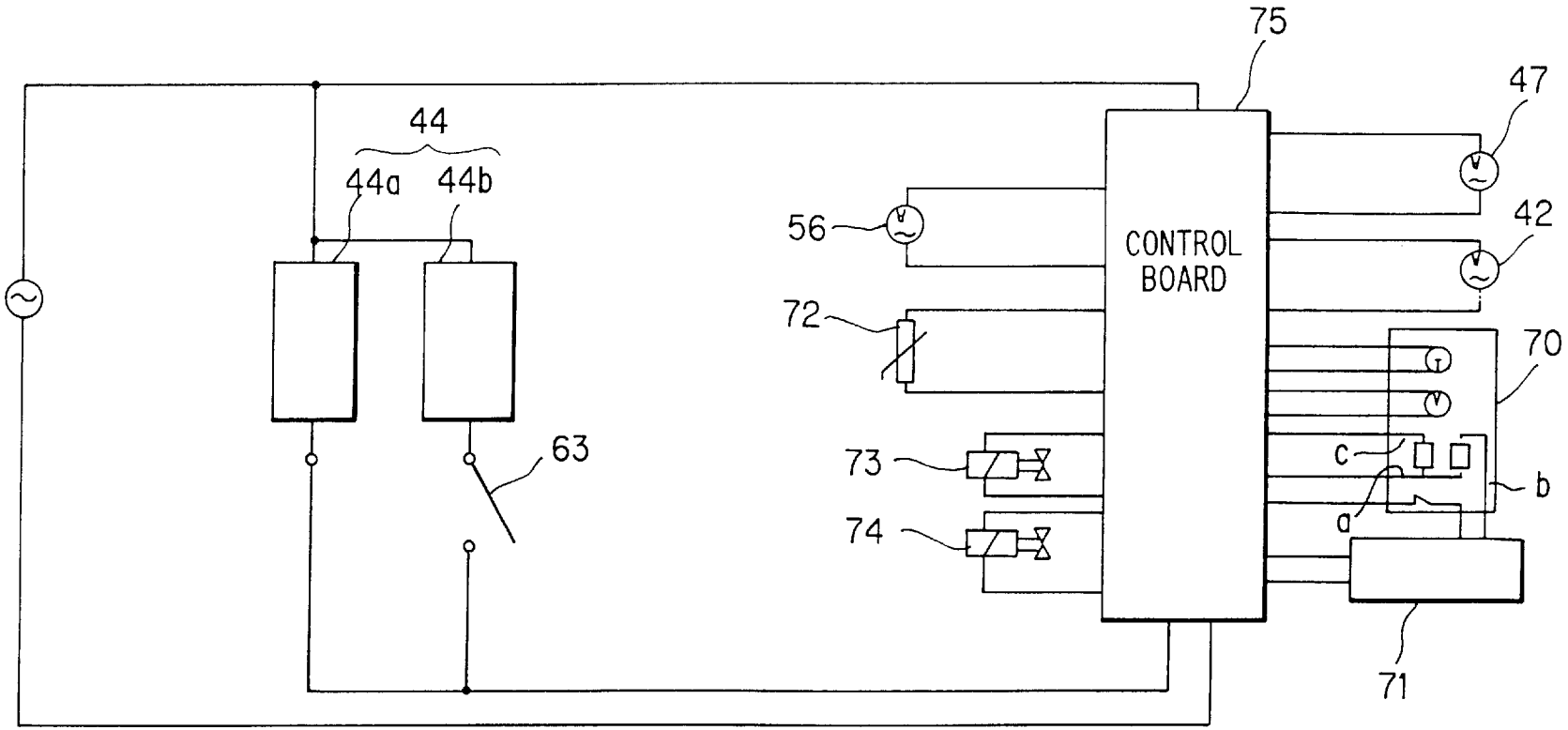
FIG. 8 is a schematic wiring diagram showing another embodiment of a drum type drying/washing machine of the invention.

In FIG. 8, the drying heater 44 is composed of a drying heater 44*a* of 700 W and a drying heater 44*b* of 500 W. A reference numeral 70 designates a main motor for rotating the drum 47, 71 a rectifier circuit board having a rectifier circuit, 72 a drying temperature sensor, 73 a water supply valve for washing, 74 a water supply valve for drying, and 75 a control board having a microcomputer etc.

In the above drum type drying/washing machine, the drum will be rotated at a high speed at the initial stage of the clothes drying operation when the viscosity of water has already started to become lower, so that the dehydrated level of laundry right after the dehydration can be improved further. Further, the laundry stuck to the drum can be separated from it by stopping or reversing it after the high speed rotation.

Moreover, the total of the power of the drying heater and the power of rotational motor is controlled to be almost constant, regardless of whether drying is performed with the high speed rotation or with the low speed turn. Specifically, the power consumption of the drying heater is controlled between 700 to 1,200 W in accordance with the operating mode of the drum: the high speed rotation or the low speed turn, so that the total power consumption may be about 1,350 W.

In this way, it is possible to quickly remove water from laundry and shorten the drying time, thus making it possible to save the energy.

Figure 11:
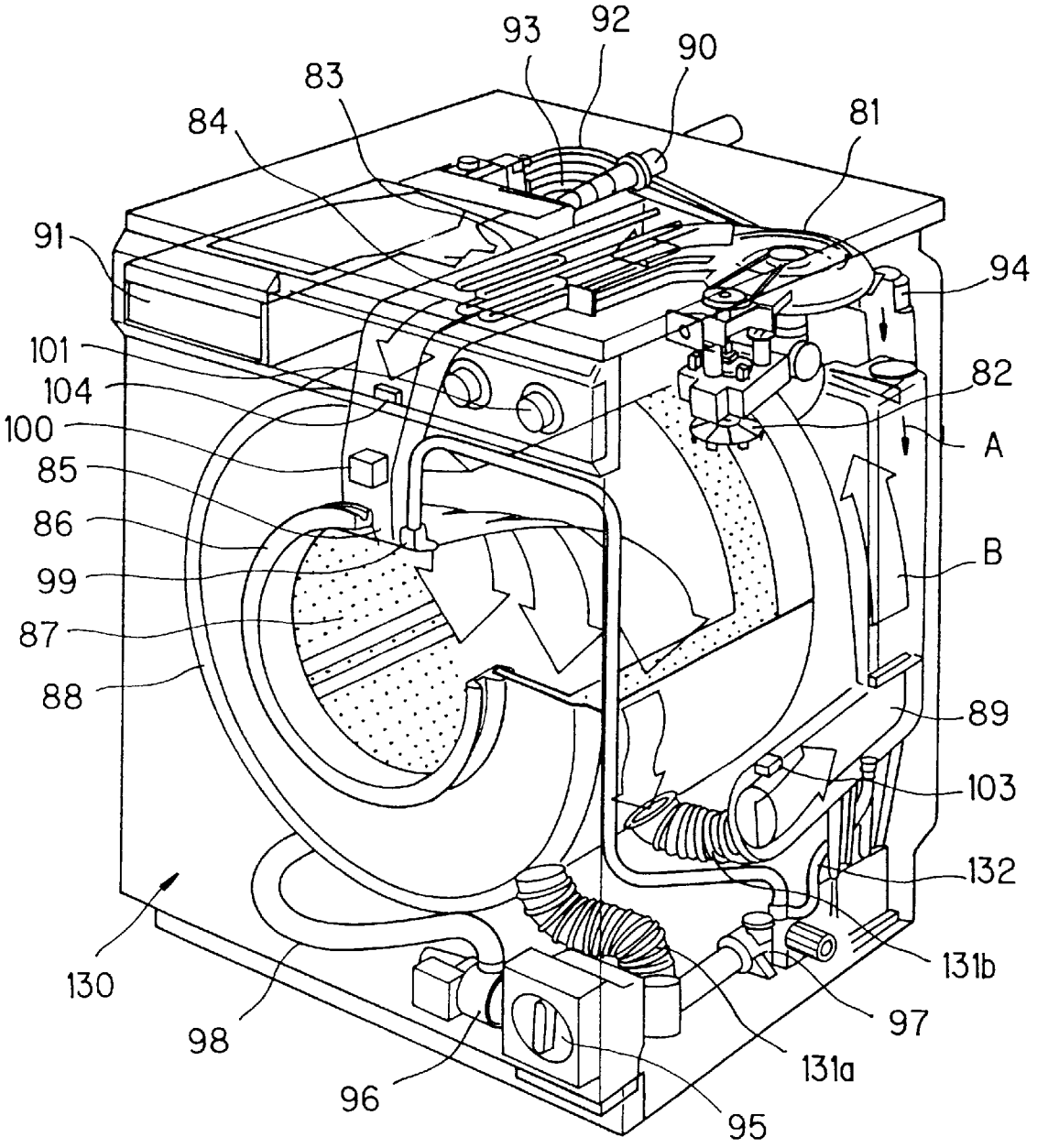
FIG. 11 is an overall perspective view showing another embodiment of a drum type drying/washing machine of the invention.
Figure 12:
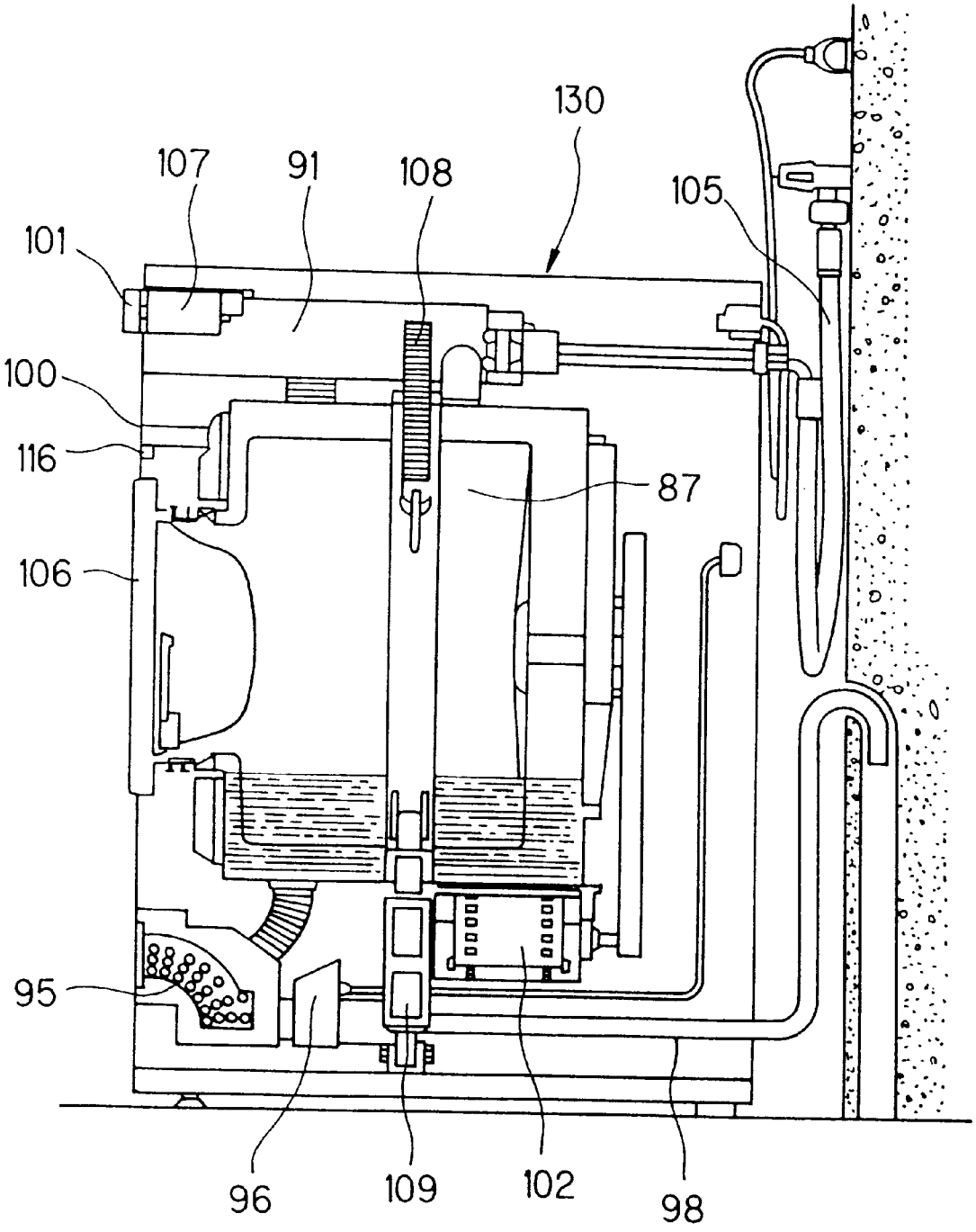
FIG. 12 is an overall sectional side elevation showing a drum type drying/washing machine of FIG. 11.

FIG. 11 is a perspective view showing another embodiment of a drum type drying/washing machine of the invention. In FIG. 11, a reference numeral 81 designates a fan, 82 a fan motor, 83 an intake duct, 84 a drying heater, 85 hot-air blower port, 86 a sealer, 87 a drum, 88 an outer tank, 89 an exhaust duct, 90 a solenoid-operated water supply valve for supplying tap water, 91 a detergent supplying port, 92 a condensation branch hose, 93 a water-cooling dehumidication hose, 94 a solenoid-operated cooling water valve, 95 a filter, 96 a drain pump, 97 a circulating pump, 98 a drain hose, 99 a nozzle, 100 a hatch, 101 a control key, 103 an exhausted air temperature sensor, 104 an intake air temperature sensor, 130 a drum type drying/washing machine body, and 131*a*, 131*b* and 132 bellows hoses. FIG. 12 is a sectional side elevation showing the drum type drying/washing machine of FIG. 11. In FIG. 12, a reference numeral 102 designates a drum motor, 105 a water supply hose, 106 a lid, 107 a controlling device, 108 a spring, 109 a damper, and 116 a solenoid valve for hatch.

Wound around the outer periphery of a rear end shaft of the drum 87 which accommodates laundry and rotates is a drum rotating belt for transmitting a rotational force from a drum rotating motor 102. The outer tank 88 is attached around the drum 87 so that no water will leak. The sealer 86 for protecting leakage of water is attached on the front side between the laundry loading port and the drum 87. Attached to the outer tank 88 is the bellows hose 131*a* for draining and circulating washing water as well as the bellow hose 131*b* for circulating drying air.

The bellow hose 131*a* to be used to drain and circulate washing water is attached to the filter 95 for trapping lint, dust etc., scattered in the water. The drain pump 96 and the drain hose 98 to be used for draining washing water and dehydrating are attached to one side of the filter 95. Attached on the other side of the filter 95 are the circulating pump 97 and the nozzle 99 for circulating washing water during washing so that washing water can forcibly be blown upon the laundry.

The bellows hose 131*b* to be used for circulating drying air is connected to the exhaust duct 89, which is then followed by the fan 81, the intake duct 83 and the hot-air blower port 85. Performed in the duct 89 is exchange of heat between laundry drying circulating air (indicated by an outlined arrow B) and water (indicated by a solid arrow A) supplied from the water-cooling dehumidication hose 93 so that the circulating air inside the exhaust duct 89 will be condensed to become low temperature low-humidity air. This low-temperature low-humidity air is drawn by the fan 81 which is rotated by the fan motor 82, into the intake duct 83 where the air is heated to become a high-temperature low-humidity air. This high-temperature low-humidity air is again supplied from the hot-air blower port 85 into the drum 87 in order to evaporate moisture of the laundry. In this way, the air is circulated in the machine. On the other hand, the water condensed in the exhaust duct 89, passing through the hose 132, is discharged via the drain hose 98 by the function of the drain pump 96.

Figure 13:
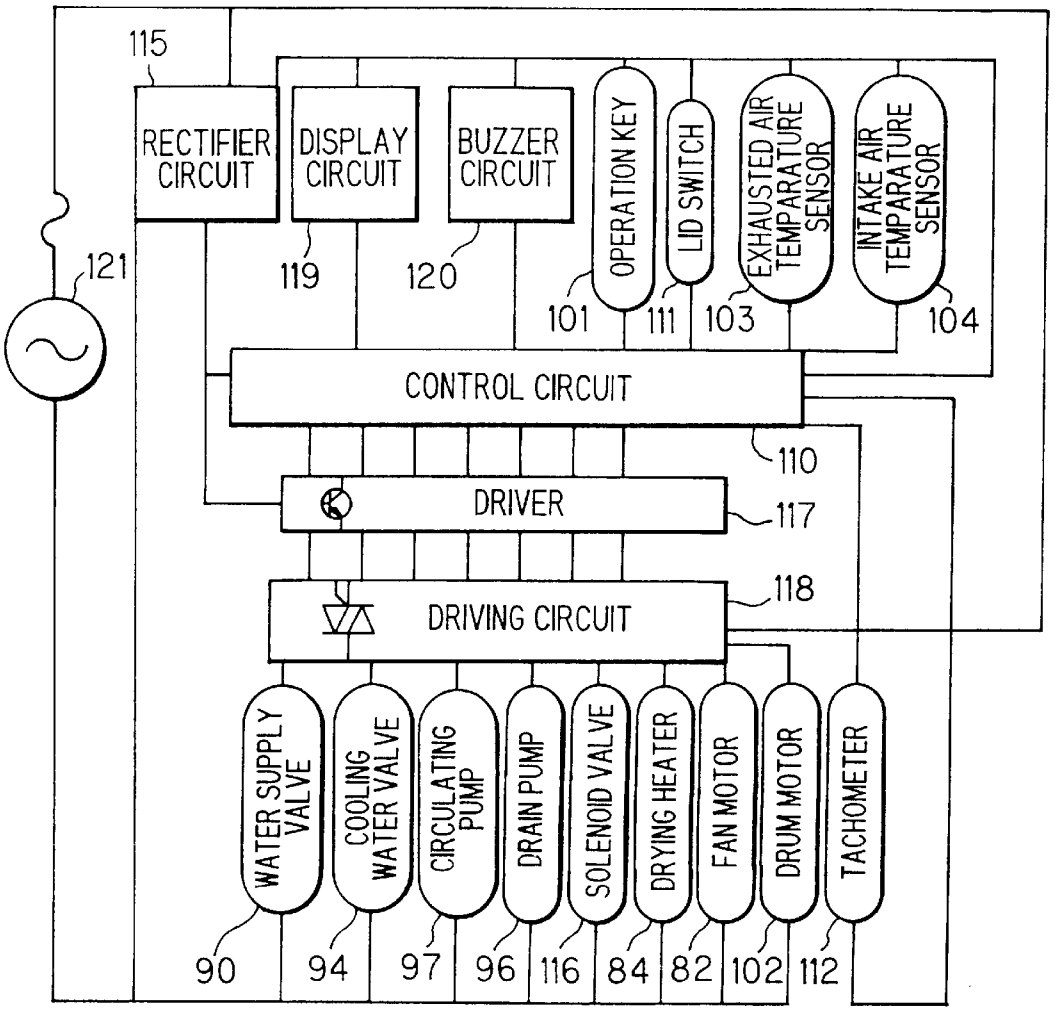
FIG. 13 is a circuit block diagram showing a relation between a control circuit and peripheral devices of a drum type drying/washing machine of FIG. 11.

The controlling device 107 including a microcomputer (CPU) is disposed in the front part of the drum type drying/washing machine body 130. This controlling device controls the washing operation in accordance with the input which is imparted through control keys (control switch) 101 of a control panel disposed on the front side of the machine body 130, the output signals from various sensors such as the exhausted air temperature sensor 103 and the intake air temperature sensor 104 etc., as well as an internal timer. As shown in a block diagram of FIG. 13, a control circuit 110 in the controlling device 107 receives signals from the exhausted air temperature sensor 103, the intake air temperature sensor 104, the control keys 101 for selecting the type of clothing etc., a lid switch 111 and a tachometer 112, and controls the drum motor 102, the fan motor 82, the drying heater 84, the solenoid valve 116, the drain pump 96, the circulating pump 97, the cooling water valve 94 and the water supply valve 90. In FIG. 13, a reference numeral 115 designates a rectifier circuit, 117 a driver, 118 a driver circuit, 119 a display circuit, 120 a buzzer circuit and 121 an AC power supply.

In the above configuration, when laundry is loaded into the drum 87 and the washing operation is started, the controlling device 107 controls the drum motor 102 so that the drum 87 rotates at a predetermined high speed and then stops. The controller detects the duration of the continuation of the rotation due to the inertia of the drum 87 until it stops so as to estimate the weight of clothing in the drum 87. Then, water is supplied by releasing the water supply solenoid valve 90, and thereafter the drum 87 is rotated by means of the drum motor 102, to start the washing operation, which is followed by subsequent rinsing, dehydrating and drying operations.

When the operation enters the dehydrating stage, driving state of drum 87 is shifted from a low speed turn (at about 50 rpm.) to a high speed rotation (at about 1,000 rpm.) by means of the drum motor 102 while the drying heater 84 is turned on the electricity in the low-mode (with about 700 W). Heat from this drying heater 84 will be able to improve the dehydration ratio by about 2% and raise the surface temperature of laundry by 5 to 10° C. Here, it is possible to determine whether the drying heater 84 should be turned on after the completion of the dehydrating operation, through the control keys 101.

Figure 14:
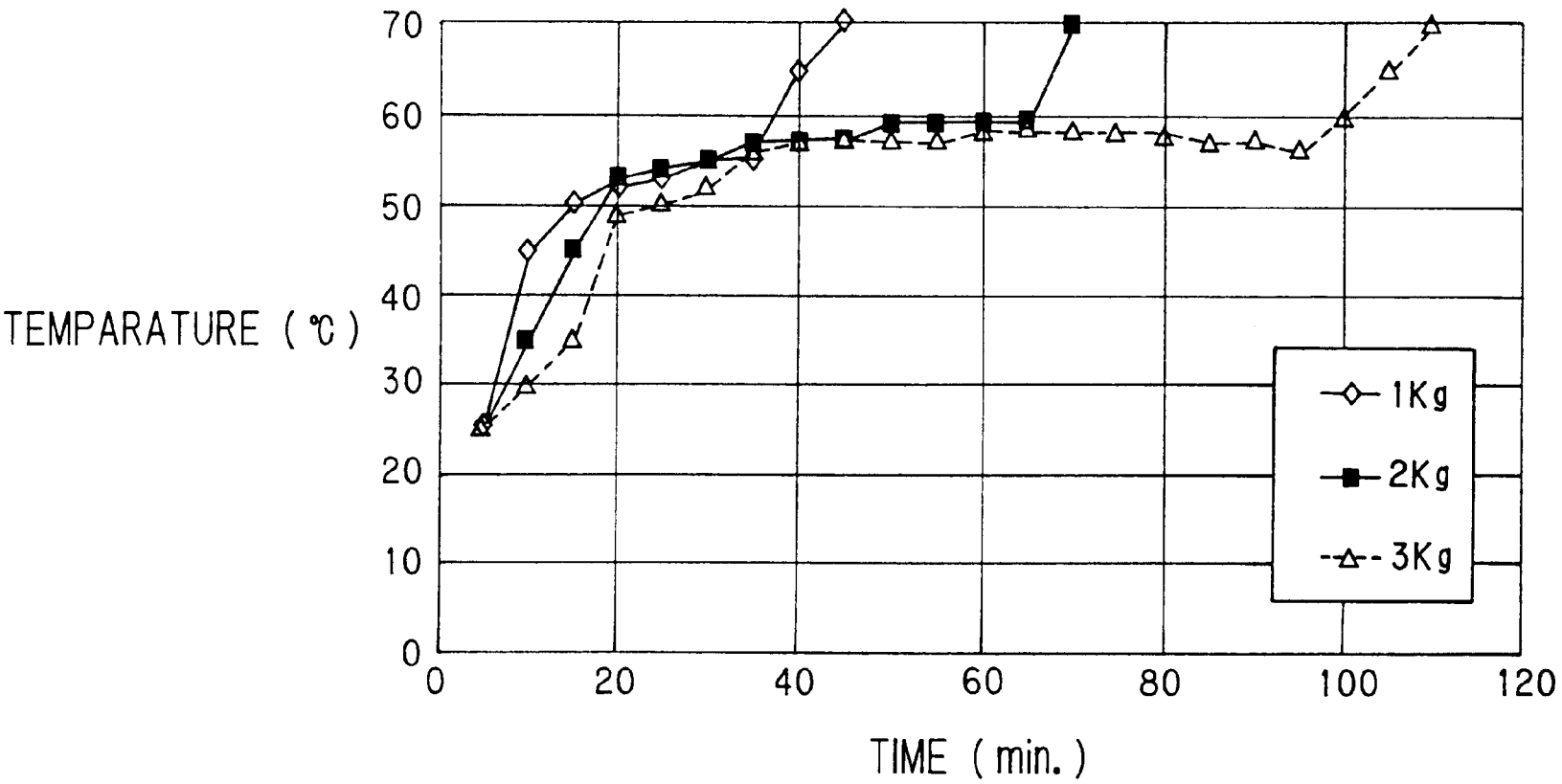
FIG. 14 is a graph showing change in the exhausted air temperature from the drum of FIG. 11 with the passage of time.

When the operation enters the drying stage, the surface temperature of clothing during drying varies depending upon the amount of laundry. Variations of the clothing surface temperature is shown in FIG. 14. Therefore, the remaining-heat drying time, the normal-rate drying time, the reduced-rate drying time should be set different depending upon the amount of laundry. Specifically the remaining-heat drying should finish for about 10 min., when the amount of laundry is 1 kg. It will finish for about 15 min. for a 2 kg laundry and it will finish for about 20 min. for a 3 kg laundry. During this time alone, the cooling water valve 94 is closed to further increase the temperature of clothing.

In the normal-rate drying, it will take about 35 min. for a 1 kg laundry, about 65 min. for 2 kg, and about 95 min. for 3 kg. Finally, in the reduced-rate drying, it will take about 44 min. for 1 kg, about 71 min. for 2 kg, and about 110 min. for 3 kg. After the completion of the normal-rate dying to the end of the drying process, the cooling water valve 94 is opened so as to perform the cooling-dehumidication.

Explaining in further detail, when the amount of laundry is 1 kg, from 0 (the start of drying) to 7 min., the drum 87 is rotated at about 50 rpm. while the drying heater 84 is turned on the electricity in the high mode (1,200 W) to heat the laundry (so-called tumbling operation). Thereafter, from 7 min. to 10 min., the drum 87 is rotated at 1,000 rpm. to perform dehydration while the drying heater 84 is turned on in the low mode (about 700 W) to heat the laundry.

During the period from 10 min. to 44 min., the tumbling operation (at about 50 rpm. heated with 1,200 W) is performed. During this operation, from 15 min. to 35 min., the drum 87 is rotated at about 1,000 rpm. for 15 sec. at intervals of 5 min. in order to dehydrate the laundry. During this time, the drying heater 84 is turned on in the low mode (about 700 W) to heat the laundry. When the reduced-rate drying stage starts, the drum 87 turns at about 50 rpm. and the drying heater 84 uses about 1,200 W to heat the laundry until the drying operation is complete. Here, when the dehydration is not performed from 15 min. to 35 min., the drum 87 turns at about 50 rpm. and the drying heater 84 uses approximately 1,200 W to heat the laundry. Finally, when the exhausted air temperature sensor 103 detects a predetermined temperature (approximately 70° C.), the whole drying operation will finish.

When the amount of laundry is 2 kg, from 0 (the start of drying) to 12 min., the drum 87 is rotated at about 50 rpm. while the drying heater 84 is turned on in the high mode (1,200 W) to heat the laundry and perform tumbling. Thereafter, from 12 min. to 15 min., the drum 87 is rotated at 1,000 rpm. to perform dehydration while drying heater 84 is turned on in the low mode (about 700 W) to heat the laundry.

During the period from 15 min. to 71 min., the tumbling operation (at about 50 rpm. heated with 1,200 W) is performed. During this operation, from 20 min. to 60 min., the drum 87 is rotated at about 1,000 rpm. for 15 sec. at intervals of 5 min. in order to dehydrate the laundry. During this time, the drying heater 84 is turned on in the low mode (about 700 W) to heat the laundry. When the reduced-rate drying stage starts, the drum 87 turns at about 50 rpm. and the drying heater 84 uses about 1,200 W to heat the laundry until the drying operation is complete. Here, when the dehydration is not performed from 20 min. to 60 min., the drum 87 turns at about 50 rpm. and the drying heater 84 uses approximately 1,200 W to heat the laundry. Finally, when the exhausted air temperature sensor 103 detects a predetermined temperature (approximately 70° C.), the whole drying operation will finish.

When the amount of laundry is 3 kg, from zero (the start of drying) to 15 min., the drum 87 is rotated at about 50 rpm. while the drying heater 84 is turned on in the high (1,200 W) to heat the laundry and perform tumbling. Thereafter, from 15 min. to 20 min., the drum 87 is rotated at 1,000 rpm. to perform dehydration while the drying heater 84 is turned on in the low mode (about 700 W) to heat the laundry.

During the period from 20 min. to 71 min., the tumbling operation (at about 50 rpm. heated with 1,200 W) is performed. During this operation, from 25 min. to 100 min., the drum 87 is rotated at about 1,000 rpm. for 15 sec. at intervals of 5 min. in order to dehydrate the laundry. During this time, the drying heater 84 is turned on in the low mode (about 700 W) to heat the laundry. When the reduced-rate drying stage starts, the drum 87 turns at about 50 rpm. and the drying heater 84 uses about 1,200 W to heat the laundry until the drying operation is completed. Here, when the dehydration is not performed from 25 min. to 100 min., the drum 87 turns at about 50 rpm. and the drying heater 84 uses approximately 1,200 W to heat the laundry. Finally, when the exhausted air temperature sensor 103 detects a predetermined temperature (approximately 70° C.), the whole drying operation will finish.

Table 1 below shows the conditions of the operations of dehydrating and drying stages when the amounts of laundry are 1 kg, 2 kg and 3 kg.

TABLE 1

| | 1 kg | 2 kg | 3 kg |
|---|---|---|---|
| Water cut-off | 0–10 min. | 0–15 min. | 0–20 min. |
| Dehydration (1,000 rpm.) | 7–10 min. 15 sec. at intervals of 5 min. from 15 to 35 min. | 12–15.min. 15 sec. at intervals of 5 min. from 20 to 60 min. | 15–20 min. 15 sec. at intervals of 5 min. from 25 to 100 min. |
| Tumbling (50 rpm.) | 0–7 min. 10–44 min. | 0–12 min. 15–71 min. | 0–15 min. 20–110 min. |
| Heating | 1,200 W during tumbling 700 W during dehydration | 1,200 W during tumbling 700 W during dehydration | 1,200 W during tumbling 700 W during dehydration |

Here, when the exhausted air temperature sensor 103 has detected a predetermined temperature and the operation enters the reduced-rate drying stage, the openable hatch 100 which is provided for the intake duct 83 may be opened by activating the solenoid valve 116. This will cause the high temperature air that contains vapor, to discharge outside the drying/washing machine body 130. It therefore becomes possible to further reduce the drying time. However, if the hatch 100 is opened, the room may be filled with the moisture which has come out from the clothing. Therefore, the activation of the solenoid valve 116 for opening and closing this hatch 100 is made to be selected. When the hatch 100 is closed, it should be done manually. Thus, when drying is performed in this drum type drying/washing machine of the invention, it is possible to reduce the drying time by about 20%, compared to that in the conventional configuration.

Next, with reference to drawings, another embodiment of a drum type drying/washing machine of the invention will be described.

Figure 15:
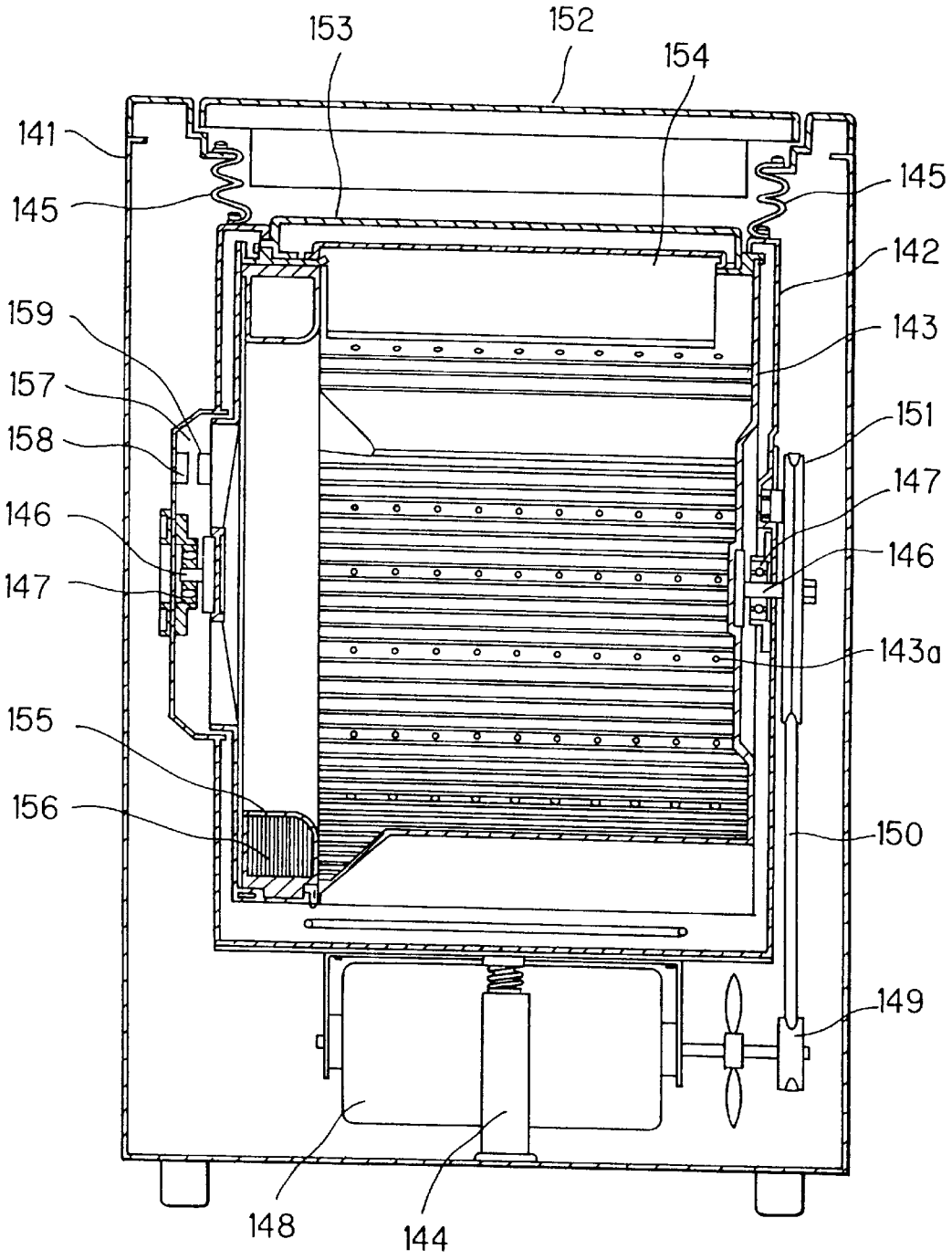
FIG. 15 is an overall sectional side elevation showing another embodiment of a drum type drying/washing machine of the invention.

FIG. 15 is a sectional side elevation showing a schematic structure of a drum type drying/washing machine in accordance with the invention. This drum type drying/washing machine includes: a box-shaped housing 141, a water tank 142 disposed inside this housing 141 for holding a washing liquid, or rinsing water etc.; and a drum 143 supported rotatably inside this water tank 142 for accommodating laundry.

Designated at 144 is a shock absorber which supports the bottom of water tank 142 for alleviating the vibrations. A reference numerals 145 designates a spring which hoists water tank 142 to alleviate the vibrations. That is, water tank 142 is supported inside the housing 141 so as to oscillate by the shock absorbers 144 (one of them is shown in FIG. 15) and the spring 145. The water tank 142 has an unillustrated drain outlet for discharging a washing liquid or rinsing water.

The drum 143 is formed of a cylinder having a diameter of about 45 cm and has many small holes 143*a* throughout the circumferential wall of it. The drum 143 has horizontal shafts 146 projected from two side-walls. These shafts are supported by bearings 147 provided for the water tank 142 so that the drum 143 can be rotated. A reference numeral 148 designates a drum motor which corresponds to a rotating means for rotating the drum 143 and has a rotary shaft to which a pulley 149 is fixed. This pulley 149 is linked with a drum driving pulley 151, which is fixed to horizontal shaft 146, through a driving belt 150.

A reference numerals 152 designates an outer lid provided on the top of the housing 141, 153 a middle lid provided on the top of the water tank 142, 154 an inner lid formed on the outer peripheral side of the drum 143. Therefore, laundry is loaded and taken out by opening the outer lid 152, the middle lid 153 and the inner lid 154.

Designated at 155 is a fluid balancer, which comprises a ring-shaped, hollowed element provided concentrically with the drum 143 and a liquid 156 sealed inside the hollow. A reference numeral 157 designates a rotational sensor for measuring the rotational rate of the drum 143, and is composed of a reed switch 158 affixed to the inner wall of the water tank and a magnet 159 affixed to the drum 143 which will become opposite the reed switch 158.

Figure 16:
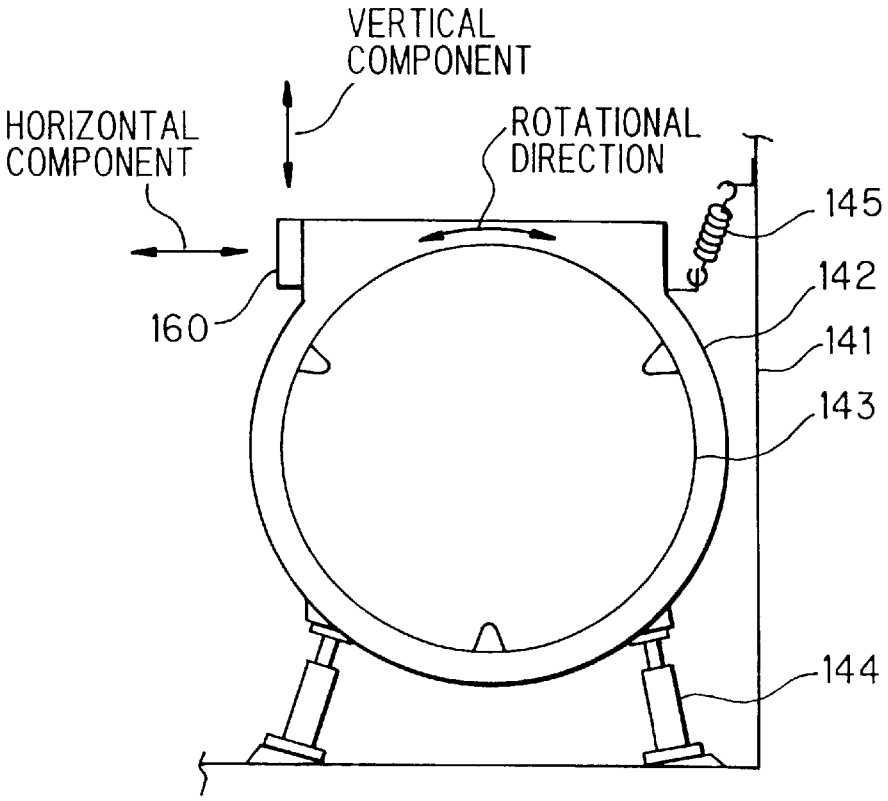
FIG. 16 is a schematic view showing the attachment position of a vibration sensor.

This drum type drying/washing machine has a vibration sensor 160 for detecting the vibrations of the water tank 142. FIG. 16 is a schematic view showing the attachment position of the vibration sensor 160. The vibration sensor 160 is attached so that it can detect a horizontal component (perpendicular to the rotational axis of drum 143) or vertical component of vibrations of the drum 143 in the water tank 142. The sensor used in this embodiment is of a type which only detects the horizontal component.

Examples of the vibration sensor 160 include displacement sensors which directly detect the amplitude of vibrations of the water tank 142 and acceleration sensors using the piezoelectric effect of piezoelectric elements such as quartz crystal., ceramic etc. which output electric signals proportional to the acceleration exerted on the water tank 142. In this embodiment, an acceleration sensor is adopted.

The acceleration sensor operates based on the following principle. Vibrations from the outside will cause a mass inside the housing of the sensor to exert forces on a piezoelectric element. This mechanical stress will break down the balance between positive and negative ions to generate electric charges. These electric charges will be accumulated on the electrodes and finally will be outputted as a vibration waveform by means of a vibration detecting circuit. The amount of the accumulated charges will be proportional to the force exerted, which will be proportional to the acceleration.

Figure 17:
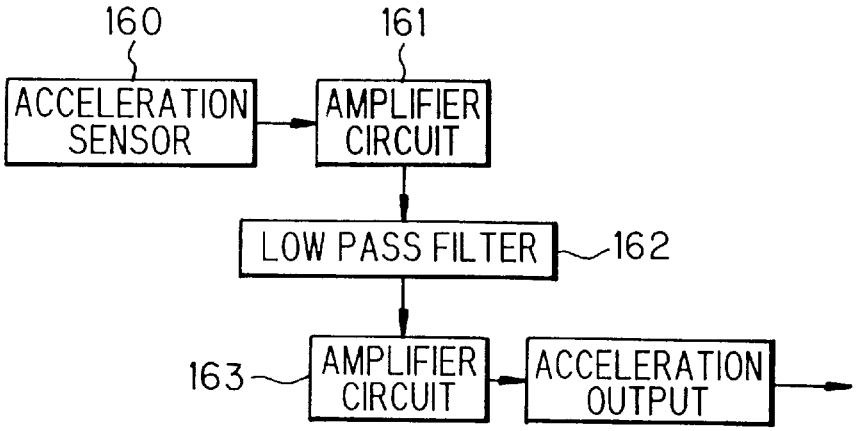
FIG. 17 is a block diagram showing a vibration detecting circuit when an acceleration sensor is used as the vibration sensor.
Figure 18:
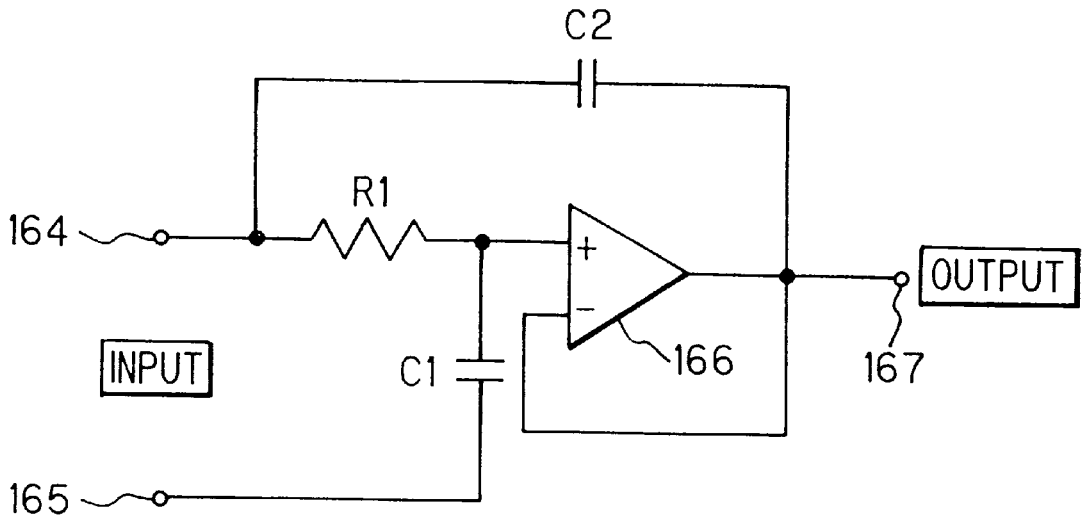
FIG. 18 is a circuit diagram showing a basic circuit of a low pass filter.

FIG. 17 is a block diagram showing a vibration detecting circuit when an acceleration sensor is used as the vibration sensor. In this figure, a signal outputted from the acceleration sensor 160 is amplified in an amplifier circuit 161. Then, the signal is converted in a low pass filter 162, and again amplified through an amplifier circuit 163 to be outputted as a vibration waveform. FIG. 18 shows a basic circuit of the low pass filter. In this figure, 164 and 165 designate input terminals to which the output from the acceleration sensor 160 is imparted. A reference numeral 166 designates an operational amplifier, R1 a resistor, C1 a capacitor, C2 a feedback capacitor, 167 an output terminal. Here, the low pass filter 162 uses a type for 10 Hz.

Figure 19:
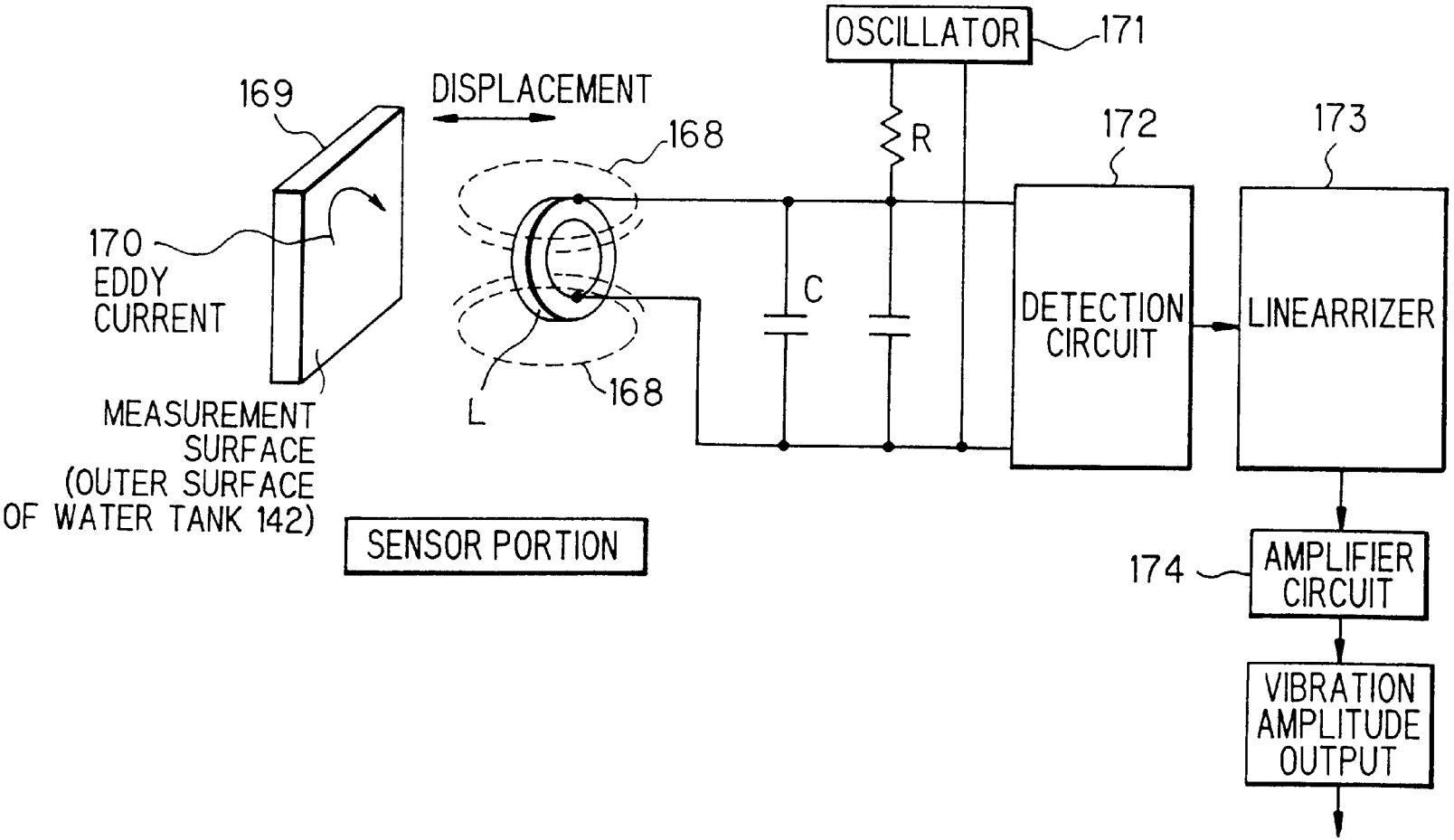
FIG. 19 is a block diagram showing a vibration detecting circuit when a displacement sensor is used as the vibration sensor.

Next, the principle of the displacement sensor will be explained. FIG. 19 is a block diagram showing a vibration detecting circuit when a displacement sensor is used as the vibration sensor. This displacement sensor is of a type using eddy currents. Lines of magnetic flux 168 produced by a coil sensor L will generate an eddy current 170 on the surface of an article (conductor) 169 to be measured. The strength of the eddy current 170 will vary depending on the distance between the sensor coil L and the target article 169 and will vary the inductance of the sensor coil L. Therefore, the amplitude of the oscillation from an LC oscillator 171 made up of the sensor coil L and a capacitor C will be varied. Variations in amplitude of the oscillation will be detected by a detector circuit 172, and a voltage proportional to the distance will be outputted through a linearizer 173. Designated at 174 is an amplifier circuit for amplifying the output from linearizer 173.

Figure 20:
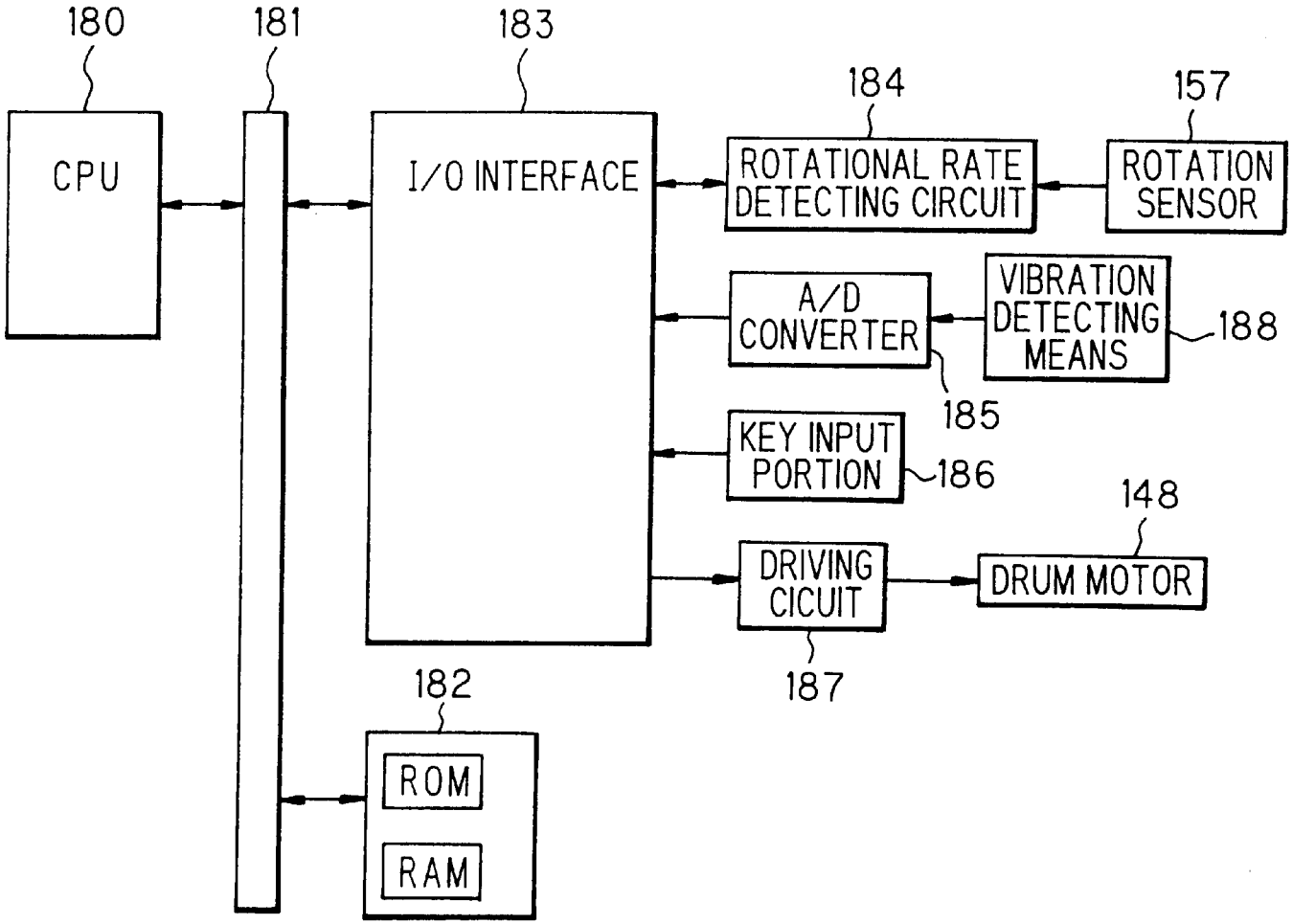
FIG. 20 is a block diagram showing an electronic controlling circuit for a drum type drying/washing machine of the invention.

Next, description will be made of an electronic control circuit as the controlling means of the drum type drying/washing machine of this embodiment. As shown in FIG. 20, the electronic controlling circuit comprises: a CPU 180 made up of a controlling section and an operating section; a data bus 181; a memory 182 consisting of ROMs and RAMs; an I/O interface 183; a rotational sensor 157; a rotational rate detecting circuit 184 for detecting the rotational rate from the output from rotational sensor 157; a vibration detector 188 having a vibration detecting circuit and the acceleration sensor 160; an A/D converter 185 for converting the output from variation detecting means 188 into digital quantities; a key input portion 186 for allowing the user to select various processes such as washing, rinsing, etc. as well as to start the operation; the drum motor 148; and a driving circuit 187 for driving the drum motor 148.

Next, the operation at the dehydrating stage of this drum type drying/washing machine will be explained. Description will be made referring to FIGS. 21 and 22.

At Step 1 (S1), the drum 143 is acceleratively rotated in a normal direction so that the drum 143 will rotate at a low rate. During the period from zero (the start of rotation) to 1.5 sec., no detection of the vibration will be performed. When 1.5 sec. elapses, it is judged at Step 2 (S2) whether a P—P (peak-to-peak) value of the output waveform from the acceleration sensor 160 is a predetermined value J or less.

Here, the predetermined value J is a threshold of P—P values. That is, if the P—P value is above this threshold, the vibration of the drum 143 is too great to continue the rotation of the drum (for example, in the case where the vibration acceleration is 5.0 $m/s^2$). When the P—P value is 'J' or less (Yes), the operation goes to Step 3 (S3). When the P—P value is above 'J' (No), the operation goes to Step 7 (S7) where the drum 143 is stopped and then returns to Step 1 (S1) where the drum 143 will be restarted. This stop and start cause the laundry in the drum 143 to roll over to change the uneven distribution of the laundry. Then, it is again judged at Step (S2) whether a P—P value is the predetermined value J or less.

Next, at Step 3 (S3), it is judged whether the rotational rate of the drum 143 has reached a predetermined value R for the low speed rotation. This value 'R' is a practically upper limit of the rotational rate (for example, 70 rpm.) at which the laundry partially moves whilst being stuck other time to the inner peripheral wall of the drum 143 (in other words, the laundry rolls over). If the rotational rate of the drum 143 has reached 'R' (Yes), the operation goes to Step 4 (S4) where the drum is maintained to rotate at that speed and then the operation will go to Step 5 (S5). If the rotational rate of the drum 143 has not yet reached 'R' (No), the operation will return to Step 1 (S1).

Next, it is judged at Step 5 (S5) whether a P—P value of the output waveform from the acceleration sensor 160 is a predetermined value N or less (primary judgment). This value 'N' is a threshold of P—P values (for example, 0.08 mm in the representation of the vibrating amplitude), based on which it will be judged whether the drum 143 can be set into the high speed rotation mode. When the P—P value is 'N' or less (Yes), the operation goes to Step 8 (S8) in FIG. 22, where the rotation of the drum 143 is accelerated. If the P—P value is above 'N' (No), the operation goes to Step 6 (S6) where it is judged whether a predetermined time T (e.g., 20 sec.) has elapsed after time when the drum 143 started to rotate. When the time has not yet elapsed (No), the operation returns to Step 4 (S4). When the time has elapsed already (Yes), the operation goes to Step 7 (S7), where the drum 143 is stopped and then the operation will be restarted from Step 1 (S1) in order to vary the uneven distribution of the laundry.

Next, at Step 9 (S9), it is judged whether a P—P value of the output waveform from the acceleration sensor 160 is above the predetermined value J or less. If it is 'J' or less (Yes), the operation goes to Step 10 (S10). When it is above 'J' (No), the operation goes to Step 7 (S7) where the drum 143 is stopped and then the operation will be restarted from Step 1 (S1) in order to vary the uneven distribution of the laundry inside the drum 143. Subsequently, at Step 10 (S10), it is judged whether the rotational rate of the drum 143 has reached a second level rotational rate L. This value 'L' is the rotational rate at which the vibrated body containing the water tank 142 will become resonant (for example 200 rpm.). If the rotational rate of the drum 143 has not yet reached 'L' (No), the operation returns to Step 8 (S8). If it has already reached 'L' (Yes), the operation goes to Step 11 (S11) where the drum 143 is maintained to rotate at that speed and the operation will go to Step 12 (S12).

Next, it is judged at Step 12 (S12) whether a P—P value of the output waveform from the acceleration sensor 160 is above the predetermined value J or less (secondary judgment). If it is 'J' or less (Yes), the operation goes to Step 13 (S13). When it is above 'J' (No), the operation goes to Step 7 (S7) where the drum 143 is stopped and then the operation will be restarted from Step 1 (S1) in order to vary the uneven distribution of the laundry inside the drum 143. Subsequently, at Step 14 (S14), it is judged whether a P—P value of the output waveform from the acceleration sensor 160 is a predetermined value K or less.

This value 'K' is a threshold of P—P values, above which the vibration of the drum 143 is too great to continue the rotation of the drum 143. At Step 14 (S14), if the P—P value is 'K' or less (Yes), the operation goes to Step 15 (S15). If it is above 'K' (No), the operation goes to Step 7 (S7) where the drum 143 is stopped and then the operation will be restarted from Step 1 (S1) in order to vary the uneven distribution of the laundry inside the drum 143.

Subsequently, at Step 15 (S15), it is judged whether the rotational rate of the drum 143 has reached a high speed rotational rate M (for example, 1,000 rpm.). If the rotational rate of the drum 143 has not yet reached 'M' (No), the operation returns to Step 14 (S14). If it has already reached 'M' (Yes), the operation goes to Step 16 (S16). At Step 16 (S16), it is judged whether a predetermined period of time for dehydration has already elapsed. If the period has not yet elapsed (No), the operation returns to Step 14 (S14). If the period has already elapsed (Yes), the operation goes to Step 17 (S17), the rotation of the drum 143 will be stopped to end the dehydration operation.

Figure 23:
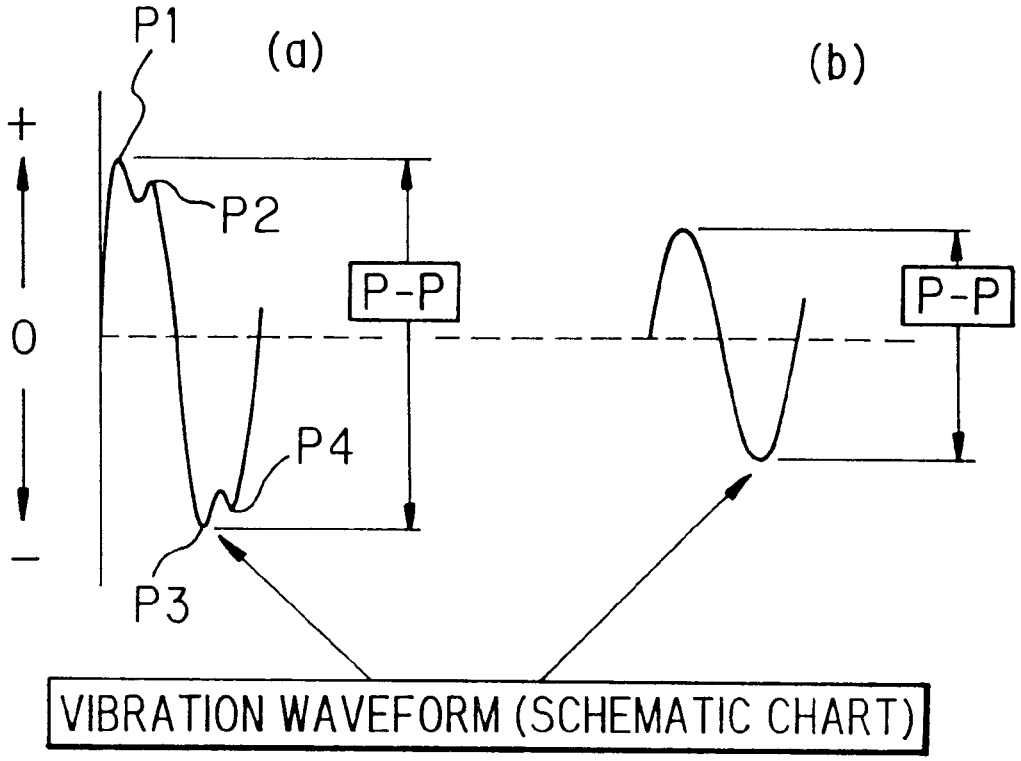
FIG. 23 is an illustration showing the concept of sampling the P—P value from the output waveform from acceleration sensor.

FIG. 23 is an illustration showing the concept of sampling a P—P value from the output waveform from the acceleration sensor 160. Here, the judgment is to be made using two peaks which are located opposite each other with respect to a line which represents that the output from the acceleration sensor 160 is zero. For example, if a waveform (a) is obtained, only the difference between peaks P1 and P3 will be detected by discarding the difference between peaks P1 and P2 or between peaks P3 and P4.

Figure 21:
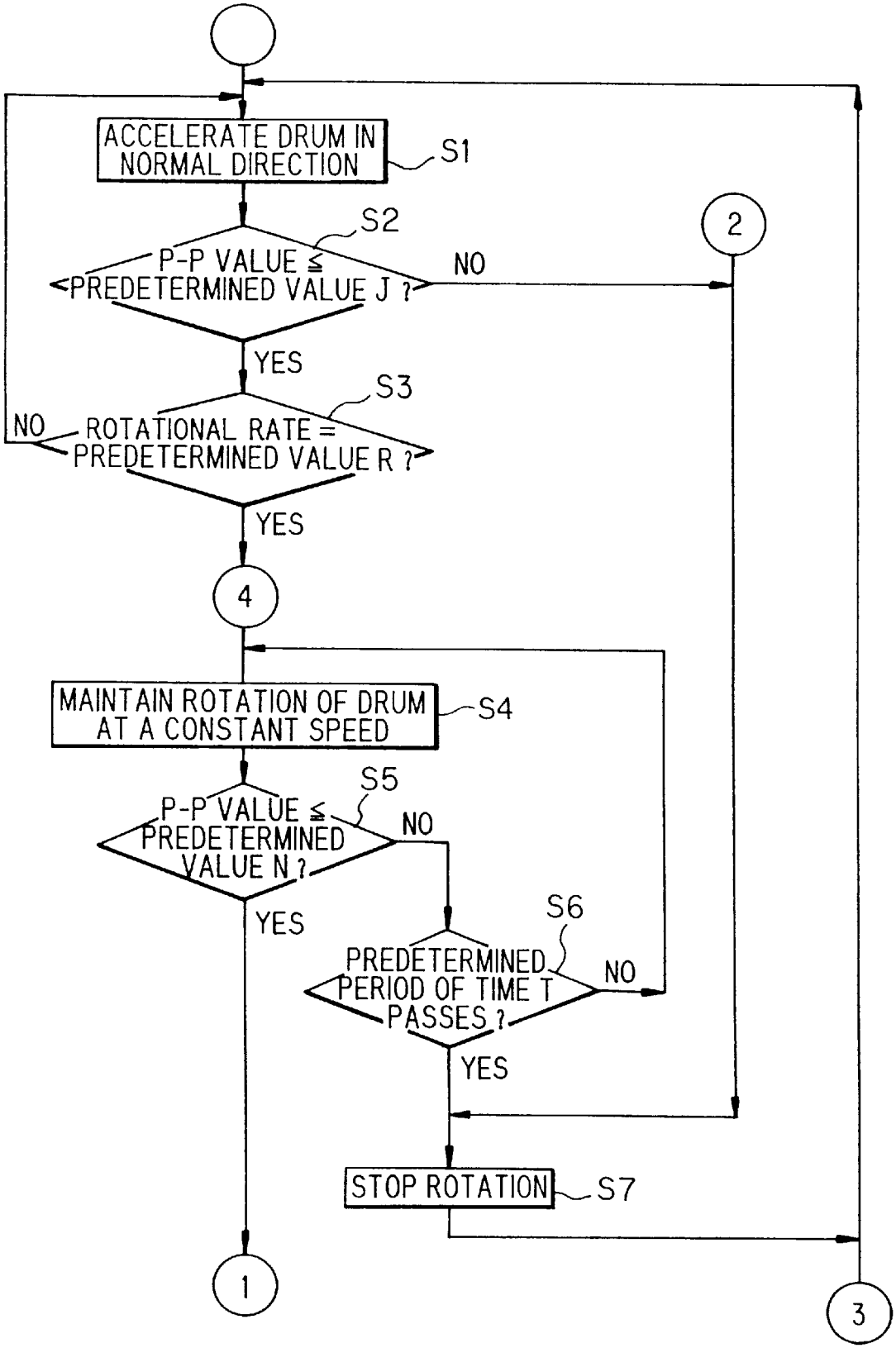
FIG. 21 is a flowchart showing the operation in the dehydrating stage of a drum type drying/washing machine of the invention.
Figure 22:
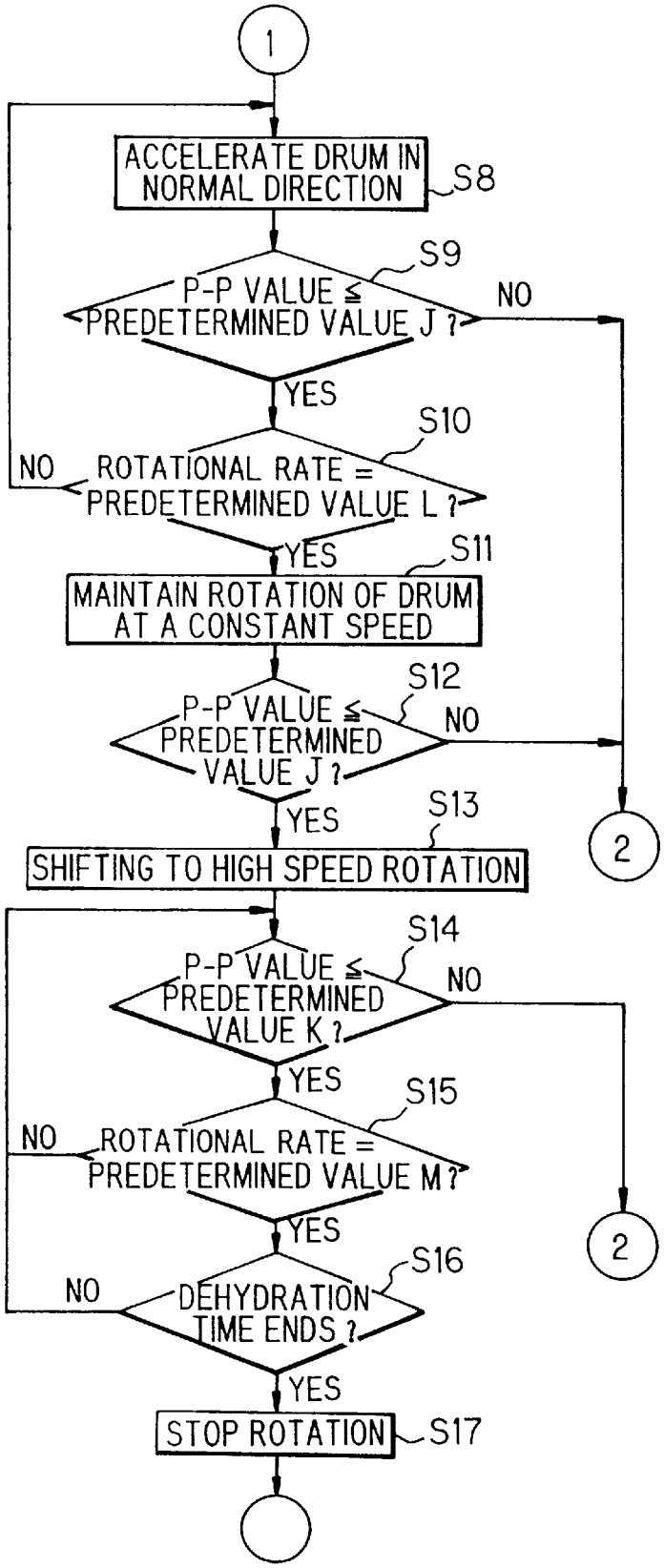
FIG. 22 is a flowchart showing the operation in the dehydrating stage of a drum type drying/washing machine of the invention.
Figure 24:
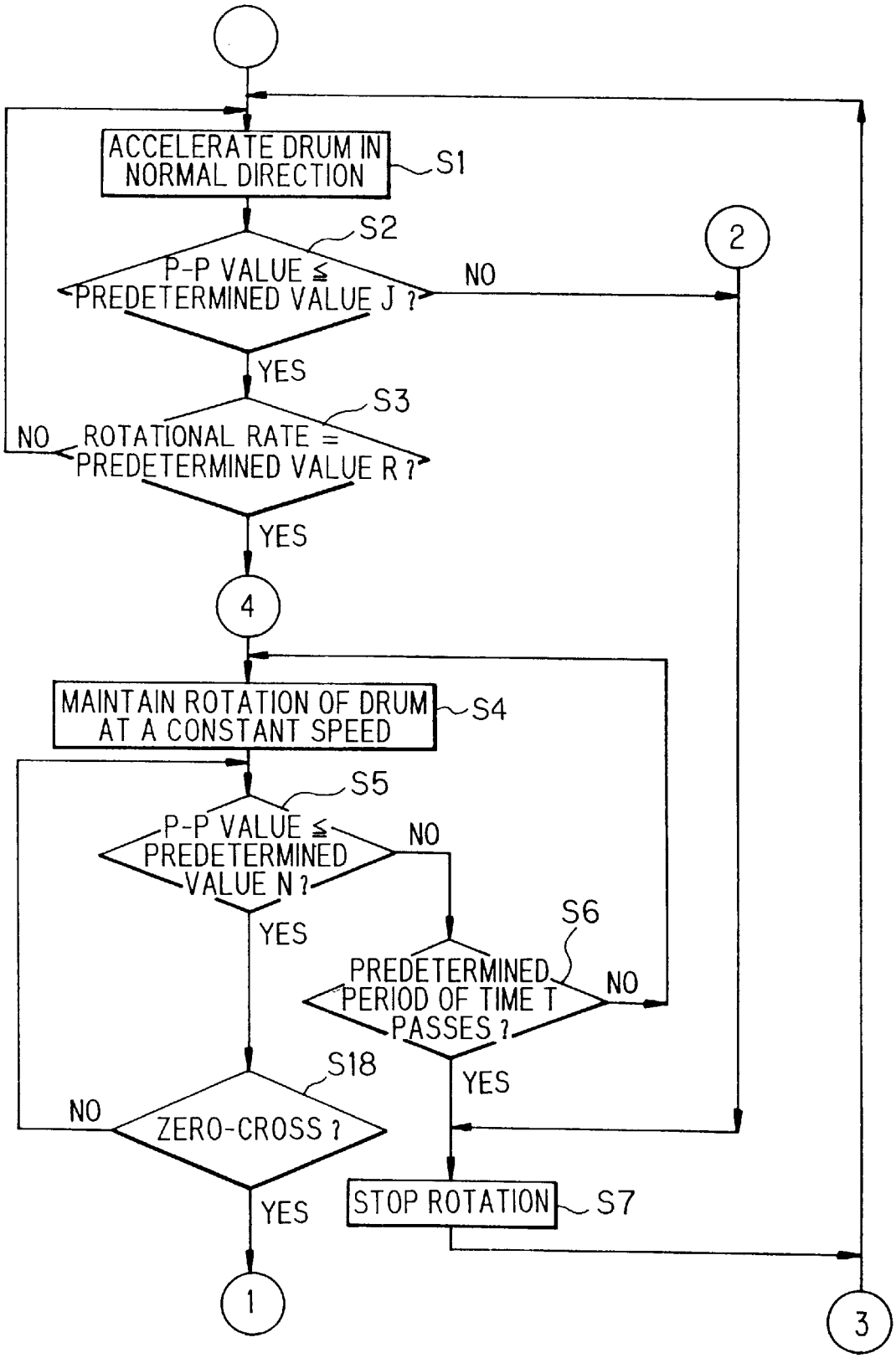
FIG. 24 is a flowchart showing the operation in the dehydrating stage of a drum type drying/washing machine of the invention and is a variational example of the flowchart shown in FIG. 21.
Figure 25:
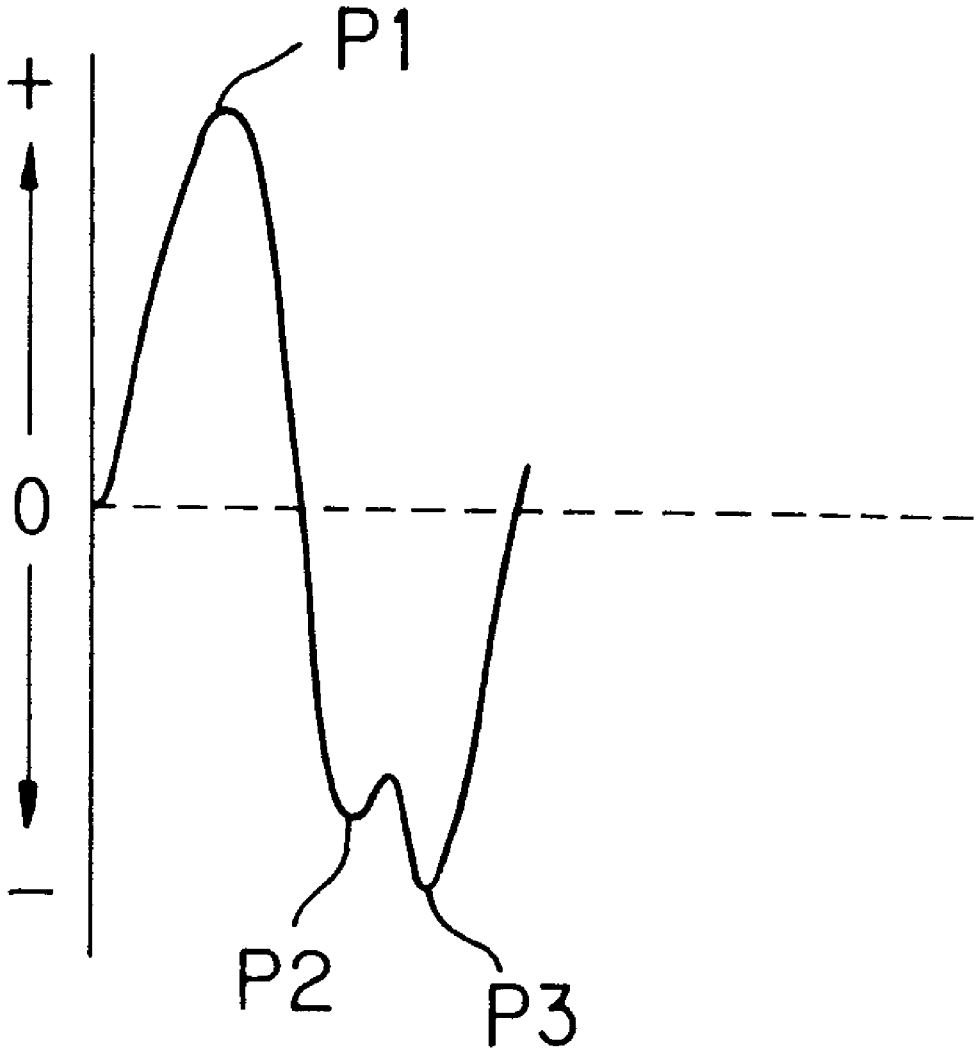
FIG. 25 is an illustration showing the concept of sampling the P—P value from the output waveform in accordance with the flowchart in FIG. 24.

FIG. 24 shows a variational example from the flowchart shown in FIG. 21. In this flowchart, another step or Step 18 (S18) is added after Step 5 (S5). The purpose of this step is to judge whether the output waveform from the acceleration sensor 160 has crossed over the line on which the output from the acceleration sensor 160 is zero (to be referred to, hereinbelow, as 'zero-cross'). If there is a zero-cross (Yes), the operation goes to Step 8 (S8) in FIG. 22. If there is no zero-cross (No), the operation returns to Step 5 (S5). For example, if a waveform shown in FIG. 25 is obtained, the difference between peaks P1 and P2 will not be recognized as a P—P value, but the distance between peaks P1 and P3 can be recognized as a P—P value, thus it is possible to make an exact judgment.

Figure 26:
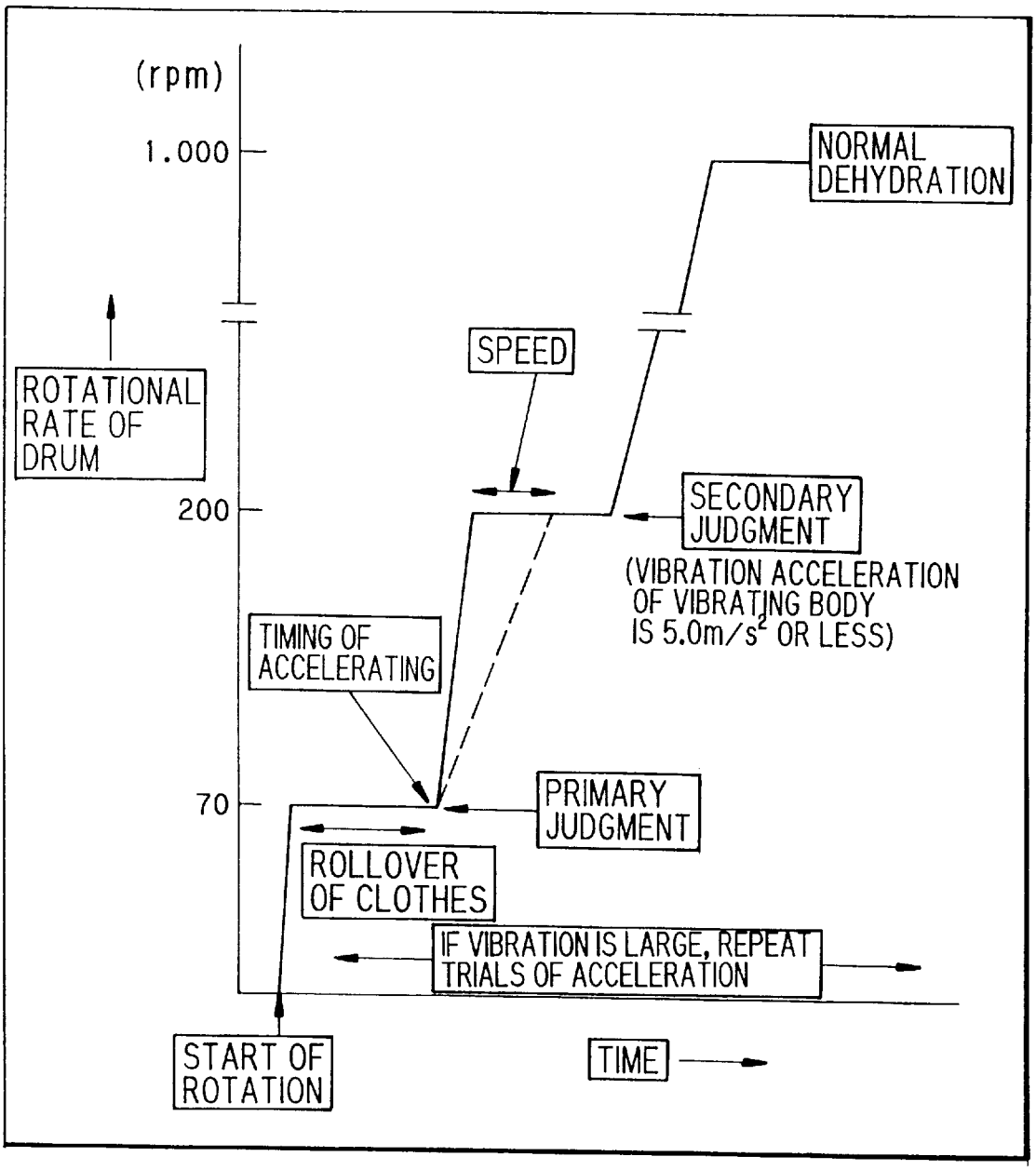
FIG. 26 is a chart showing the pattern of controlling the rotational speed of the drum.
Figure 27:
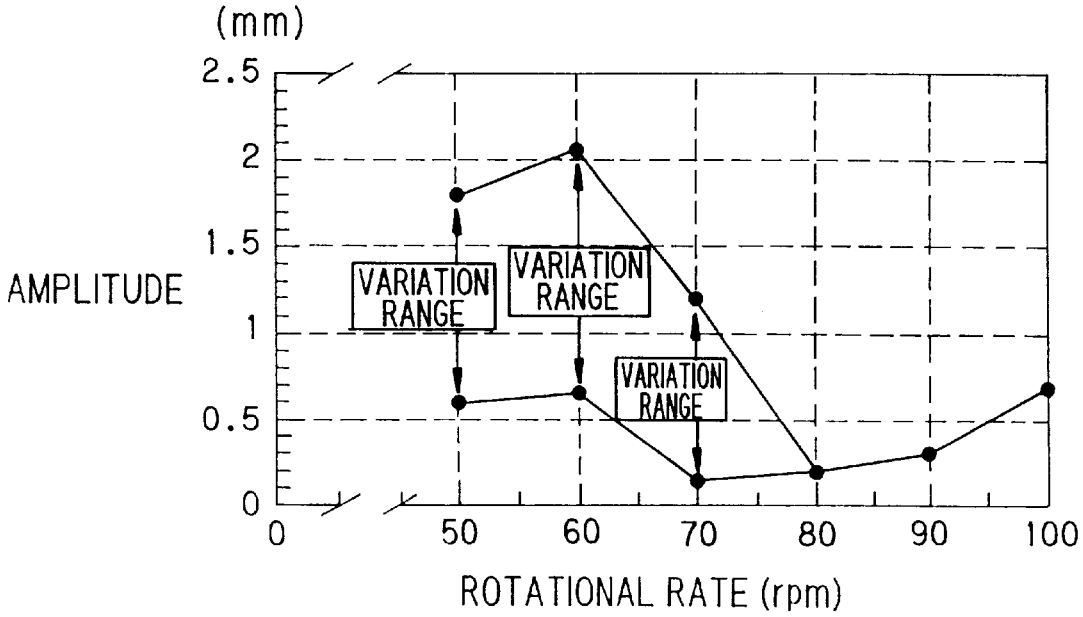
FIG. 27 is a chart for explaining the reason why 70 r.p.m. is preferred as the rotational rate at the time of the judgment for mode transition.
Figure 28A:
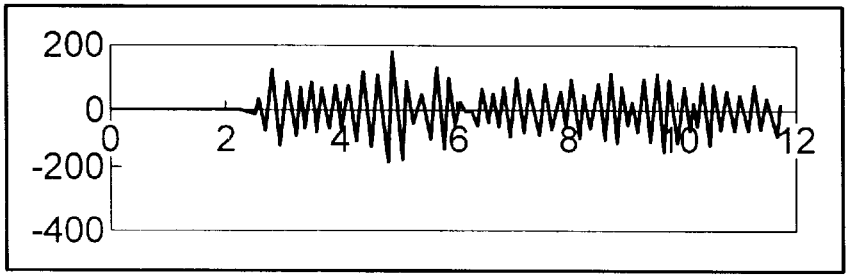
FIGS. 28A–D, hereinafter referred to as FIG. 28, are charts showing vibration waveforms from the acceleration sensor at different rotational rates.
Figure 28B:
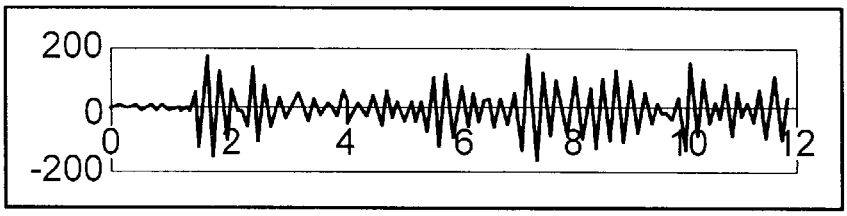
Figure 28C:
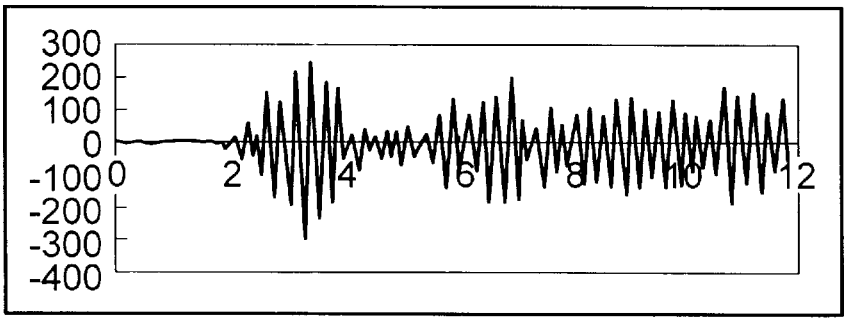
Figure 28D:
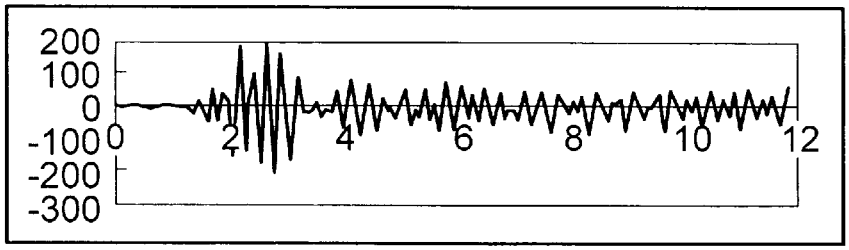

FIG. 26 is a chart showing the pattern of controlling the rotational rate of the drum 143. FIG. 27 is a graph showing the variation ranges of the average of the output from the acceleration sensor 160 during the period from 1 sec. to 2 sec. in order to show that the most preferable rotational rate R at which the judgment of whether the drum 143 should be set into the high speed rotation mode is made lies in a range of from 70 to 80 rpm.

As shown in FIG. 27, over 80 rpm., there are no variations in amplitude, whereas the variations in amplitude of the vibration at below 60 rpm. is too large and the amplitude is changing unceasingly. Therefore, those ranges are not preferable for the rotational rate R at which the judgment for setting up the high speed mode. Since the vibration waveform at 70 rpm. contains vibrations varying in amplitude appropriately and still continuing relatively long, this characteristic meets the condition in which the laundry partially moves some little by little whilst being stuck to the inner peripheral wall of the drum 143 (that is, the practically upper limit of the rotational rate at which laundry rolls over.).

Meanwhile, in order to make the laundry stick to the drum 143, it is necessary to rotate the drum 143 so that the acceleration of a mass point located on the inner surface of the peripheral wall of the drum 143 will be at least equal to or greater than the gravitational acceleration. When the radius of the drum 143 is represented by 'r', the following relations of a rotational rate 'n' of the drum 143, a circumferential velocity 'v' and an acceleration a will hold:

$$v=2\pi rn,\ \alpha=v^2/r.$$

If the drum 143 having a diameter of 45 cm is rotated at 70 rpm., then v=165 cm/s, $\alpha$=12 m/s$^2$. In this case, since the acceleration $\alpha$ is greater than the gravitational acceleration, laundry will stick to the inner surface of peripheral wall of the drum 143.

Nevertheless, laundry ought to have a thickness, therefore the part of laundry which lies closer to the center of the drum 143 will have a lower rotational speed so that it will be affected by gravity and will be shifted from the part which is sticking to the peripheral wall. This movement causes the variations in vibration amplitude. For example, a mass point which is located 5 cm inside from the inner surface of the peripheral wall of the drum 143 has an acceleration of 9.4 m/s$^2$, which is smaller than the gravitational acceleration. Thus, the laundry will be able to roll over little by little.

When the drum 143 is rotated at 60 rpm., a mass point located on the inner surface of the peripheral wall of the drum 143 has an acceleration of 8.9 $m/s^2$, so that it cannot stick to the peripheral wall of the drum 143. If the drum 143 rotates at 80 rpm., then $\alpha$=16 $m/s^2$. In this case, the laundry is able to stick to the peripheral wall of the drum 143 but the acceleration of a mass point located 8 cm inside from the peripheral wall of the drum 143 will be 10 $m/s^2$, so that the movement cannot be anticipated. At the position 9 cm inside from the inner surface, the acceleration will be 9.5 $m/s^2$, so that laundry will be able to move. This means that if much laundry is loaded, the laundry will not totally stick to the peripheral wall of the drum 143, but some parts of the laundry will become able to move even at this rotational rate.

As shown in FIG. 28, when the drum 143 rotates at 60 rpm., vibrations with large amplitudes last long. Accordingly, it is impossible to properly set the drum into the high speed mode. When the drum 143 rotates at 70 or 80 rpm., some low-amplitude vibrations appear definitely, so that it is possible to appropriately set the drum into the high speed mode. In this example, however, when the drum rotates at 80 rpm., the waveform presents periodic vibrating characteristics after 5 sec. so that no movement of laundry cannot be expected if a longer period of rotation is performed. When the drum rotates at 90 rpm., the waveform shows periodic vibrations except the unstable period at the start of rotation of the drum 143, so that no movement of laundry will not be anticipated however long the rotation may last. As apparent from the above facts, the most preferable rotational rate F when the drum is set into the high speed rotation mode (acceleration) ranges from 70 rpm. to 80 rpm.

Figure 29A:
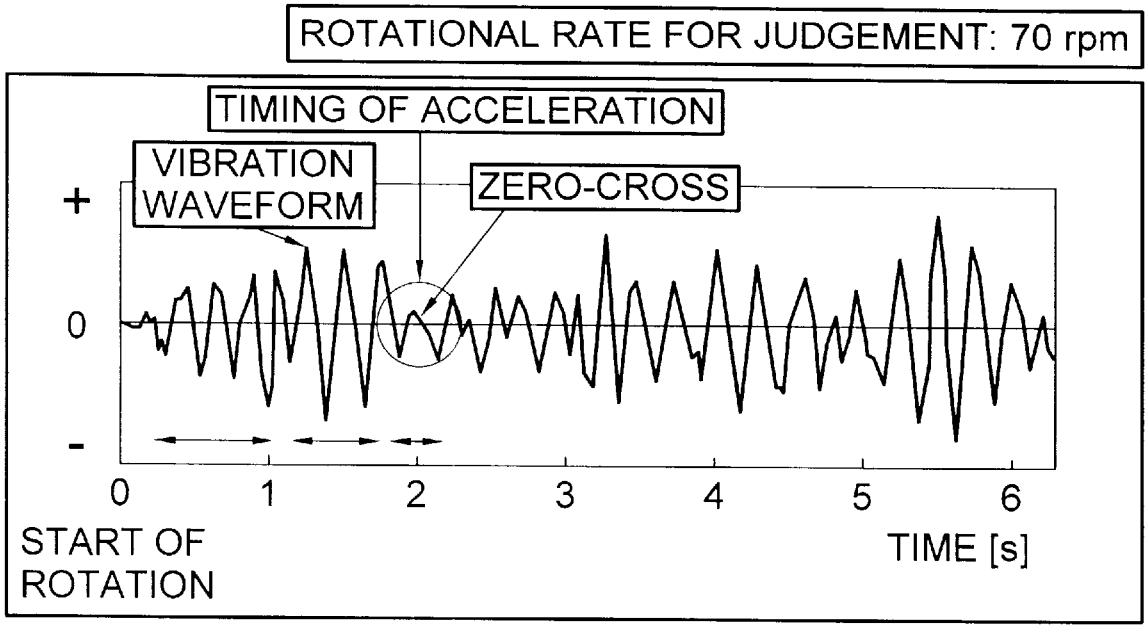
Figures 29B, 29C, 29D:
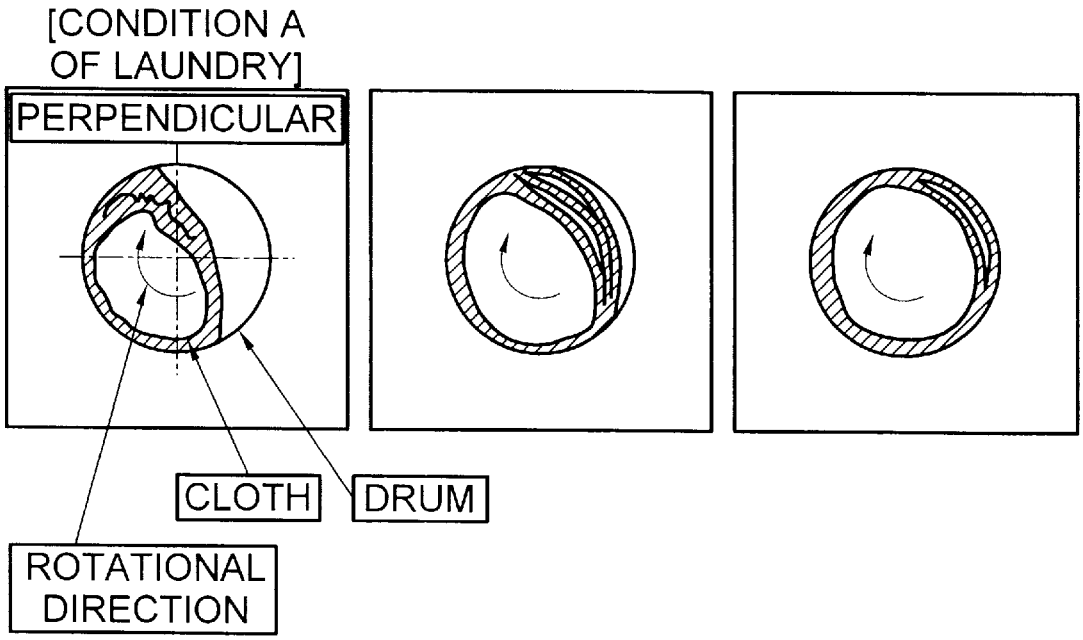

FIG. 29 is a diagram showing the timing of setting the drum into the high speed rotation mode and the zero-cross as well as the conditions of the laundry inside drum 143 by using a conceptual chart of a vibration waveform obtained from the acceleration sensor. When the drum 143 is rotated at the upper limit of the rotation rate at which the laundry is allowed to roll over, the vibration of the vibrated body containing the water tank 142 presents an output waveform which comprehends the vibration characteristics of the shock absorber 144 and the spring 145. When the resonant rotational rate of the vibrated body is 180 to 200 rpm., and the rotational rate of the drum 143 is 70 rpm., peak-to-peak oscillating waves appear at intervals of about half or quarter revolution.

When the P—P value is large, the laundry is distributed unevenly inside the drum 143, as shown in state A or B. (FIG. 29A and FIG. 29B respectively) When the P—P value is smaller, the laundry is distributed almost uniformly inside the drum 143, as shown in state C. (FIG. 29C) By judging whether the P—P value is a predetermined value E or less, it is possible to locate a portion where P—P values are small (the encircled portion). Further, at the moment that the output in the waveform intersects the 0-level line (at the zero-cross point), the drum will be shifted to the high speed rotation mode. Since the acceleration (mode transition) can be performed within the period of a quarter to one revolution from the detection of the P—P value, it is possible to set the drum into the high speed mode before the laundry makes a significant movement.

Figure 30A:
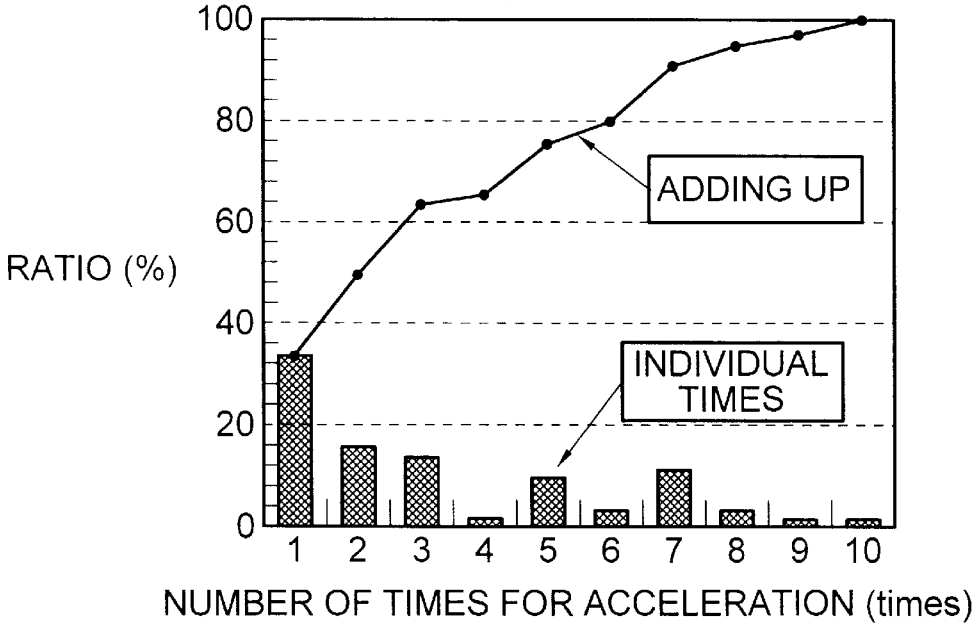
FIGS. 30A–B, hereinafter referred to as FIG. 30, are charts showing experimental results for explaining an effect when the rotational acceleration of the drum is made large.
Figure 30B:
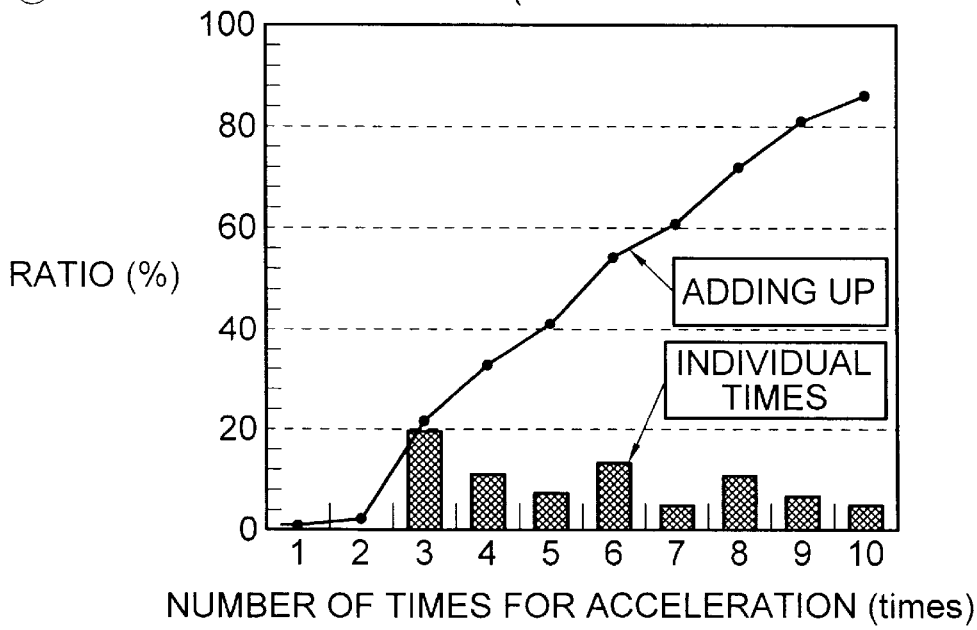

FIG. 30 is a chart showing the experimental result for explaining the effect when the rotational acceleration of the drum 143 is made large. The experiment was performed as follows:

The rotational rate of the drum 143 was raised from 70 rpm. to 200 rpm. within a predetermined period of time regardless of the conditions of the laundry inside the drum 143. The ratios of the number of times of trials which were made until the output value from the acceleration sensor 160 became equal to or below a predetermined value (5.0 $m/s^2$ represented in oscillating acceleration) when the rotational rate was raised, to the total number of test, were plotted for each number of trials. Here, the test laundry was jeans and 50 times of tests were carried out.

FIG. 30 ① shows a case where the rotation rate of the drum 143 was raised to 100 rpm. within about 1 sec. so that the laundry could stick to the peripheral wall of the drum, and then was made to reach 200 rpm. after 2 sec. from the start of the acceleration. FIG. 30 ② shows a case where the rotation rate of the drum 143 was raised from 70 rpm. to 200 rpm. over 10 sec. It is clear that case ① is more effective at raising the rotational rate by a less number of trials than case ②.

Figure 31:
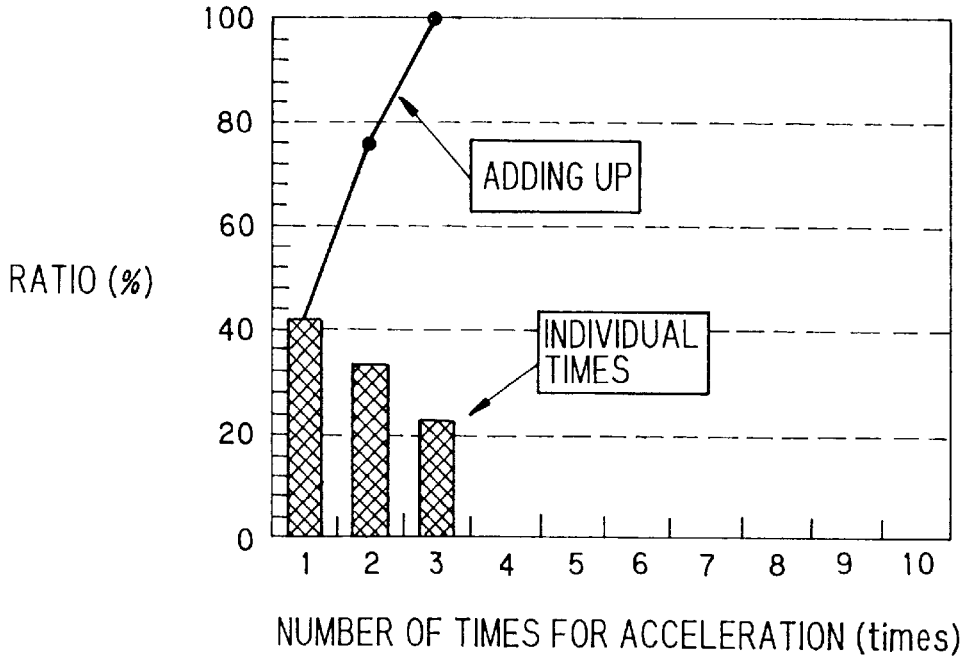
FIG. 31 is a chart showing an experimental result in a drum type drying/washing machine of the invention.

FIG. 31 is a chart showing the experimental result of the drum type drying/washing machine of this embodiment. Here, the drum was accelerated as in the above case ①. As shown in this figure, the vibration of the drum was stabilized to not more than a predetermined level, within three times of trials for acceleration (mode transition). This result is drastically excellent compared to that of the case ① or ②.

Figure 32:
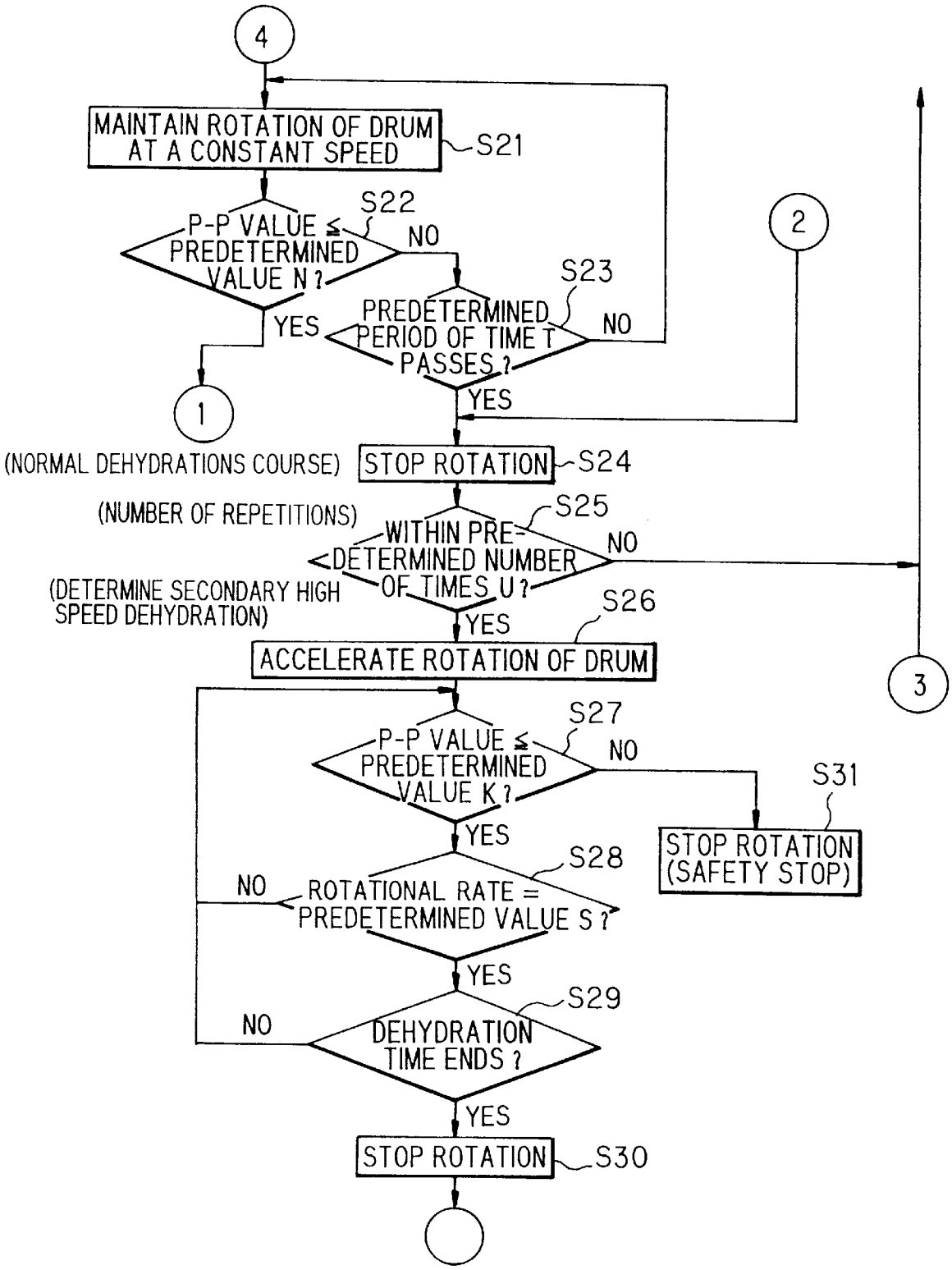
FIG. 32 is a flowchart showing the operation in the dehydrating stage of a drum type drying/washing machine when laundry cannot be separated and a large uneven distribution of weight is occurred.

In the case where an article, such as one of sport shoes (e.g., basketball shoes) though it is not typical as laundry, which cannot be separated and therefore must cause a large uneven distribution of weight should be washed, it is possible to handle such kind of articles following the procedure shown in the flowchart in FIG. 32.

Now, the operation flow will be described with reference to this flowchart. First, Step 1 (S1) to Step 3 (S3) in FIG. 21 are performed. At Step 3 (S3), if it is determined that the rotational rate of the drum 143 has reached predetermined value R (Yes), the operation goes to Step 21 (S21), where the drum 143 is maintained to rotate at that speed. Then, it is judged at Step 22 (S22), whether a P—P value of the output waveform from the acceleration sensor 160 is a predetermined value N or less. If it is 'N' or less (Yes), the article inside is assumed as normal laundry and the operation goes to Step 8 (S8) in FIG. 22.

At Step 22 (S22), if the P—P value is greater than the predetermined value N (No), the operation goes to Step 23 (S23), where it is judged whether a predetermined time 'T' (20 sec. for example) elapses from the start of rotation of the drum 143. If the time has not yet elapsed (No), the operation returns to Step 21 (S21). If the time has elapsed (Yes), the operation goes to Step 24 (S24), where the drum 143 is interrupted rotating.

Next, it is judged at Step 25 (S25) whether the drum 143 has been already interrupted at a predetermined number of times U (for example, six times). If the number of the interruptions has not yet reached U (No), the operation returns to Step 1 (S1) in FIG. 21. If the number of the interruptions reaches U (Yes), the laundry is assumed to contain articles which cause large unbalance and cannot be separated and the operation goes to Step 26 (S26) where the drum 143 will be rotationally accelerated. Next, the operation goes to Step 27 (S27), where it is judged whether a P—P value is a predetermined value K or less. If it is 'K' or less (Yes), the operation goes to Step 28 (S28). If it is greater than 'K' (No), the operation goes to Step 31 (S31) where the drum 143 will stop rotating.

Next, it is judged whether the rotational rate of the drum 143 at Step 28 (S28) is equal to or below a predetermined value S which is a second high speed rotational rate (here S<M). When it is 'S' or less (Yes), the operation goes to Step 29 (S29). If it is grater than 'S' (No), the operation returns to Step 27 (S27). Next, at Step 29 (S29), it is judged whether a predetermined time for dehydration (this dehydrating time is longer than that of normal dehydration) has elapsed. If it has not yet elapsed (No), the operation returns to Step 27 (S27). If it has already elapsed (Yes), the operation goes to Step 30 (S30), where the rotation of the drum 143 is stopped to end the dehydration running.

Figure 33:
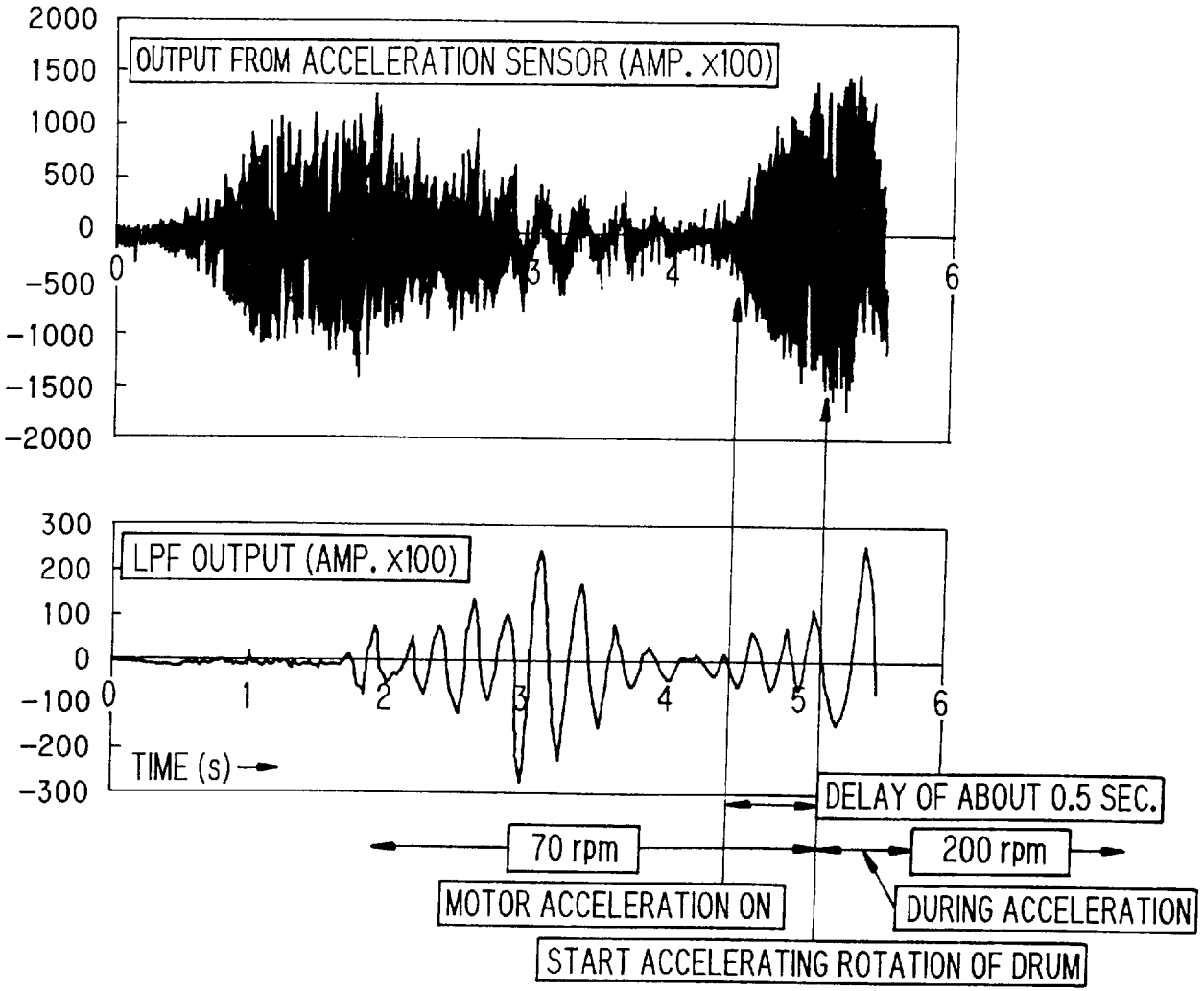
FIG. 33 is a chart showing a comparison of the output waveform from the acceleration sensor and the output waveform from the low pass filter, and explaining an example of a time lag between the time at which motor starts to be accelerated and the time at which the drum starts to be accelerated.

Because of the characteristics of the motor such as torque is small or any other factors, the shift of the drum into the high speed rotating mode may occur slowly. FIG. 33 is a chart showing an example of a time lag between the time at which the motor starts to be accelerated and the time at which the drum starts to be accelerated. This chart shows a comparison of the output waveform from the acceleration sensor 160 and the output waveform from the low pass filter 162. As shown in this figure, as a signal which triggers the acceleration of the motor 148 is given, a current flows through the motor 148. Since the acceleration sensor 160 tends to pick up the noise of the current, a large variation occurs in the output waveform from acceleration sensor 160. Since this noise component can be eliminated through the low pass filter, no variation will not occur at that moment in the output waveform from the low pass filter 162. Then, this output begins to become large from about 0.5 sec. This means that the drum 143 starts to accelerate.

When the mode transition (acceleration) occurs slowly as in the above way, there occurs a problem that the condition of laundry may change during the period from the time at which mode transition is decided to the time at which the drum is actually accelerated so that it may become impossible to change the driving mode whilst the condition of laundry is maintained as it is when the mode transition is decided. This problem can be worked out if a predetermined number of P—P values in a row are all made lower than a threshold. For example, when a delay for mode transition is as much as 1 sec., it is possible to set up the system so that the mode transition will be started after recognizing that three or four consecutive P—P values are all lower than a threshold.

The fact that a series of P—P values are all lower than a threshold suggests that the laundry must be stabilized and maintained in a even distribution. This method will be able to countermeasure the delay in the mode transition. However, since the P—P value is still changing at any time, the increase in the number of judgment based on the P—P value does not mean the improvement but it is preferable that the decision can be made in a less number of judgment. That is, preferably, the decision should be made during the period corresponding to a half revolution of the drum 143.

Figure 34:
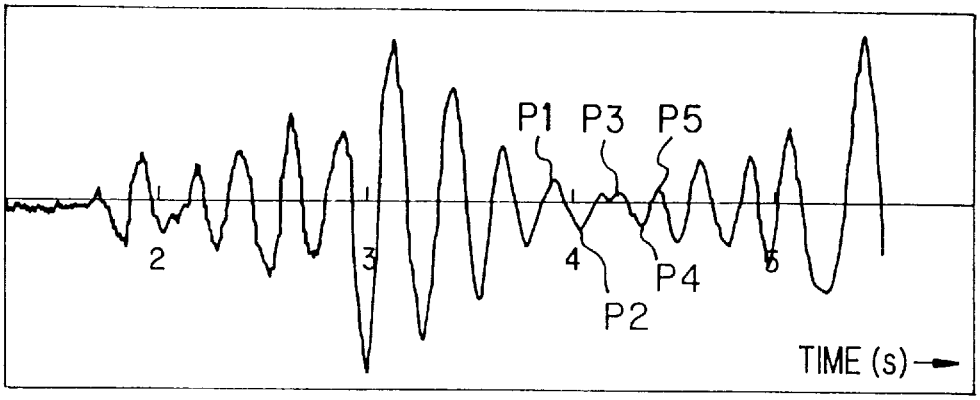
FIG. 34 is a chart for explaining the concept of how a series of P—P values are sampled.

FIG. 34 is a chart for explaining how to sample a number of P—P values in a row. In this figure, P1–P2 indicates the first P—P value, P2–P3 the second one, P3–P4 the third one, and P4–P5 the fourth one.

Figure 35:
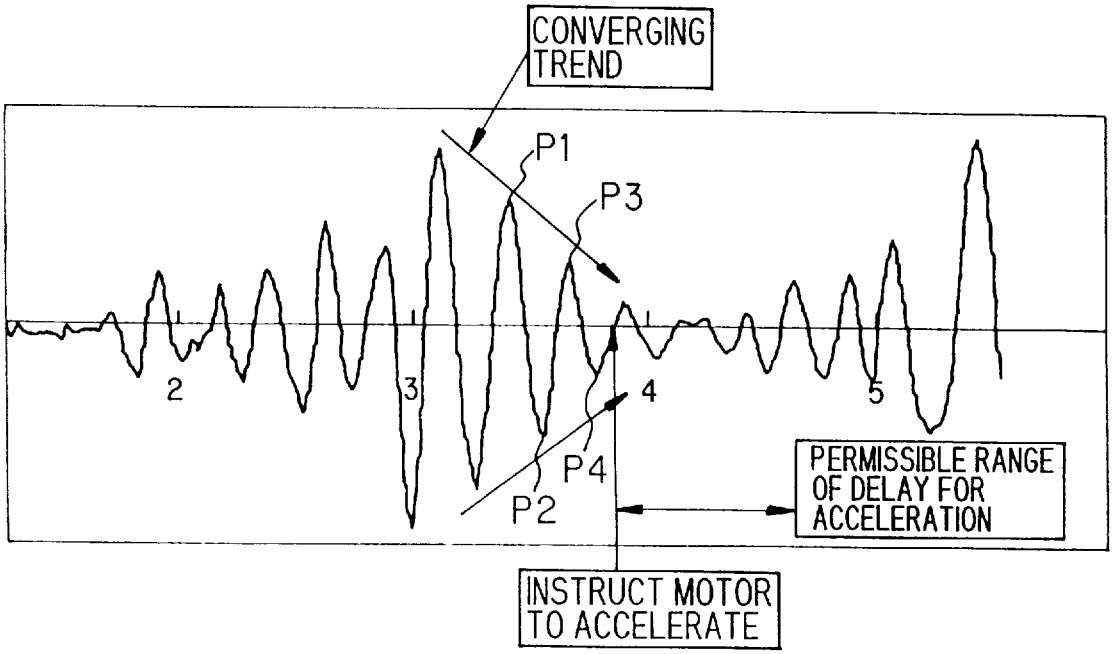
FIG. 35 is a chart showing a case where the vibrating waveform from the acceleration sensor is in the converging trend.

For the case where there is a delay in the mode transition, it is possible to reduce the possibility of changing the state of laundry and further improve the countermeasure against the delay in the mode transition if another condition whether the vibration is in the converting trend is checked in addition to the above condition for the mode-change judgment. For example, in the vibration waveform shown in FIG. 35, only when the P—P values between P1 and P2, P2 and P3, P3 and P4 and P4 and P5, are all smaller than a threshold and these P—P values become smaller successively, the mode transition to the high speed rotation mode may and should be performed.

Figure 36:
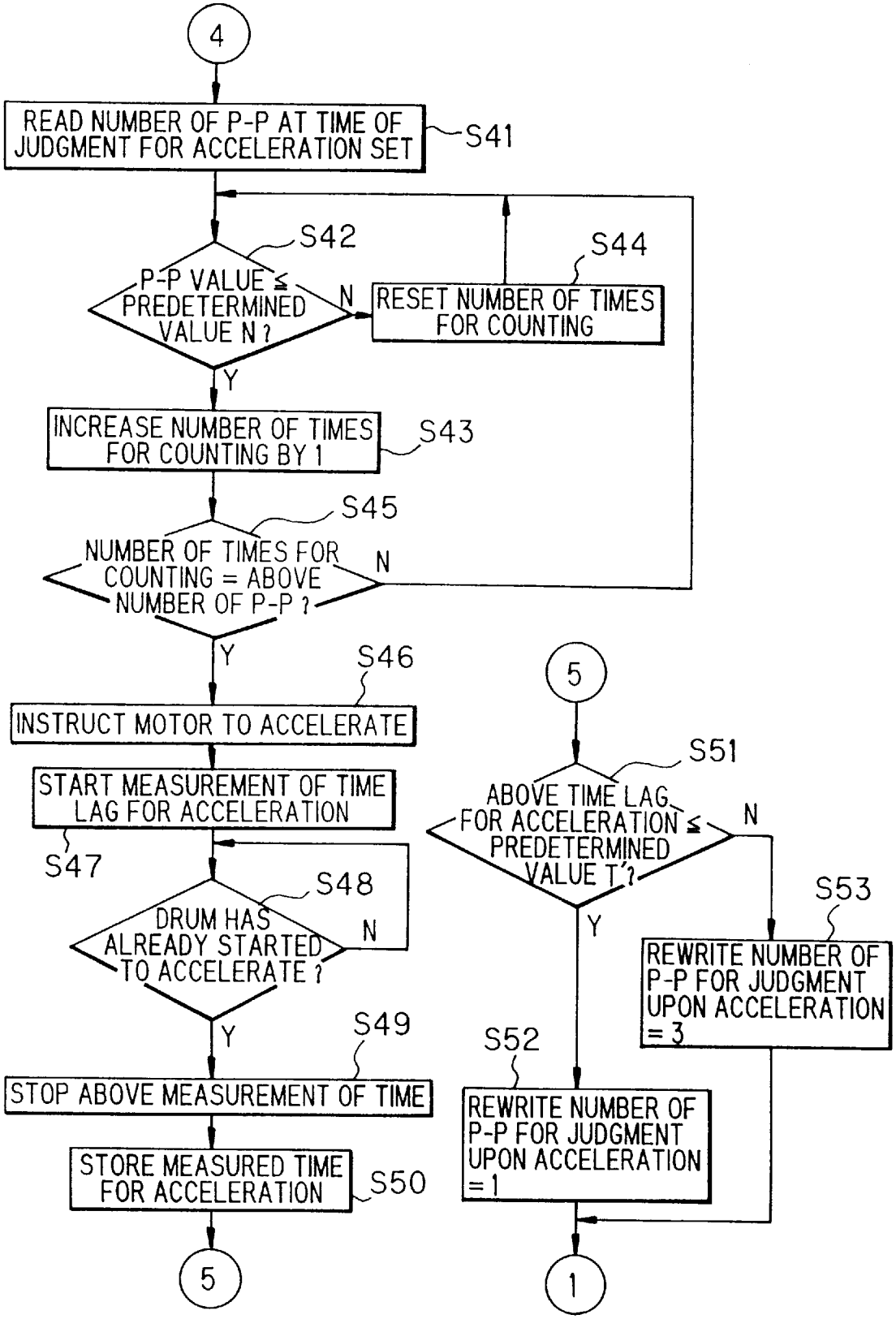
FIG. 36 is a flowchart showing the operation during the dehydration stage of a drum type drying/washing machine having a learning function, which performs the next judgment for mode transition using a series of P—P values when the speed of the mode transition is slow.

It is also possible to construct a system in which the judgment for mode transition is initially made by a single P—P value, and if it is recognized that the driving mode of the drum cannot be changed quickly, a predetermined number of P—P values in a row can be used for the next judgment for acceleration. FIG. 36 is the flowchart showing the operation during the dehydration running in a drum type drying/washing machine having such a learning function.

First, Step 1 (S1) to Step 3 (S3) in FIG. 21 are performed. At Step 3 (S3), if it is determined that the rotational rate of the drum 143 has reached a predetermined value R (Yes), the operation goes to Step 41 (S41), where a previously determined P—P number for the judgment at the mode transition is read into RAM. Then, at Step 42 (S42), it is judged whether a P—P value is the predetermined value N or less. If the P—P value is 'N' or less (Yes), the operation goes to Step 43 (S43) where the count stored in RAM is increased by 1. If the P—P value is above 'N' (No), the operation goes Step 44 (S44) where the count stored in RAM is reset, and returns to Step 42 (S42).

Next, at Step 45 (S45), it is judged whether the count is equal to the aforementioned P—P number. If it is true (Yes), the operation goes to Step 46 (S46) where the motor 148 is accelerated. If the count is not equal to the P—P number (No), the operation returns to Step 42 (S42). Next, at Step 47 (S47), started is the measurement of a time lag from the time when the signal for accelerating the motor 148 is given to the time when the drum 143 will actually be accelerated. Then, at Step 48 (S48), it is judged whether the drum 143 starts to be accelerated. If the drum starts to accelerate (Yes), the operation goes to Step 49 (S49) where the measurement of the time lag for mode transition is stopped. If the drum has not been accelerated yet (No), it is judged again whether the drum 143 starts to be accelerated. Next, at Step 50 (S50), the measured time lag or delay of the mode transition is stored into RAM.

Subsequently, it is judged at Step 51 (S51) whether the time lag of the mode transition is equal to or below a predetermined value T' (for example, 0.3 sec. ). If the time lag is the predetermined value or less (Yes), the operating goes to Step 52 (S52) where the P—P number for the judgment at the mode transition is rewritten to 1 and then goes to Step 8 (S8) in FIG. 22. If the time lag is above predetermined value T' (No), the operation goes to Step 53 (S53) where the P—P number is rewritten to 3 and then goes to Step 8 (S8) in FIG. 22. When the judgment at the mode transition is performed next, the P—P number determined at Step 52 (S52) or Step 53 (S53) will be used.

Although in the above description of the embodiment, a drum type drying/washing machine which performs washing, dehydration and drying was explained, the present invention can be applied to drum type washing machines which perform washing and dehydration, to drum type dryers dedicated only to drying.

The above description of the embodiment has been made of a drum type drying/washing machine of a top loading type using a double shaft-supported drum. The present invention, however, can be applied to a single shaft-supported type or a front loading type.

Figure 37:
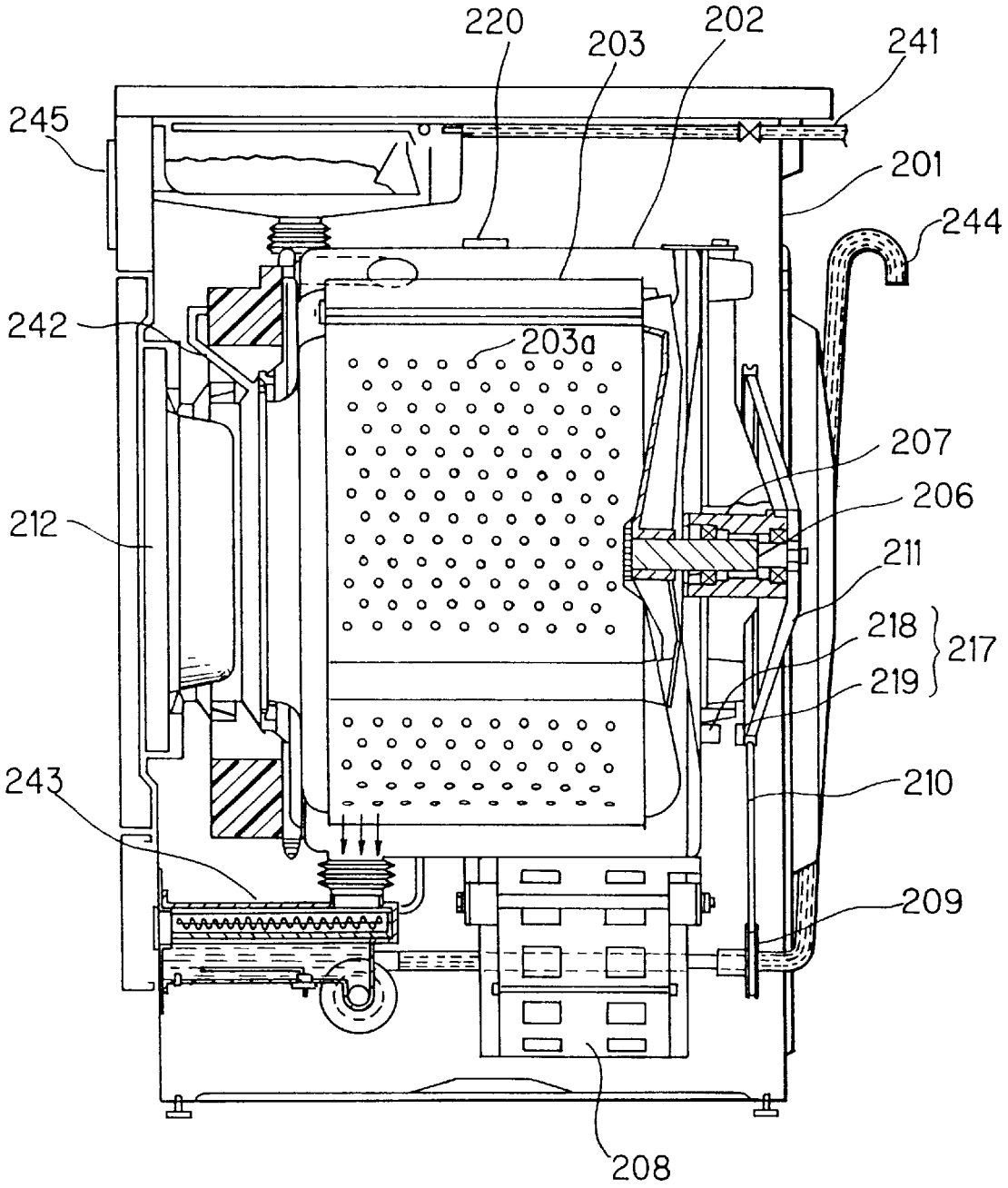
FIG. 37 is an overall sectional side elevation showing another embodiment of a drum type drying/washing machine of the invention.

Now, another embodiment of a drum type drying/washing machine of the invention will be described with reference to the drawings. FIG. 37 is a sectional side elevation showing the overall structure of a drum type drying/washing machine of the invention. This drum type drying/washing machine includes: a box-shaped housing 201, a water tank 202 disposed inside this housing 201 for holding a washing liquid, or rinsing water etc.; and a drum 203 supported rotatably inside this water tank 202 for accommodating laundry.

The drum 203 is formed of a cylinder having a diameter of about 46 cm and has many small holes 203*a* throughout the circumferential wall of it. The drum 203 has a horizontal shaft 206 projected from the backside wall and is supported by a bearing 207 provided for the water tank 202 so that the drum 203 can be rotated. A reference numeral 208 designates a drum motor which corresponds to means for rotating the drum 203 and has a rotary shaft to which a pulley 209 is fixed. This pulley 209 is linked with a drum driving pulley 211 which is fixed to the horizontal shaft 206, through a driving belt 210.

A door 212 which is opened and closed for allowing laundry to be loaded and taken out is provided on the front side of the housing 201. A reference numeral 217 designates a rotational sensor for measuring the rotational rate of the drum 203, and the rotational sensor 217 is composed of a reed switch 218 affixed to the outer wall of the water tank and a magnet 219, which is opposite the reed switch 218, affixed to the drum driving pulley 211.

The water tank 202 is provided with a water supply pipe 241 for supplying water, a circulating pipe 242 for circulating the washing liquid or rinsing water, a reservoir water tank 243 for circulating and storing the washing liquid or rinsing water, and a drain outlet 244 for discharging the washing liquid or rinsing water. Provided on the front side of the housing 201 is a control panel 245 having a power switch, a start switch, etc.

Figure 38:
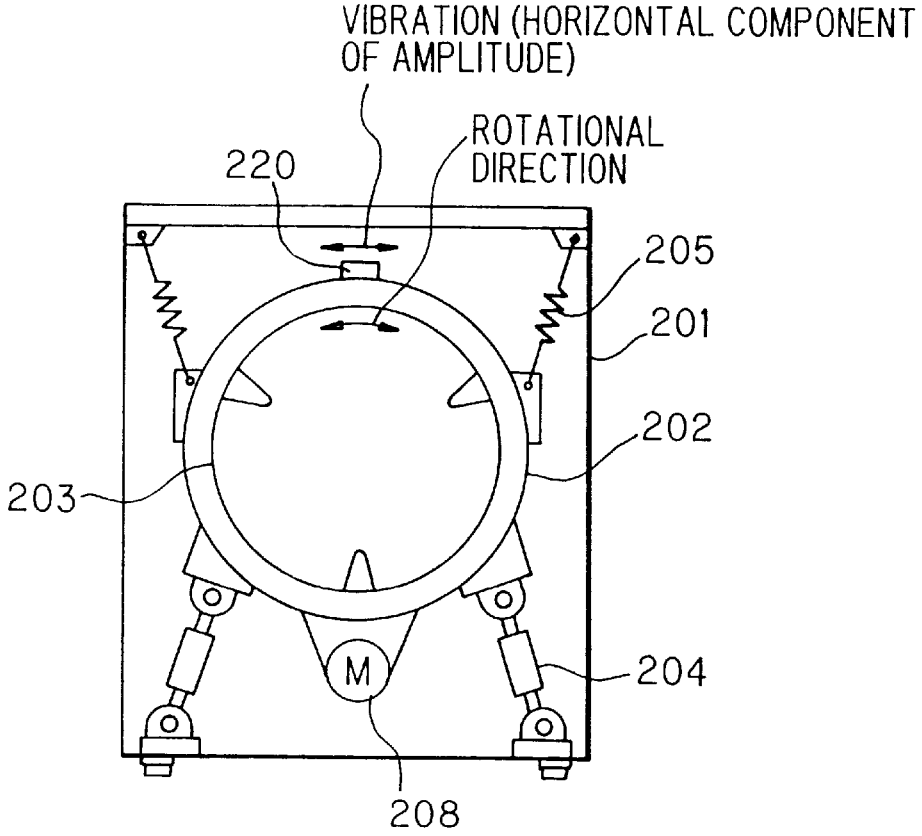
FIG. 38 is an overall sectional front elevation showing the drum type drying/washing machine of FIG. 37.

As shown in FIG. 38, the bottom of the water tank 202 is supported by a shock absorber 204 which alleviates vibrations. Further, the water tank 202 is hoisted by springs 205 which are attached to the upper inside of the housing 201 in order to alleviate vibrations. Therefore, the water tank 202 is supported so as to be able to oscillate inside the housing 201 by means of these shock absorber 204 and springs 205.

The drum type drying/washing machine of this embodiment has a vibration sensor for detecting the vibrations of the water tank 202. Specific examples of vibration sensor include displacement sensors which directly detects the amplitude of vibrations of the water tank 202 and acceleration sensors using the piezoelectric effect of piezoelectric elements such as quartz crystal., ceramic etc. which output electric signals proportional to the acceleration exerted on the water tank 202. In this embodiment, an acceleration sensor is adopted.

As apparent from FIG. 38, an acceleration sensor 220 is attached on the top of the water tank 202 so that it can detect the vibration of the water tank 202 in horizontal directions (the horizontal component of the vibration) relative to the mounted surface of the washing machine. The horizontal component of the vibration of the water tank 202 is indicated by bidirectional arrow in the figure.

The acceleration sensor 220 operates based on the following principle. Vibrations from the outside will cause a mass inside the housing of the acceleration sensor 220 to exert forces on a piezoelectric element. This mechanical stress will break down the balance between positive and negative ions to generate electric charges. These electric charges will be accumulated on the electrodes and finally will be outputted as a vibration waveform by means of a vibration detecting circuit. The amount of the accumulated charges will be proportional to the force exerted, which will be proportional to the acceleration.

Figure 39:
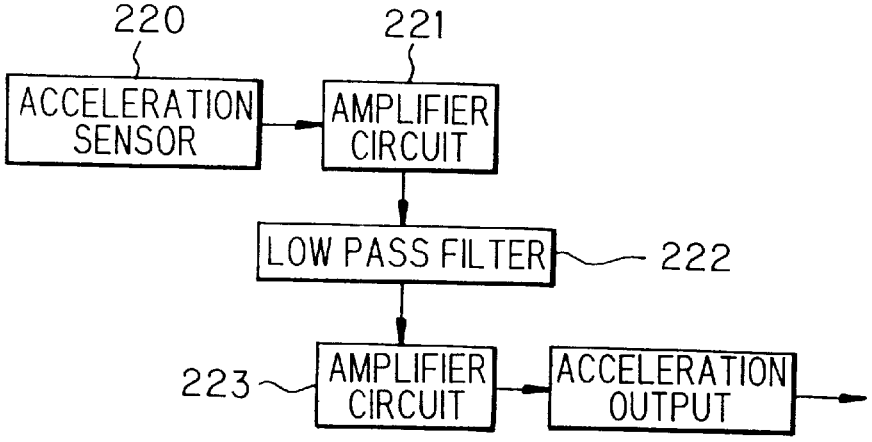
FIG. 39 is a block diagram showing a vibration detecting circuit.
Figure 40:
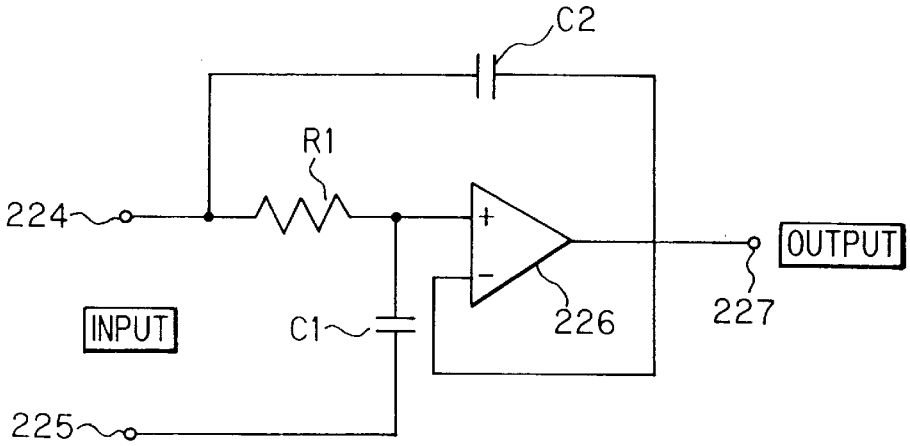
FIG. 40 shows a basic circuit diagram of the low pass filter.

FIG. 39 is a block diagram showing a vibration detecting circuit when an acceleration sensor is used as the vibration sensor. In this figure, a signal outputted from the acceleration sensor 220 is amplified in an amplifier circuit 221. Then, the signal is converted in a low pass filter 222, and again amplified through an amplifier circuit 223 to be outputted as a vibration waveform. FIG. 40 shows a basic circuit diagram of the low pass filter of FIG. 39. In this figure, 224 and 225 designate input terminals to which the output from the acceleration sensor 220 is imparted. A reference numeral 226 designates an operational amplifier, R1 a resistor, C1 a capacitor, C2 a feedback capacitor, 227 an output terminal.

Here, the low pass filter used in this embodiment is preferably of a type for about 3 Hz. This is because the sensing system is required to be able to handle vibration waveforms of any type. That is, the vibration waveform will change drastically, depending on difference in the vibration characteristics of the vibrated body, specifically, depending upon the spring constant, the rotational rate, the difference of movement of the materials to be processed.

Figure 41:
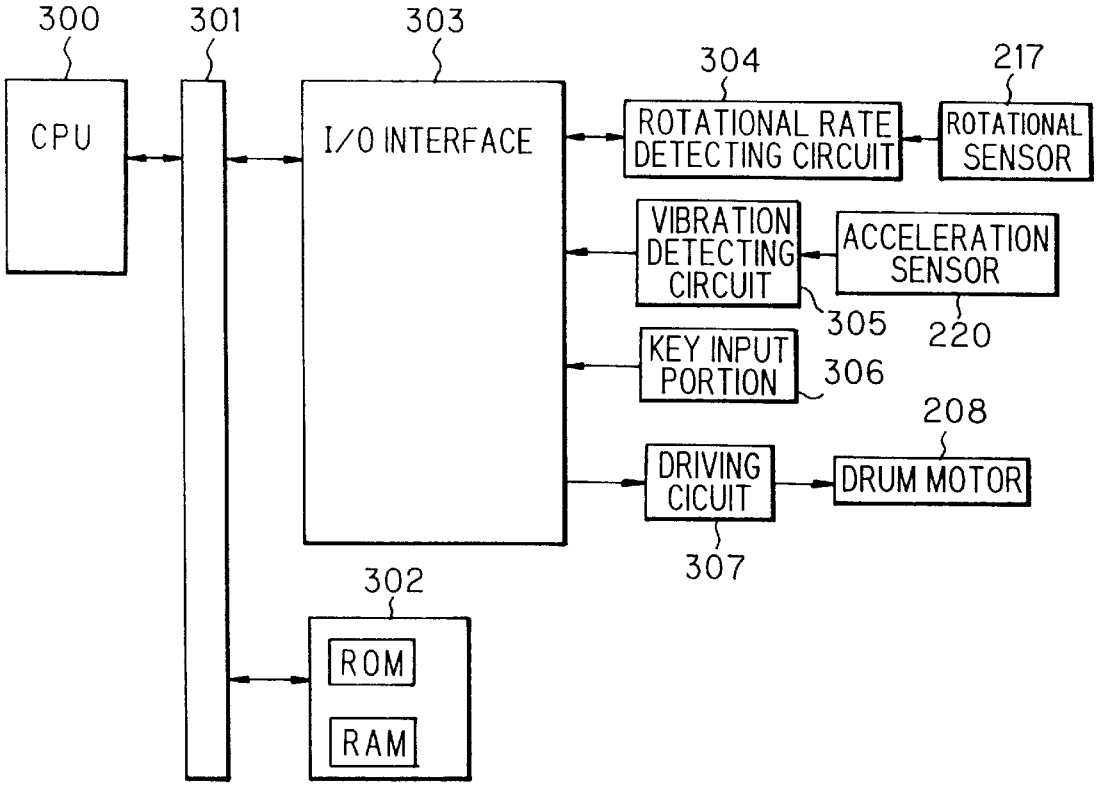
FIG. 41 is a block diagram showing an electronic controlling circuit.

Next, description will be made of an electronic control circuit as the controlling means of the drum type drying/washing machine of this embodiment. As shown in FIG. 41, the electronic controlling circuit comprises: a CPU 300 made up of a controlling section and an operating section; a data bus 301; a memory 302 consisting of ROMs and RAMs; an I/O interface 303; the rotational sensor 217; a rotational rate detecting circuit 304 for detecting the rotational rate from the output from the rotational sensor 217; the acceleration sensor 220; a vibration detecting circuit 305 for producing a vibration waveform from the signal outputted from the acceleration sensor 220; a key input portion 306 for allowing the user to select various processes such as washing, rinsing, etc. as well as to start the operation; the drum motor 208; and a driving circuit 307 for driving the drum motor 208.

Now, consider a case where the drum 203 shown in FIGS. 37 and 38 is rotating at a low speed. In this case, since the vertical vibration is strongly affected by gravity, the downward displacement of the vibration will become large while the upward displacement of the vibration will become small even if the amount of unbalance in the drum 203 is the same. As to the vibration in the horizontal direction, since gravity equally affects on the horizontal vibrations on both sides, the vibrations caused by the unbalance inside the drum 203 will be markedly greater than that attributed to gravity. Accordingly, it is possible to estimate the degree of uneven distribution of laundry by detecting the vibrations in a horizontal direction which is perpendicular to that of the rotary shaft of the drum 203.

Figure 42A:
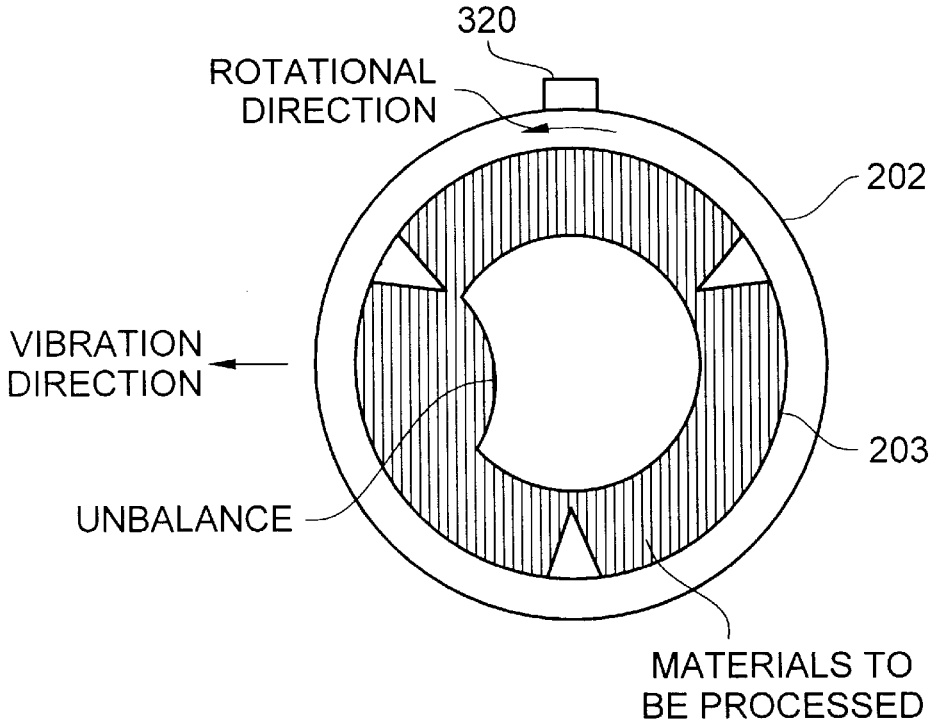
FIGS. 42A–B, hereinafter referred to as FIG. 42, are schematic illustrations showing a relation between an unbalanced part of laundry and vibrations.
Figure 42B:
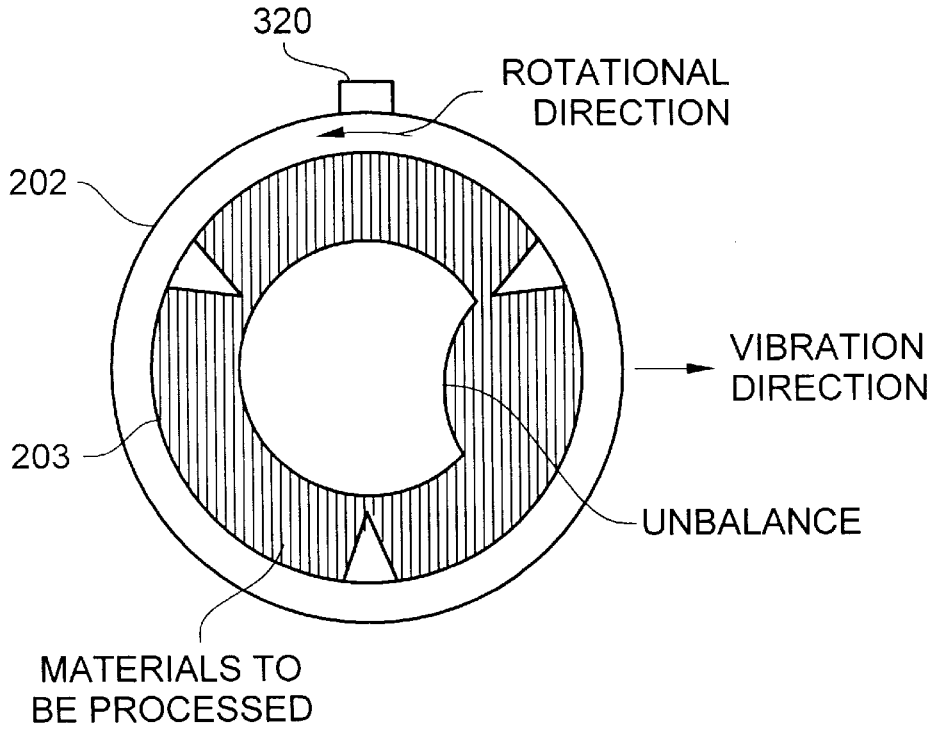

As shown in FIG. 42, as the drum 203 rotates, an unbalanced part, if there is, moves right and left so as to cause horizontal vibrations. Accordingly, if there is an unbalanced part, the drum 203 as a whole, displaces right and left once during each revolution. Therefore, it is possible to know what degree the laundry is unevenly distributed by detecting the vibration waveforms in the horizontal direction.

Figure 43A:
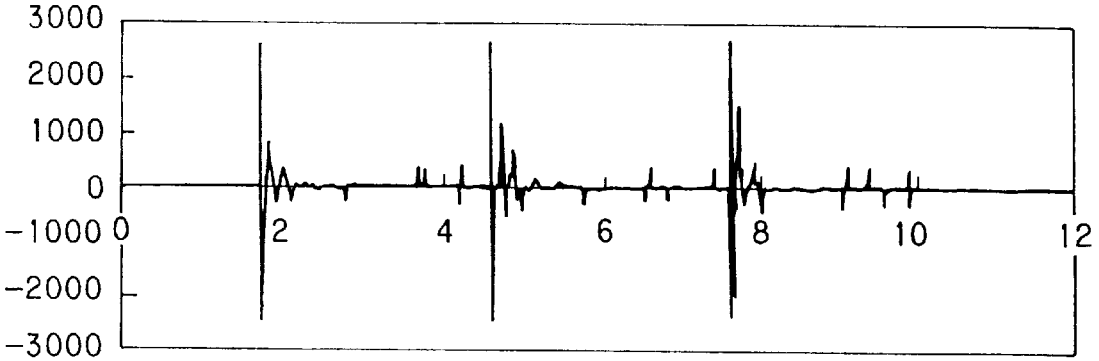
FIG. 43A is a chart showing an output waveform from acceleration sensor when impacts are imparted whilst a drum is unrotated and FIG. 43B is a chart showing a vibration waveform produced by making the output shown in FIG. 43A undergo a low pass filter.
Figure 43B:
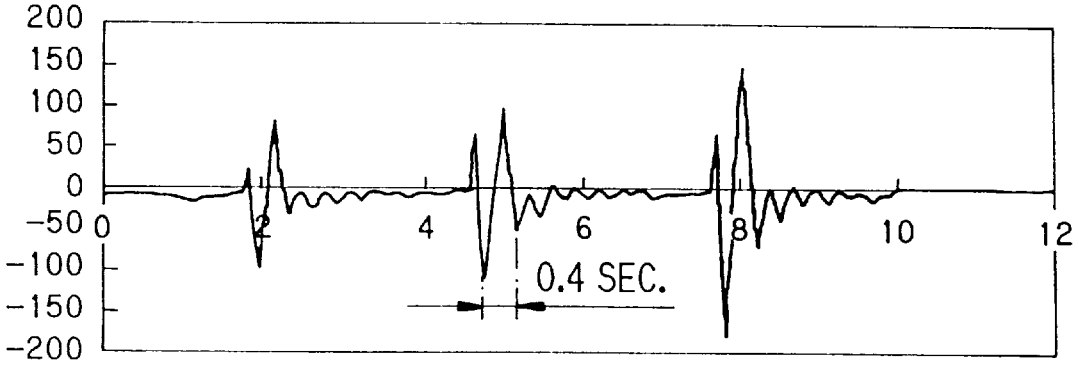

FIG. 43A is a chart showing an output waveform from the acceleration sensor 220, where the abscissa represents time (sec.) and the ordinate represents the magnitudes of the signal. This chart shows that three repeated impacts in one direction were imparted whilst the drum 203 was unrotated. There appear many vibrations at a time (many vibrations are superposed in the figure). FIG. 43B is a chart showing a waveform was produced by making the output from the acceleration sensor 220 undergo the low pass filter (abbreviated as LPF in the figure) of 3 Hz. Here, it is known that the signal converges in about 0.4 sec.

Next, explained will be a case where the drum 203 is rotated at 83 rpm. In this case, the time required for one revolution of the drum 203 is 0.72 sec. Accordingly, when the output waveform is processed using the low pass filter of 3 Hz, it is possible to confine one impact under the influence of the signal generated by the impacts, during the period of about 0.4 sec. or the period in which the drum 203 makes about a half revolution. In this way, it is possible to definitely detect the horizontal vibration during the period of one revolution, which is attributed to the unbalance.

Figure 44A:
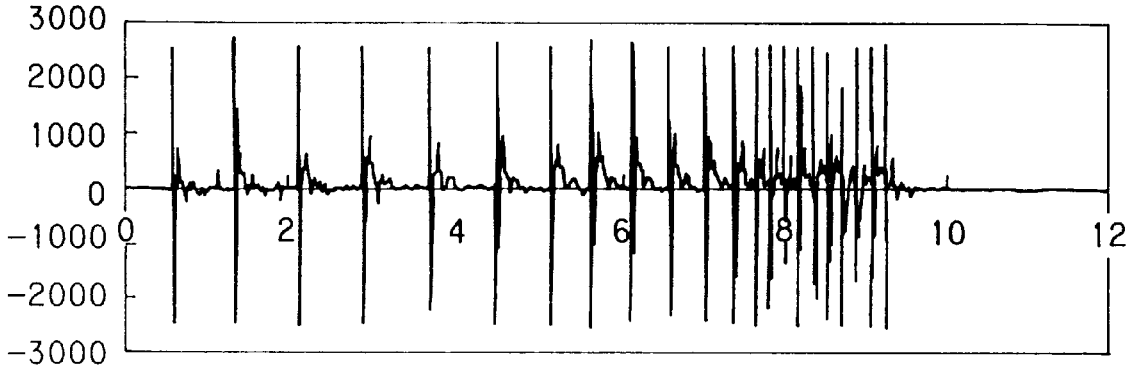
FIG. 44A is a chart showing an output waveform from acceleration sensor when impacts are imparted whilst a drum is unrotated.
Figure 44B:
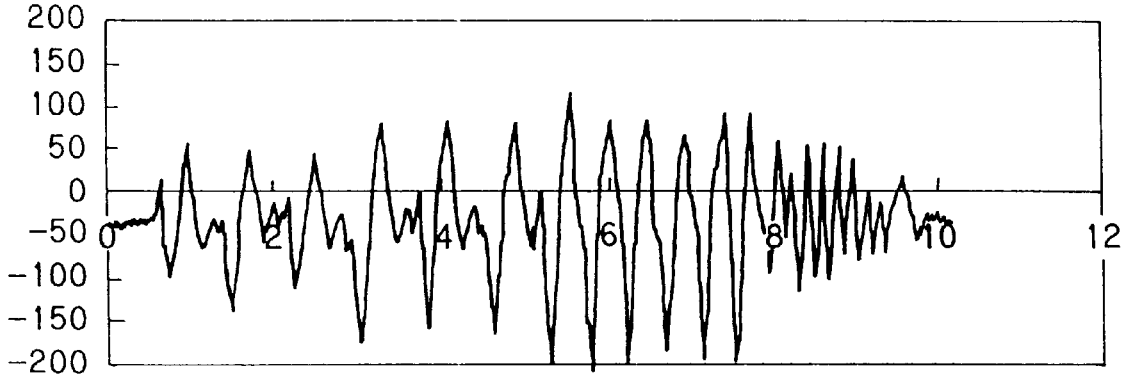
FIG. 44B is a chart showing a vibration waveform produced by making the output shown in FIG. 44A undergo a low pass filter.
Figure 45A:
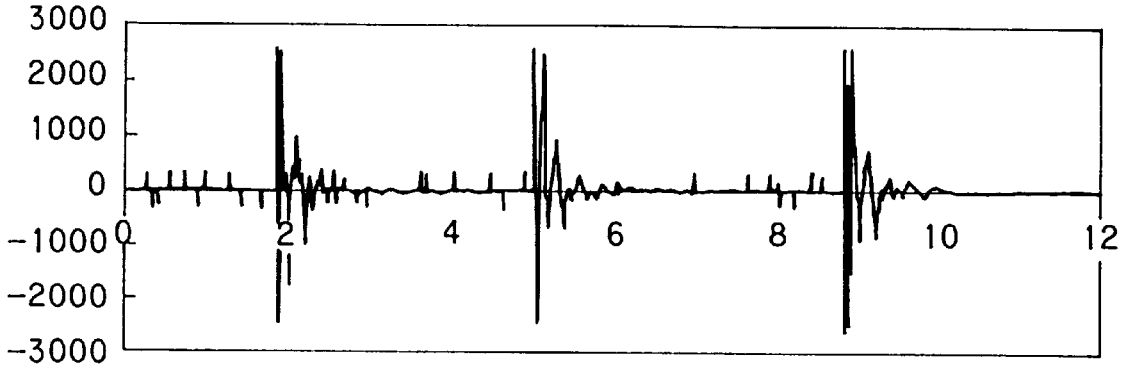
FIG. 45A is a chart showing an output waveform from acceleration sensor when impacts are imparted whilst a drum is unrotated.
Figure 45B:
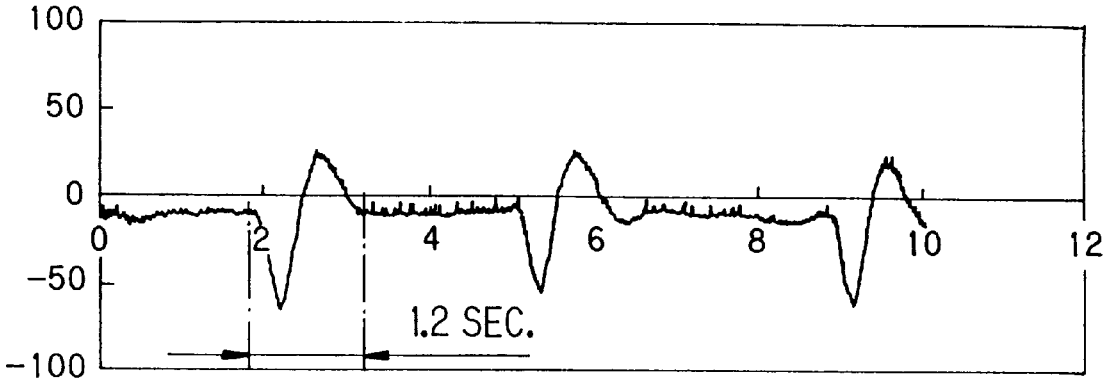
FIG. 45B is a chart showing a vibration waveform produced by making the output shown in FIG. 45A undergo a low pass filter.

Similarly, FIG. 44A is a chart showing an output waveform from the acceleration sensor 220 when impacts were imparted from one direction at varying intervals whilst the drum 203 was unrotated. The waveform shown in FIG. 44B is one which was obtained by processing the output from the acceleration sensor 220 through the low pass filter of 3 Hz. From this figure it is apparent that the system presents good performance in followability. Similarly to the above, FIG. 45A is a chart showing an output waveform from the acceleration sensor 220, where three repeated impacts in one direction were imparted whilst the drum 203 was unrotated. FIG. 45B is a chart showing a waveform which was produced by making the output from the acceleration sensor 220 undergo the low pass filter of 1 Hz. As apparent from FIG. 45B, the vibration caused by one impact in one direction last for 1.2 sec. This period is longer than the period for one revolution of the drum 203, and is not preferable. In practice, when the output waveform was processed through the low pass filter of 3 Hz, the resultant waveform synchronized with the actual vibration of the water tank 202 containing the drum 203.

Figure 46:
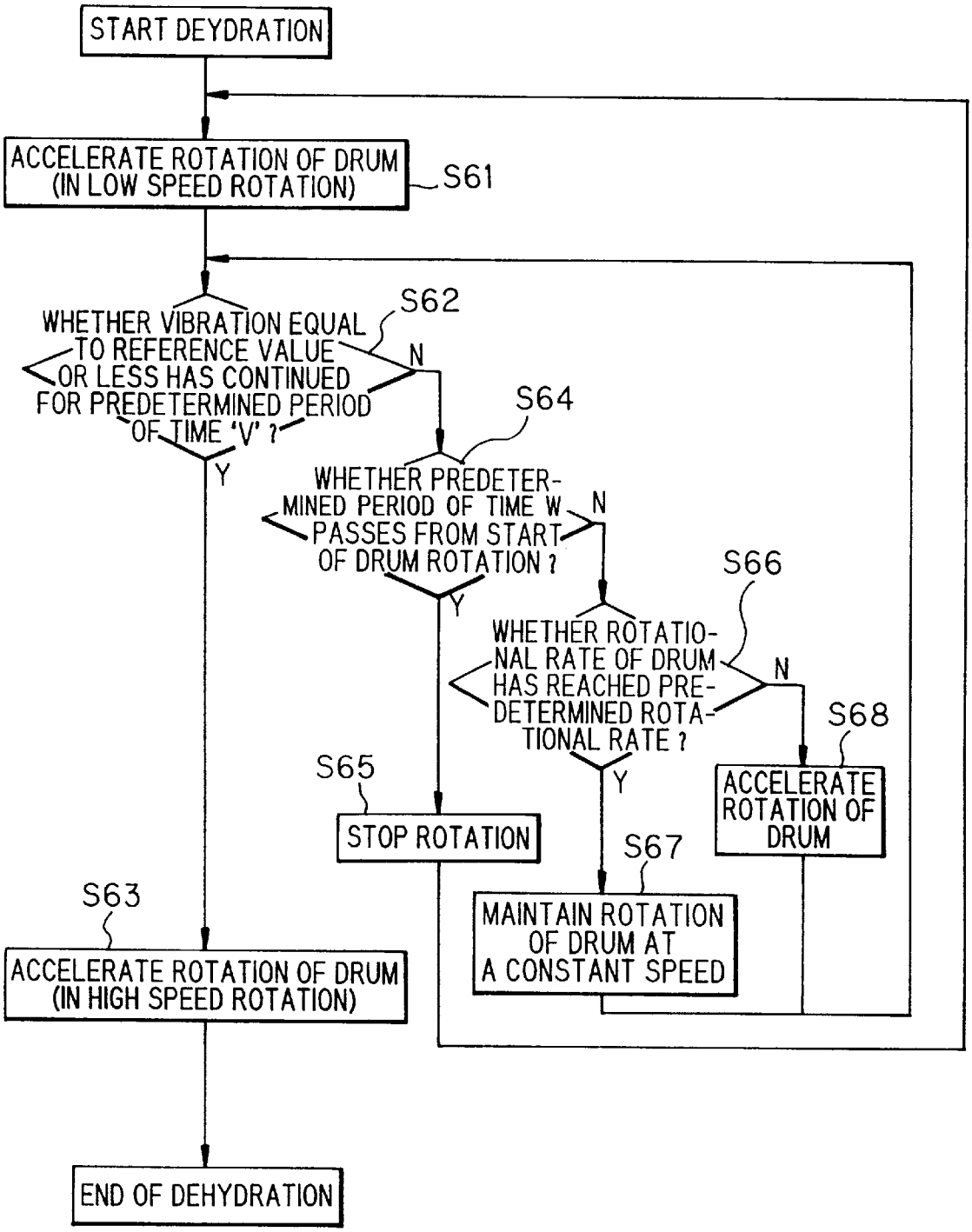
FIG. 46 is a flowchart showing the operation in the dehydrating stage of a drum type drying/washing machine of the invention.
Figure 47A:
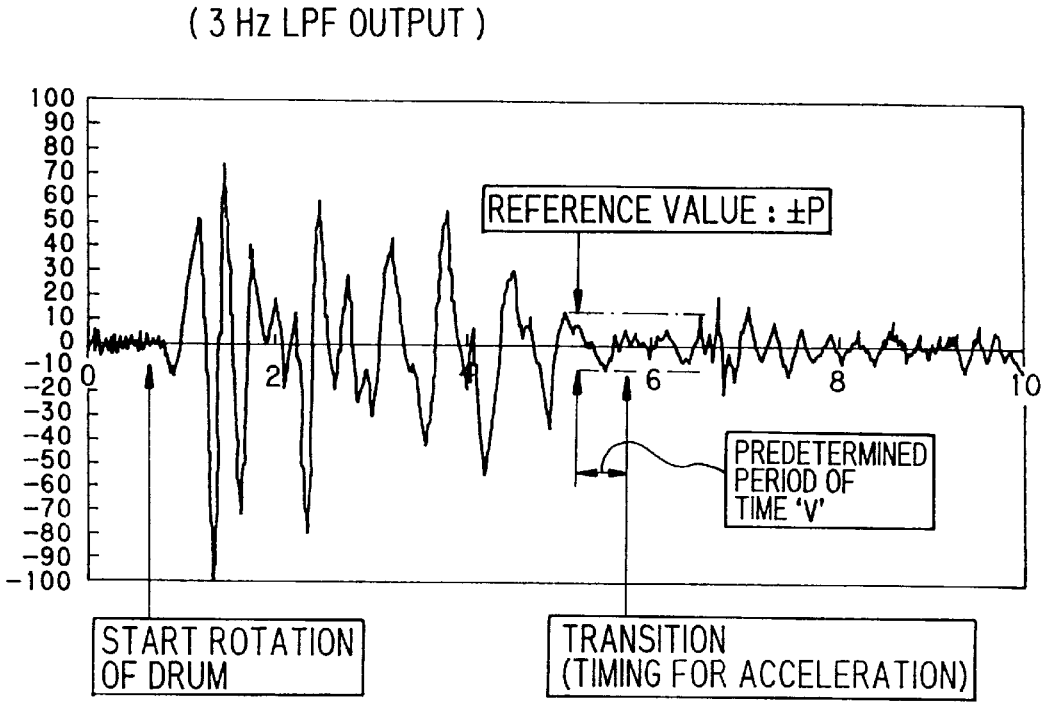
FIGS. 47A and 47B are illustrations for explaining how to obtain a reference value and a predetermined period of time A using a vibration waveform which was processed through a low pass filter, and for showing the timing for mode transition.
Figure 47B:
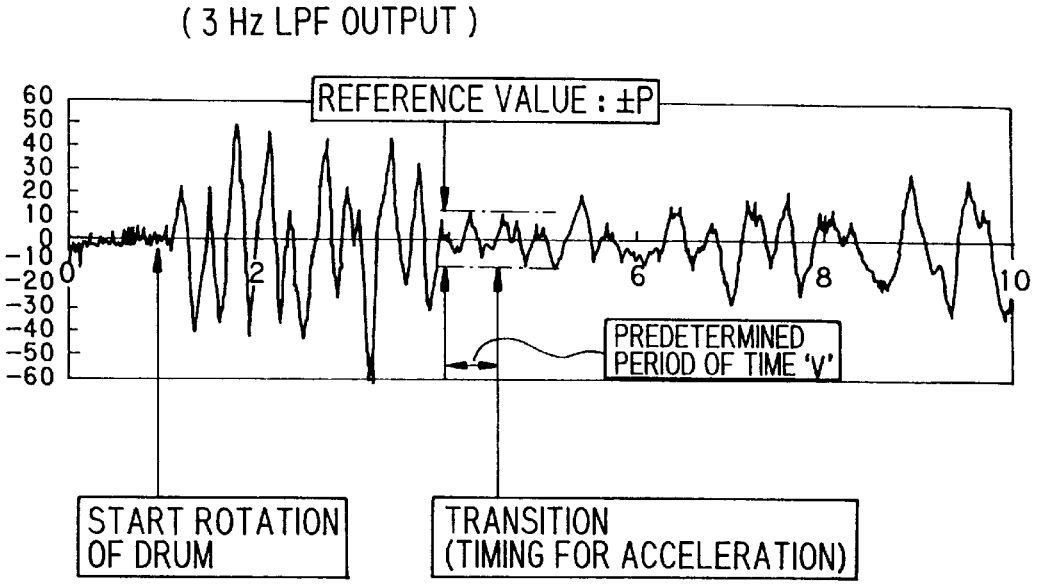

Next, the operation of the dehydration stage of the drum type drying/washing machine in accordance with this embodiment will be described with reference to the flowchart shown in FIG. 46.

First, at Step S61 (S61), the rotation of the drum 203 is accelerated so that the drum 203 will rotate at a low rate. Then, it is judged at Step 62 (S62) whether the absolute value of the output which was obtained by making the waveform of the output from the acceleration sensor 220 undergo the low pass filter of 3 Hz is a reference value P or less. If it is true, another judgment is made of whether the current condition continues for a predetermined period of time V. If these conditions are satisfied (Yes), the operation goes to Step 63 (S63) where the rotation of the drum 203 is accelerated so that the drum 203 will be rotated at a high speed to enter the dehydration running.

At Step 62 (S62), If the above conditions are not satisfied (No), the operation goes to Step 64 (S64) where it is determined whether a predetermined time W (for example) has elapsed from the start of the drum rotation. If the time has elapsed (Yes), the operation goes to Step 65 (S65) where the drum 203 is stopped, and returns to Step 61 (S61), from where the above procedure will be repeated. If the predetermined time W has not elapsed yet (No) at Step 64 (S64), the operation goes to Step 66 (S66) where it is determined whether the rotational rate of the drum has reached a predetermined rotational rate (balance rotational rate). If the rotational rate of the drum has reached the predetermined rotational rate (Yes), the rotational rate is maintained (S67) and the operation returns to Step 61 (S61), from where the above procedure will be repeated. At Step 66 (S66), if the rotational rate of the drum has not reached the predetermined rotational rate (No), the operation goes to Step 68 (S68) where the rotation of the drum 203 is accelerated until the rotational rate reaches the predetermined rotational rate and then the operation returns to Step 61 (S61), form where the above procedure will be repeated.

Figure 48:
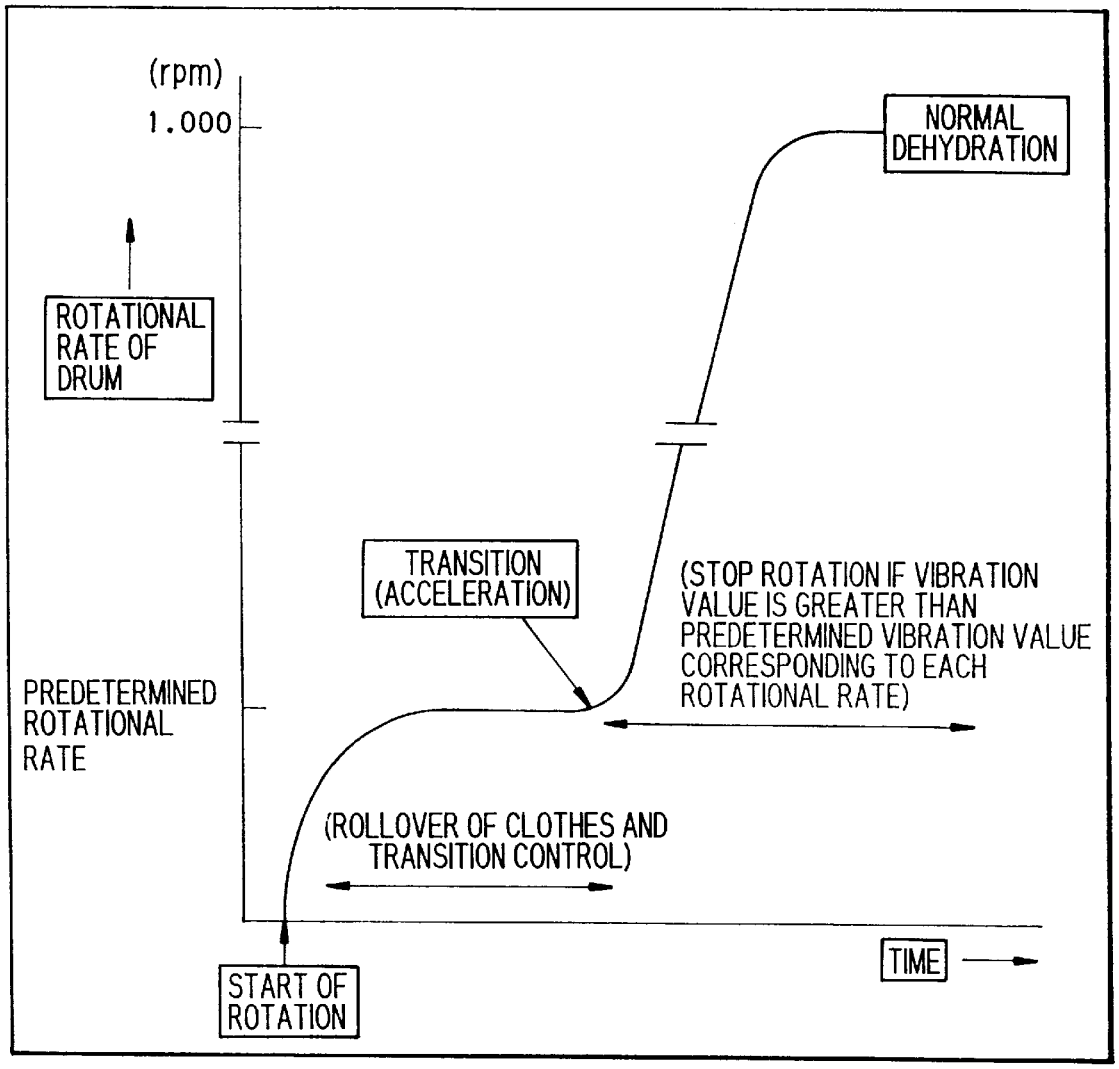
FIG. 48 is a chart showing a pattern of controlling the rotational speed of drum.
Figure 49:
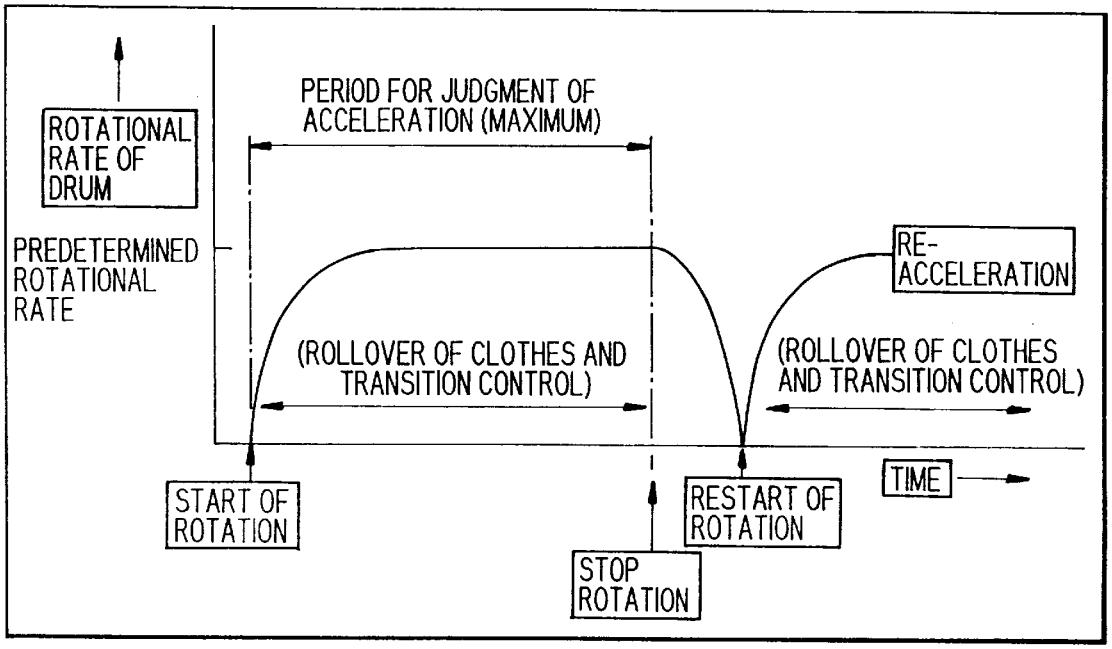
FIG. 49 is a chart showing a pattern of controlling the rotational speed of drum.

Now, the above process which has been described with the flowchart will be explained with reference to the charts for explaining mode transition (acceleration) shown in FIGS. 48 and 49, wherein the abscissa represents time (sec.) and the ordinate represents the rotational rate of the drum. These charts are to show the basic procedures of controlling the rotational rate of the drum with the passage of time. Particularly, FIG. 49 shows a case of mode re-transition.

Next, the balance rotational rate will be described. Here, consider an example in which materials to be processed (clothes) are loaded into the drum 203 having an inside diameter of 46 cm. In this case, in order to make the materials to be processed stick to the drum 203, it is necessary to rotate the drum 203 so that the acceleration of a mass point located on the inner surface of the peripheral wall of the drum 203 will be at least equal to or greater than the gravitational acceleration. When the radius of the drum 203 is represented by 'r', the following relations of a rotational rate 'n' of the drum 203, a circumferential velocity 'v' and an acceleration a will hold:

$$v=2\pi rn \quad \text{(I)}$$

$$\alpha=v^2/r \quad \text{(II)}$$

Now, suppose that r=0.23 m, $\alpha$=9.8 m/s$^2$, then, the rotational rate 'n' is 63 rpm. However, this case corresponds to the case where the materials to be processed have no thickness and therefore this situation is not practical.

Figure 50:
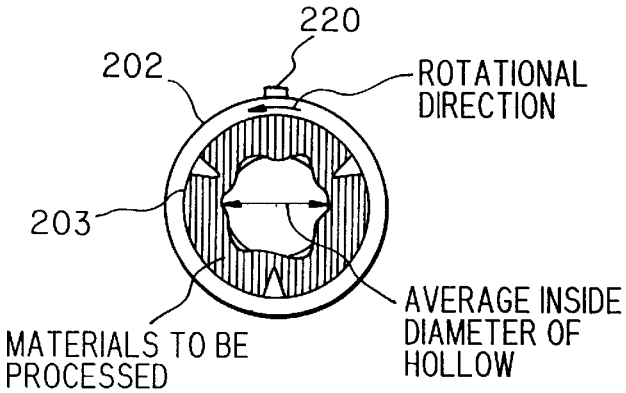
FIG. 50 is a schematic view, which shows conditions of materials to be processed, and especially shows a hollow which is formed in the central part of drum.

Therefore, explained will be the case where the thickness of the materials to be processed is considered. As the drum 203 starts to rotate, the materials to be processed will be pressed against the inner peripheral wall of the drum 203 by the centrifugal force as shown in FIG. 50 so that a hollow will be formed in the central part of the drum 203. Accordingly, when the acceleration of a mass point which is located at the average radius of the hollow is equal to or greater than the gravitational acceleration, the materials as a whole will stick to the inner peripheral wall of the drum 203 as long as the materials are distributed evenly or without any unbalance. Even if there is a portion which causes unbalance, as shown in the projected portion in FIG. 42, the acceleration of a mass point at the projected portion will become smaller than the gravitational acceleration and therefore, the processed material will become able to move (or fall). As a result, the part of the materials to be processed corresponding to the mass point, without sticking to the peripheral wall of the drum 203, will become able to move little by little to change the condition of balance or distribution of the materials to be processed. Thus, the rotational rate of the drum 203 should be selected so that the acceleration of the mass point at the average radius of the hollow may become substantially equal to the gravitational acceleration. In this way, the balance rotational rate can be obtained.

Suppose, for example, the average diameter of the hollow is 24 cm. In order to make the acceleration of a mass point located at the radius equal to the gravitational acceleration, the rotational rate 'n' is calculated to be 86 rpm. from the above formulae (I) and (II). Similarly, when the average diameter is 26 cm, the rotational rate 'n' is 83 rpm. In practice, the optimum balance rotational rate was determined empirically. The result obtained was shown in FIG. 51. From this chart, the balance rotational rate varies depending upon the amount of clothes (materials to be processed). More specifically, the rate becomes greater as the amount of clothes is larger. Here, the drum 203 used in this experiment had a capacity of 6 kg (an inside diameter of 46 cm).

Figure 52:
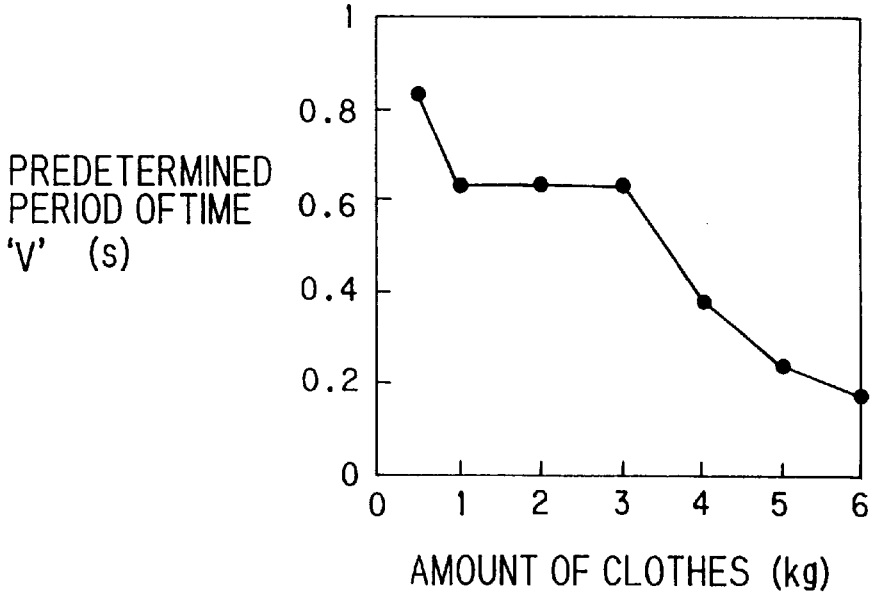
FIG. 52 is a graph showing a relation between the amount of clothes and a predetermined period of time V.

Next, the predetermined period V will be explained. If this predetermined period V is too short, there occurs a risk that the vibrating signal might be judged as small even when the vibration has not converged sufficiently, thus possibly causing a large vibration after the transition to the high speed rotation mode. In contrast, if the predetermined period V is too long, it could happen to miss a chance of the timing of transition to the high speed rotation mode. As shown in FIG. 42, if there is an uneven distribution of clothes inside the drum 203, the water tank 202 containing the drum 203 will sway once to each direction (horizontally) while the drum 203 makes one revolution. Therefore, it is possible to judge whether there is an uneven distribution for every half revolution. This means that the predetermined period V needs to be at least a period during which the drum 203 makes a half revolution. It was found experimentally that the predetermined period V should most preferably be a period which corresponds to a half to one revolution of the drum. FIG. 52 shows a relation between the amount of clothes (materials to be processed) and the predetermined period V.

In FIG. 52, when the amount of clothes is 5 kg and 6 kg, the predetermined period V becomes smaller than the period for allowing drum 203 to make a half revolution. However, for those cases, it was detected in the experiment that uneven distribution of clothes was too small. This can be explained as follows: As an increased amount of clothes is loaded into the limited capacity of the drum 203, the hollow which will be formed in the central part of the drum 203 becomes small. Therefore, uneven distribution of the same level will cause less influence and consequently, the permissible amount of unbalance will become large. As a result, it is possible to make the reference value (±P) large. In practice, when the reference value (±P) is fixed as in the case for the other amount of clothes, the predetermined period V should be adjusted. Therefore, it is possible to set the predetermined period V at a time equal to or shorter than the period for a half revolution of the drum.

Figure 53:
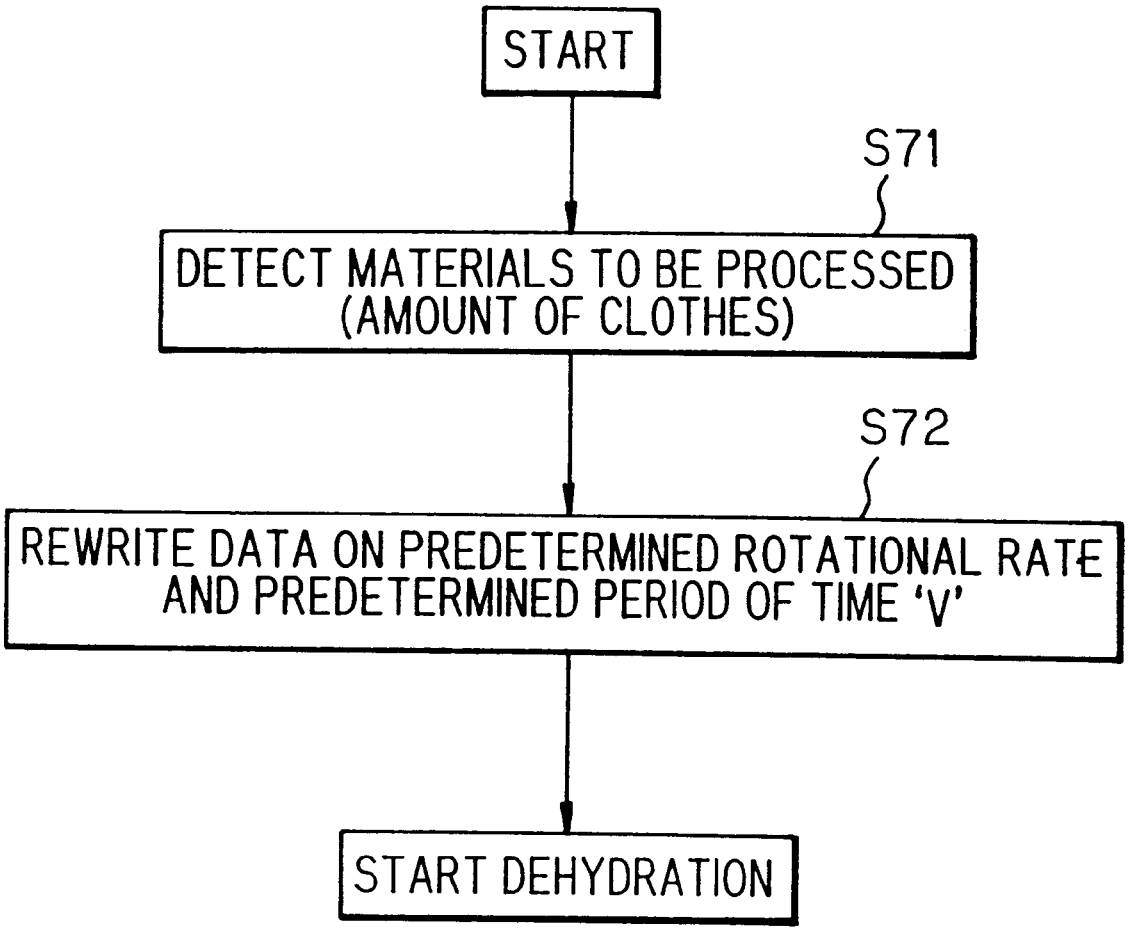
FIG. 53 is a flowchart showing the operation when the balance rotational rate and predetermined period of time V are changed in accordance with the amount of materials to be processed.

Subsequently, referring to the flowchart in FIG. 53, description will be made of a case where the balance rotational rate and the predetermined period V will be varied in accordance with the amount of materials to be processed (clothes). In FIG. 53, first, the amount of clothes is detected at Step 71 (S71). Typically, there are two types of means for detecting the amount of clothes. One type is to determine it based on the absorbed amount of water into laundry. That is, after laundry is loaded into the rotatable drum, the washing operation is started. Then, the water supply valve is opened to supply water from the top of the water tank. When the water-level sensor detects a preset level, the drum will rotate. As the laundry absorbs the water, the water level lowers. When the water-level sensor detects the reduction of the level of water, the water supply valve will be opened to restart water supply. The amount of water supplied at this time is used to determine the amount of the laundry.

The other method uses the inertia of laundry. First, laundry is loaded into the rotatable drum. Before starting the washing operation, the motor is activated to rotate the drum without water. The rotation of the drum is controlled to accelerate the drum to the high speed rotation so that the laundry will uniformly be attached to the inner peripheral wall of the drum by centrifugal force. After the drum has been rotated for a predetermined time, the motor will be deactivated. The period from the deactivation until the drum stops will become long if a large amount of clothes is loaded and will become short if a small amount is loaded. That is, the time to the stoppage will be proportional to the amount of clothes. This property is used to detect the amount of clothes. This embodiment uses the latter method.

Figure 51:
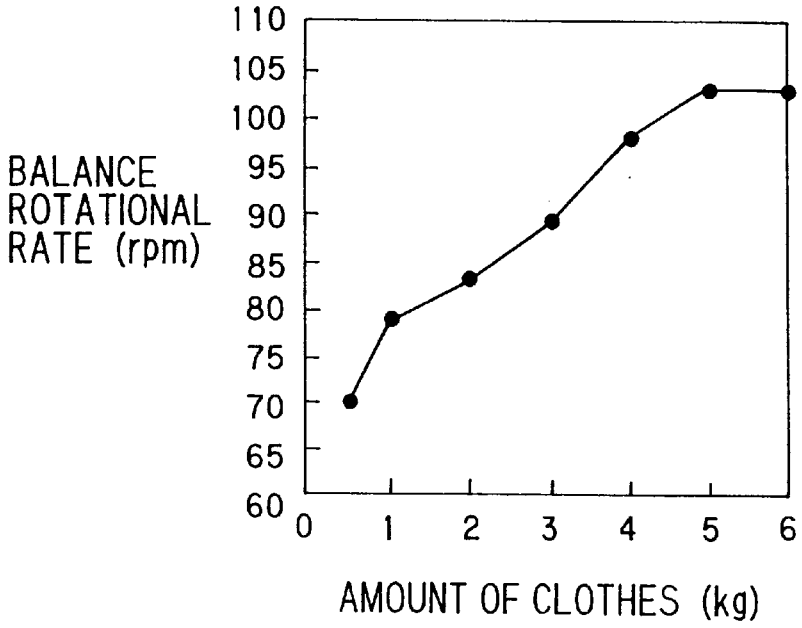
FIG. 51 is a graph showing a relation between the balance rotational rate and the amount of clothes.

After the amount of clothes is detected at Step 71 (S71) in the manner as stated above, based on the detected amount of clothes, the optimum balance rotational rate and the optimum predetermined time V are obtained from FIGS. 51 and 52, respectively. Then the data on the balance rotational rate and the data on the predetermined period V are rewritten. Thus the rewritten balance rotational rate and predetermined period V are adopted as the conditions for dehydration, and the operation will be performed in accordance with the flowchart in FIG. 46.

Although in the above description of this embodiment, a drum type drying/washing machine which performs washing, dehydration and drying was explained, the present invention can also be applied to drum type washing machines which perform washing and dehydration, to drum type dryers dedicated only to drying. Further, the above description of the embodiment has been made of a drum type drying/washing machine of a front loading type using a single shaft-supported drum. The present invention, however, can be applied to a double shaft-supported type or a top loading type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drum type drying/washing machine, comprising:

a drum, adapted to accommodate laundry, including a number of holes on a peripheral wall thereof and a baffle for agitating laundry;

a water tank enclosing said drum and supporting said drum rotatably about a horizontal axis;

driving means for imparting driving force to rotate said drum in forward and reverse directions;

heating means for heating air to be supplied to said drum; and control means for controlling said driving means to rotate said drum at least two levels of low and high rotational rates during a drying operation, wherein after completion of dehydration occurring at the high speed rotation, said control means controls said driving means such that said drum is either stopped for a predetermined period of time, or is stopped for a predetermined period of time and is then rotated in the reverse direction at a low speed, in order to separate laundry sticking to the peripheral wall of said drum.

2. A drum type drying/washing machine, comprising:

a drum, adapted to accommodate laundry, including a number of holes on a peripheral wall thereof and a baffle for agitating laundry;

a water tank enclosing said drum and supporting said drum rotatably about a horizontal axis;

driving means for imparting driving force to rotate said drum in forward and reverse directions;

heating means for heating air to be supplied to said drum; and control means for controlling said driving means such that said drum is rotated for a predetermined period of time at a high speed, once or a plurality of times, in order to dehydrate the laundry heated by a warm air from the heating means at an initial stage of a drying operation.

3. The drum type drying/washing machine according to claim 2, wherein, at the initial stage of the drying operation, said control means controls said heating means so as to reduce output power thereof.

4. The drum type drying/washing machine according to claim 2, wherein after the completion of the dehydration by the high speed rotation, said control means controls said driving means such that said drum is either stopped for a predetermined period of time, or is stopped for a predetermined period of time and then is rotated in the reverse direction at a low speed, in order to separate laundry sticking to the peripheral wall of said drum.

5. The drum type drying/washing machine according to claim 2, wherein, when the drying operation is performed with the high speed rotating dehydration or when the drying operation is performed with a low speed rotation, said control means controls said heating means and said driving means such that a total output power of an output power from said heating means and an output power of said driving means is equal to or less than a predetermined value.

6. A drum type drying/washing machine, comprising:

a drum, rotatably incorporated inside a machine body, for accommodating laundry;

driving means for rotationally driving said drum;

air-blowing means for reintroducing air, exhausted from said drum, back into said drum through a circulating passage;

dehumidifying means for dehumidifying the air inside the circulating passage by cooling the air using cooling water;

heating means for heating the dehumidified air;

exhausted air temperature detecting means for detecting a temperature of the air exhausted from said drum; and control means for controlling said driving means and said heating means based on the temperature detected by said exhausted air temperature detecting means, wherein said control means controls said heating means to turn on at a final dehydration operation prior to shifting to a drying operation and controls said driving means such that dehydration is performed even during the drying operation.

7. The drum type drying/washing machine according to claim 6, further comprising input means for inputting to said control means an option of whether said heating means is allowed to turn on after the completion of the final dehydration operation without shifting to the drying operation.

8. The drum type drying/washing machine according to claim 6, wherein said control means controls said driving means to rotate said drum at a predetermined high speed and to thereafter stop the driving to said drum, and detects time from the stop of the driving until said drum, rotating due to inertia, stops rotating, to estimate the weight of the laundry.

9. The drum type drying/washing machine according to claim 6, wherein the circulating passage has a hatch capable of opening/closing to discharge the air inside the circulating passage out of the machine body, and said control means opening said hatch based on the temperature detected by said exhausted air temperature detecting means.

10. A drum type drying/washing machine, comprising:

a drum, rotatably supported inside a housing, for accommodating materials to be processed and a supporting body further supported inside the housing;

driving means for rotationally driving said drum;

control means for controlling said driving means to shift to a high speed rotation after said drum is rotated at a low speed at which the materials to be processed can roll over inside said drum; and unbalance detector, adapted to detect uneven distribution of the materials to be processed inside said drum, the unbalance detector further including a vibration detector, adapted to detect displacement of the supporting body;

wherein said control means controls said driving means to rotate said drum at a low speed rotation at a balance rotational rate at which part of the materials to be processed around the rotary central axis of said drum can roll over, and said control means allows said driving means to accelerate said drum to the high speed rotation during a drying operation when an output from said vibration detector is equal to or less than a predetermined level.

11. The drum type drying/washing machine according to claim 10, wherein said vibration detector outputs a vibrating waveform in accordance with the vibration of said supporting body, and said control means allows said driving means to accelerate said drum to the high speed rotation when at least one of peak-to-peak values in the vibrating waveform is equal to or less than a predetermined value, and said vibrating waveform outputted from said vibration detecting means intersects a zero-level line.

12. The drum type drying/washing machine according to claim 11, wherein the output from said vibration detector is processed through a low pass filter.

13. The drum type drying/washing machine according to claim 11, wherein only when a predetermined number of peak-to-peak values in a row are all equal to or less than the predetermined value, does said controlling means control said driving means to accelerate said drum to the high speed rotation.

14. The drum type drying/washing machine according to claim 11, wherein when said drum has not started rotating with acceleration within a predetermined period of time after said controlling means outputs a signal for accelerating said drum to the high speed rotation, said control means increases a number of peak-to-peak values to be used for a next judgment.

15. The drum type drying/washing machine according to claim 10, wherein the balance rotational rate is a positive value when an acceleration of a mass point on the inner peripheral wall of said drum becomes equal to or greater than gravitational acceleration.

16. The drum type drying/washing machine according to claim 10, wherein when in the low speed rotation the output from said vibration detector exceeds the predetermined value within a predetermined period of time, said control means controls said driving means such that said drum is either stopped or is rotated at a rotational rate lower than the balance rotational rate, and thereafter said drum is rotated again at a restored rotational rate.

17. The drum type drying/washing machine according to claim 10, wherein when, in the low speed rotation, the output from said vibration detector exceeds the predetermined value within a predetermined period of time, said control means controls said driving means such that in the high speed rotation, said drum is rotated at a lower rotational rate than a rotational rate in the normal high speed rotation.

18. The drum type drying/washing machine according to claim 10, wherein when, in the low speed rotation the output from said vibration detector exceeds the predetermined value within a predetermined period of time, said control means controls said driving means such that in the high speed rotation, said drum is rotated at a lower rotational rate than a rotational rate in the normal high speed rotation and is rotated for a longer period of time than a period of time in the normal high speed rotation.

19. A drum type drying/washing machine, comprising:

a drum, rotatably supported inside a housing, for accommodating materials to be processed and a supporting body further supported inside the housing;

driving means for rotationally driving said drum;

control means for controlling said driving means to shift to a high speed rotation after said drum is rotated at a low speed, at which the materials to be processed can roll over inside said drum; and unbalance detector, adapted to detect uneven distribution of the materials to be processed inside said drum, the unbalance detector further including a vibration detector, adapted to detect vibration of the supporting body in a direction perpendicular to a rotary central axis of the drum, wherein said control means controls said driving means such that said drum is rotated in a low speed rotation at a balance rotational rate above which the materials to be processed as a whole stick to an inner peripheral wall of said drum, and said control means allows said driving means to accelerate said drum to a high speed rotation during a drying operation when an absolute value of an output from said vibration detector is equal or less than a reference value and continues for a predetermined period of time.

20. The drum type drying/washing machine according to claim 19, wherein said control means changes the balance rotational rate in accordance with an amount of the materials to be processed.

21. The drum type drying/washing machine according to claim 20, wherein said control means changes the predetermined period of time in accordance with the balance rotational rate.

22. The drum type drying/washing machine according to claim 19, wherein the output from said vibration detector is processed through a low pass filter of about 3 Hz.

23. The drum type drying/washing machine according to claim 19, wherein the predetermined period of time is set to be equal to or longer than a period of time during which said drum rotates in a half revolution and is set to be equal to or shorter than a period of time during which said drum rotates in one revolution.

24. A drum type drying/washing machine, comprising:

a drum, adapted to accommodate laundry, including a number of holes on a peripheral wall thereof and a baffle for agitating laundry;

a water tank enclosing said drum and supporting said drum rotatably about a horizontal axis;

driving means for imparting driving force to rotate said drum in forward and reverse directions;

heating means for heating air to be supplied to said drum;

control means for controlling said driving means to rotate said drum at at least two levels of low and high rotational rates during a drying operation, and unbalance detector, adapted to detect uneven distribution of the materials to be processed inside said drum, the unbalance detector further including a vibration detector, adapted to detect displacement of the supporting body;

wherein after completion of dehydration occurring at the high speed rotation, said control means controls said driving means such that said drum is either stopped for a predetermined period of time, or is stopped for a predetermined period of time and is then rotated in the reverse direction at a low speed, in order to separate laundry sticking to the peripheral wall of said drum, and wherein said control means controls said driving means to rotate said drum at a low speed rotation at a balance rotational rate at which part of the materials to be processed around the rotary central axis of said drum can roll over, and said control means controls said driving means to accelerate said drum to the high speed rotation during a drying operation when an output from said vibration detector is equal to or less than a predetermined level.

25. The drum type drying/washing machine of claim 24, wherein the balance rotational rate is a positive value when an acceleration of a mass point on the inner peripheral wall of said drum becomes equal to or greater than gravitational acceleration.

26. The drum type drying/washing machine of claim 25, wherein said control means changes the balance rotational rate in accordance with an amount of the materials to be processed.

* * * * *